US011691241B1

(12) United States Patent
Duescher et al.

(10) Patent No.: US 11,691,241 B1
(45) Date of Patent: Jul. 4, 2023

(54) ABRASIVE LAPPING HEAD WITH FLOATING AND RIGID WORKPIECE CARRIER

(71) Applicants: Wayne O. Duescher, Roseville, MN (US); Cameron M. Duescher, Lino Lakes, MN (US)

(72) Inventors: Wayne O. Duescher, Roseville, MN (US); Cameron M. Duescher, Lino Lakes, MN (US)

(73) Assignee: KELTECH Engineering, Inc., Rosemount, MN (US)

( * ) Notice: Subject to any disclaimer, the term of this patent is extended or adjusted under 35 U.S.C. 154(b) by 326 days.

(21) Appl. No.: 16/985,764

(22) Filed: Aug. 5, 2020

Related U.S. Application Data

(60) Provisional application No. 62/882,827, filed on Aug. 5, 2019.

(51) Int. Cl.
*B24B 37/04* (2012.01)
*B24B 37/20* (2012.01)

(52) U.S. Cl.
CPC ..... *B24B 37/042* (2013.01); *B24B 37/20* (2013.01)

(58) Field of Classification Search
CPC ..... B24B 37/12; B24B 37/30; B24B 37/042; B24B 37/32; B24B 49/16
USPC ..... 451/285, 287, 288, 289, 363, 388, 398
See application file for complete search history.

(56) References Cited

U.S. PATENT DOCUMENTS 4,270,316 A * 6/1981 Kramer ..... B24B 37/042 451/63
4,593,495 A * 6/1986 Kawakami ..... B24B 37/105 451/291
4,811,522 A * 3/1989 Gill, Jr. ..... B24B 7/16 451/285
4,918,870 A * 4/1990 Torbert ..... B24B 37/102 451/287
5,205,082 A * 4/1993 Shendon ..... B24B 37/30 451/283
5,329,732 A * 7/1994 Karlsrud ..... G05B 19/41825 451/334
5,335,453 A * 8/1994 Baldy ..... B24B 37/30 451/41

(Continued)

*Primary Examiner* — Joel D Crandall
*Assistant Examiner* — Robert F Neibaur
(74) *Attorney, Agent, or Firm* — DeWitt LLP

(57) ABSTRACT

Embodiments of a high-speed rotatable workpiece abrasive polishing head are disclosed that allow flat surfaced hard material workpieces or sapphire or semiconductor wafers to be polished at high abrading speeds that can use water-mist cooled quick-change fixed abrasive island-type discs. Workpieces can be quickly attached with vacuum to a rotatable workpiece plate having a curved (e.g., spherical) bearing with an offset spherical center of rotation located at the workpiece abraded surface. Abrading contact there prevents lateral abrading friction forces from tilting workpieces and causing non-flat workpiece surfaces. The workpiece carrier plate can be rotationally driven by a floating drive shaft having a spherical spline head that contacts the workpiece carrier plate at a position close to the workpiece abraded surface to avoid tilting of the workpiece due to the shaft-applied workpiece rotation forces. The workpiece head can allow the workpieces to either float in contact with the abrasive or be held in rigid contact with the abrasive.

20 Claims, 17 Drawing Sheets

(56) References Cited

U.S. PATENT DOCUMENTS 5,364,655 A * 11/1994 Nakamura ..... B24B 49/14 427/209
5,421,768 A * 6/1995 Fujiwara ..... B24B 53/017 451/286
5,423,716 A * 6/1995 Strasbaugh ..... B24B 37/30 269/21
5,443,416 A * 8/1995 Volodarsky ..... B24B 37/0053 451/388
5,449,316 A * 9/1995 Strasbaugh ..... B24B 37/30 451/388
5,569,062 A * 10/1996 Karlsrud ..... B24B 53/017 451/285
5,597,346 A * 1/1997 Hempel, Jr. ..... B24B 53/017 451/36
5,643,053 A * 7/1997 Shendon ..... B24B 37/30 451/291
5,643,067 A * 7/1997 Katsuoka ..... B24B 53/017 451/271
5,683,289 A * 11/1997 Hempel, Jr. ..... B24B 53/017 451/443
5,738,574 A * 4/1998 Tolles ..... B24B 53/017 451/247
5,769,697 A * 6/1998 Nishio ..... B24B 37/042 451/286
5,800,254 A * 9/1998 Motley ..... B24B 37/04 451/287
5,874,318 A * 2/1999 Baker ..... H01L 21/67253 257/E21.583
5,910,041 A * 6/1999 Duescher ..... B24B 37/042 451/28
5,916,009 A * 6/1999 Izumi ..... B24B 37/04 451/24
5,944,583 A * 8/1999 Cruz ..... B24B 37/26 451/287
5,960,697 A * 10/1999 Hayase ..... F04B 1/324 417/269
5,961,169 A * 10/1999 Kalenian ..... H01L 21/67259 269/21
5,964,651 A * 10/1999 Hose ..... B24B 7/17 451/291
5,964,653 A * 10/1999 Perlov ..... B24B 37/32 451/286
5,967,882 A * 10/1999 Duescher ..... B24B 37/12 451/550
5,975,997 A * 11/1999 Minami ..... B24B 37/08 451/63
5,985,093 A * 11/1999 Chen ..... B24B 53/017 451/36
5,989,104 A * 11/1999 Kim ..... B24B 37/30 451/287
5,993,298 A * 11/1999 Duescher ..... B24B 37/107 451/444
5,993,302 A * 11/1999 Chen ..... B24B 37/32 451/41
6,024,630 A * 2/2000 Shendon ..... B24B 37/32 451/286
6,027,398 A * 2/2000 Numoto ..... B24B 41/06 451/287
6,048,254 A * 4/2000 Duescher ..... B24B 37/245 451/28
6,050,882 A * 4/2000 Chen ..... B24B 37/30 451/41
6,056,632 A * 5/2000 Mitchel ..... B24B 37/32 451/286
6,074,277 A * 6/2000 Arai ..... B24B 37/105 451/287
6,080,050 A * 6/2000 Chen ..... B24B 37/30 451/388
6,089,959 A * 7/2000 Nagahashi ..... B24B 37/08 451/262
6,102,777 A * 8/2000 Duescher ..... B24B 41/061 451/36
6,116,993 A * 9/2000 Tanaka ..... B24B 37/04 451/446
6,120,352 A * 9/2000 Duescher ..... B24B 37/26 451/287
6,126,116 A * 10/2000 Cellier ..... B64G 1/1085 455/12.1
6,132,298 A * 10/2000 Zuniga ..... B24B 37/30 451/41
6,146,259 A * 11/2000 Zuniga ..... B24B 49/16 451/288
6,149,506 A * 11/2000 Duescher ..... B24B 1/00 451/36
6,159,073 A * 12/2000 Wiswesser ..... B24B 37/04 451/6
6,162,116 A * 12/2000 Zuniga ..... B24B 37/32 451/288
6,165,056 A * 12/2000 Hayashi ..... B24B 41/068 451/550
6,168,506 B1 * 1/2001 McJunken ..... B24B 37/08 451/259
6,179,956 B1 * 1/2001 Nagahara ..... B24B 37/30 438/692
6,183,354 B1 * 2/2001 Zuniga ..... B24B 37/32 451/287
6,217,433 B1 * 4/2001 Herrman ..... B24D 7/06 451/268
6,224,472 B1 * 5/2001 Lai ..... B24B 37/32 451/288
6,251,215 B1 * 6/2001 Zuniga ..... B24B 37/30 451/286
6,270,392 B1 * 8/2001 Hayashi ..... B24B 37/105 451/60
6,299,741 B1 * 10/2001 Sun ..... H01L 21/32115 204/230.2
6,371,838 B1 * 4/2002 Holzapfel ..... B24B 53/12 451/72
6,390,901 B1 * 5/2002 Hiyama ..... B24B 37/11 451/287
6,390,905 B1 * 5/2002 Korovin ..... B24B 37/30 451/286
6,394,882 B1 * 5/2002 Chen ..... B24B 41/061 451/41
6,398,906 B1 * 6/2002 Kobayashi ..... B24B 41/061 156/345.12
6,425,809 B1 * 7/2002 Ichimura ..... B24B 37/26 451/287
6,436,828 B1 * 8/2002 Chen ..... B24B 1/005 438/692
6,439,965 B1 * 8/2002 Ichino ..... B24B 37/22 451/36
6,439,978 B1 * 8/2002 Jones ..... B24B 21/04 451/41
6,443,821 B1 * 9/2002 Kimura ..... B24B 37/32 451/41
6,447,368 B1 * 9/2002 Fruitman ..... B24B 49/04 451/287
6,491,570 B1 * 12/2002 Sommer ..... B24B 37/20 451/388
6,506,105 B1 * 1/2003 Kajiwara ..... B24B 49/16 451/288
6,558,232 B1 * 5/2003 Kajiwara ..... B24B 49/16 451/41
6,585,567 B1 * 7/2003 Black ..... B24B 57/02 451/36
6,592,434 B1 * 7/2003 Vanell ..... B24B 37/30 451/41
6,592,439 B1 * 7/2003 Li ..... B24B 21/04 451/296
6,607,157 B1 * 8/2003 Duescher ..... B65H 27/00 242/417.3
6,663,466 B2 * 12/2003 Chen ..... B24B 49/00 451/287
6,672,949 B2 * 1/2004 Chopra ..... B24B 37/26 451/287
6,712,673 B2 * 3/2004 Albrecht ..... B24B 37/30 451/63

(56) References Cited

U.S. PATENT DOCUMENTS 6,729,944 B2 * 5/2004 Birang ..... B24D 7/12 451/490
6,752,700 B2 * 6/2004 Duescher ..... B24D 11/00 451/527
6,769,969 B1 * 8/2004 Duescher ..... B24B 1/00 451/36
6,837,779 B2 * 1/2005 Smith ..... B24B 21/04 451/60
6,893,332 B2 * 5/2005 Castor ..... B24B 37/30 451/41
6,899,603 B2 * 5/2005 Homma ..... B24B 37/30 451/286
6,899,607 B2 * 5/2005 Brown ..... B24B 49/16 451/288
6,899,609 B2 * 5/2005 Hong ..... B24B 37/04 451/60
6,908,366 B2 * 6/2005 Gagliardi ..... B24B 37/245 451/41
6,935,013 B1 * 8/2005 Markevitch ..... B24B 37/042 29/603.18
7,001,251 B2 * 2/2006 Doan ..... B24D 9/085 451/494
7,001,257 B2 * 2/2006 Chen ..... B24B 37/30 451/288
7,008,295 B2 * 3/2006 Wiswesser ..... B24B 37/013 451/6
7,008,303 B2 * 3/2006 White ..... B24B 37/16 451/41
7,014,535 B2 * 3/2006 Custer ..... B24B 37/30 438/689
7,018,275 B2 * 3/2006 Zuniga ..... B24B 37/013 451/286
7,018,906 B2 * 3/2006 Chen ..... H01L 21/76229 438/791
7,029,380 B2 * 4/2006 Horiguchi ..... B24B 37/08 451/41
7,033,251 B2 * 4/2006 Elledge ..... B24B 37/30 451/41
7,044,838 B2 * 5/2006 Maloney ..... B24B 49/16 451/63
7,081,042 B2 * 7/2006 Chen ..... B24B 37/345 451/388
7,086,929 B2 * 8/2006 Wiswesser ..... B24B 49/04 451/6
7,097,544 B1 * 8/2006 Tolles ..... B24B 37/30 451/274
7,101,272 B2 * 9/2006 Chen ..... B24B 37/30 438/692
7,101,273 B2 * 9/2006 Tseng ..... B24B 37/30 451/288
7,125,313 B2 * 10/2006 Zelenski ..... B24B 55/02 451/8
7,137,874 B1 * 11/2006 Bovio ..... B24B 41/04 451/286
7,144,304 B2 * 12/2006 Moore ..... B24B 21/04 451/63
7,147,541 B2 * 12/2006 Nagayama ..... B24B 41/067 451/10
7,166,016 B1 * 1/2007 Chen ..... B24B 27/0023 451/283
7,250,368 B2 * 7/2007 Kida ..... H01L 21/02008 257/E21.228
7,276,446 B2 * 10/2007 Robinson ..... B24B 37/04 438/692
7,292,427 B1 * 11/2007 Murdoch ..... H01L 21/68714 361/234
7,357,699 B2 * 4/2008 Togawa ..... B24B 37/30 451/388
7,367,867 B2 * 5/2008 Boiler ..... B24B 7/17 451/60
7,393,790 B2 * 7/2008 Britt ..... H01L 23/544 438/692
7,419,910 B2 * 9/2008 Minamihaba ..... H01L 21/7684 438/692
7,422,634 B2 * 9/2008 Powell ..... H01L 29/66068 257/E21.321
7,445,847 B2 * 11/2008 Kulp ..... B24D 3/28 451/526
7,446,018 B2 * 11/2008 Brogan ..... H01L 29/66143 438/459
7,452,817 B2 * 11/2008 Yoon ..... H01L 21/31053 438/692
7,456,106 B2 * 11/2008 Koyata ..... H01L 21/30608 438/692
7,456,107 B2 * 11/2008 Keleher ..... C09G 1/02 438/692
7,470,169 B2 * 12/2008 Taniguchi ..... B24B 37/042 451/36
7,485,028 B2 * 2/2009 Wilkinson ..... B24B 37/32 451/28
7,485,241 B2 * 2/2009 Schroeder ..... H01L 21/3212 252/79.3
7,488,235 B2 * 2/2009 Park ..... B24B 37/30 451/10
7,488,236 B2 * 2/2009 Shimomura ..... B24D 3/30 451/41
7,488,240 B2 * 2/2009 Saito ..... B24B 37/30 451/287
7,491,116 B2 * 2/2009 Sung ..... B24D 18/00 451/72
7,491,342 B2 * 2/2009 Kamiyama ..... H01L 21/30608 216/36
7,507,148 B2 * 3/2009 Kitahashi ..... B24B 37/30 451/286
7,510,974 B2 * 3/2009 Li ..... H01L 21/7684 438/692
7,520,798 B2 * 4/2009 Muldowney ..... B24B 37/26 451/527
7,520,800 B2 * 4/2009 Duescher ..... B24D 11/001 451/527
7,527,271 B2 * 5/2009 Oh ..... H01L 21/67005 269/21
7,527,722 B2 * 5/2009 Sharan ..... H01L 21/3212 204/229.4
7,553,214 B2 * 6/2009 Menk ..... B24B 21/04 451/6
7,568,970 B2 * 8/2009 Wang ..... B24B 37/22 451/288
7,572,172 B2 * 8/2009 Aoyama ..... B24B 37/30 451/60
7,579,071 B2 * 8/2009 Huh ..... B29C 70/606 51/296
7,582,221 B2 * 9/2009 Netsu ..... B24B 37/345 438/692
7,618,529 B2 * 11/2009 Ameen ..... B23H 5/08 205/663
7,632,434 B2 * 12/2009 Duescher ..... C09K 3/1436 264/13
7,648,410 B2 * 1/2010 Choi ..... B24B 37/26 451/527
7,699,684 B2 * 4/2010 Prasad ..... C09G 1/02 451/6
7,708,621 B2 * 5/2010 Saito ..... B24B 53/017 451/53
7,731,568 B2 * 6/2010 Shimomura ..... B24B 37/205 451/526
7,741,656 B2 * 6/2010 Nakayama ..... H01L 27/0922 257/159
7,753,761 B2 * 7/2010 Fujita ..... B24B 37/04 451/60
7,754,611 B2 * 7/2010 Chen ..... H01L 21/31053 438/692
7,762,870 B2 * 7/2010 Ono ..... B24D 11/001 451/526
7,807,252 B2 * 10/2010 Hendron ..... B24B 37/26 438/692
7,822,500 B2 * 10/2010 Kobayashi ..... B24B 37/005 700/28

(56) References Cited

U.S. PATENT DOCUMENTS 7,833,907 B2 * 11/2010 Anderson ..... H01L 21/3212 438/692
7,838,482 B2 * 11/2010 Fukasawa ..... C09K 3/1463 510/501
7,840,305 B2 * 11/2010 Behr ..... B24B 37/04 700/173
7,883,397 B2 * 2/2011 Zuniga ..... B24B 37/28 451/442
7,884,020 B2 * 2/2011 Hirabayashi ..... B24B 37/24 438/692
7,897,250 B2 * 3/2011 Iwase ..... B24B 37/26 428/315.7
7,922,783 B2 * 4/2011 Sakurai ..... B24D 3/342 451/526
7,950,985 B2 * 5/2011 Zuniga ..... B24B 37/30 451/288
7,955,964 B2 * 6/2011 Wu ..... H01L 21/76883 438/587
7,972,396 B2 * 7/2011 Feng ..... B24B 37/30 51/295
8,002,860 B2 * 8/2011 Koyama ..... C09K 3/1463 451/60
8,021,215 B2 * 9/2011 Zuniga ..... B24B 37/30 451/288
8,025,813 B2 * 9/2011 Liu ..... C09G 1/02 438/692
8,047,899 B2 * 11/2011 Chen ..... B24D 3/346 451/527
8,062,096 B2 * 11/2011 Brusic ..... B24B 13/015 451/92
8,062,098 B2 * 11/2011 Duescher ..... B24B 37/14 451/550
8,066,551 B2 * 11/2011 Chen ..... B24B 37/32 451/57
8,070,909 B2 * 12/2011 Shanmugasundram ..... H01L 21/67276 156/345.13
8,071,479 B2 * 12/2011 Liu ..... C09G 1/02 438/692
8,088,299 B2 * 1/2012 Chen ..... B24B 37/30 451/28
8,101,060 B2 * 1/2012 Lee ..... B24B 37/26 205/640
8,101,093 B2 * 1/2012 de Rege Thesauro ... C09G 1/02 252/79.1
8,256,091 B2 * 9/2012 Duescher ..... B24D 18/00 51/300
8,292,694 B2 * 10/2012 Togawa ..... B24B 41/061 451/7
8,328,600 B2 * 12/2012 Duescher ..... B24B 37/107 451/5
8,332,064 B2 * 12/2012 Torikoshi ..... B24B 37/042 451/36
8,348,720 B1 * 1/2013 Ko ..... B24B 37/042 451/41
8,357,029 B2 * 1/2013 Fukushima ..... B24B 37/30 451/286
8,382,558 B2 * 2/2013 Watanabe ..... B24B 53/017 451/288
8,398,456 B2 * 3/2013 Kobayashi ..... B24B 49/00 451/6
8,407,882 B2 * 4/2013 Seki ..... G11B 5/3169 29/603.18
8,408,970 B2 * 4/2013 Ueda ..... G11B 5/8404 451/41
8,430,717 B2 * 4/2013 Duescher ..... B24B 37/30 451/287
8,545,290 B2 * 10/2013 Abrahamians ..... B24B 37/10 451/10
8,545,583 B2 * 10/2013 Duescher ..... B24D 18/00 51/293
8,592,313 B2 * 11/2013 Yamaguchi ..... B24B 37/345 438/692
8,647,171 B2 * 2/2014 Duescher ..... B24B 37/107 451/5
8,740,668 B2 * 6/2014 Duescher ..... B24B 37/107 451/63
8,758,088 B2 * 6/2014 Duescher ..... B24B 49/12 451/5
8,845,394 B2 * 9/2014 Duescher ..... B24B 37/30 451/287
8,926,411 B2 * 1/2015 Schwappach ..... B24D 11/00 451/340
8,998,677 B2 * 4/2015 Duescher ..... B24B 37/32 451/286
8,998,678 B2 * 4/2015 Duescher ..... B24B 41/04 451/28
9,011,207 B2 * 4/2015 Duescher ..... B24B 37/042 451/41
9,039,488 B2 * 5/2015 Duescher ..... B24B 37/10 451/287
9,079,285 B2 * 7/2015 Kramer ..... B24B 13/00
9,149,904 B1 * 10/2015 Moudry ..... B24B 37/12
9,199,354 B2 * 12/2015 Duescher ..... B24B 37/30
9,233,452 B2 * 1/2016 Duescher ..... B24B 37/30
9,403,255 B2 * 8/2016 Fukushima ..... B24B 49/16
9,604,339 B2 * 3/2017 Duescher ..... B24B 37/042
9,849,557 B2 * 12/2017 Shinozaki ..... B24B 37/105
2020/0392988 A1 * 12/2020 Hagiwara ..... B60B 27/0084

* cited by examiner

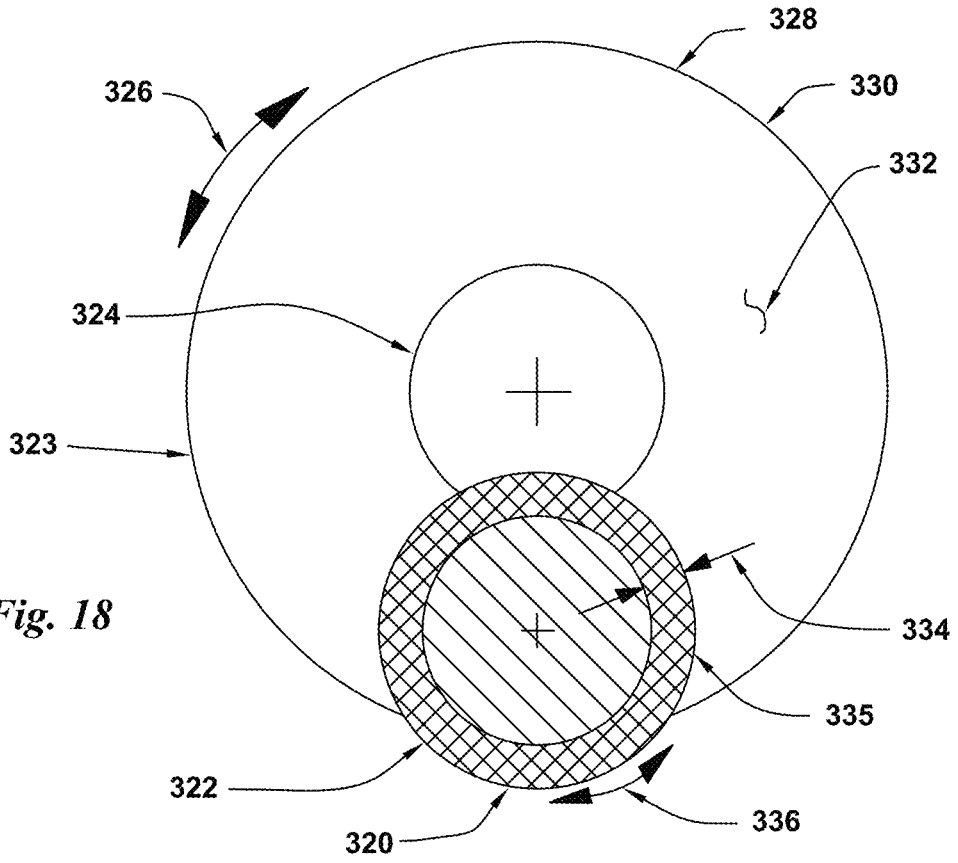
*Fig. 18*
*Fig. 19*
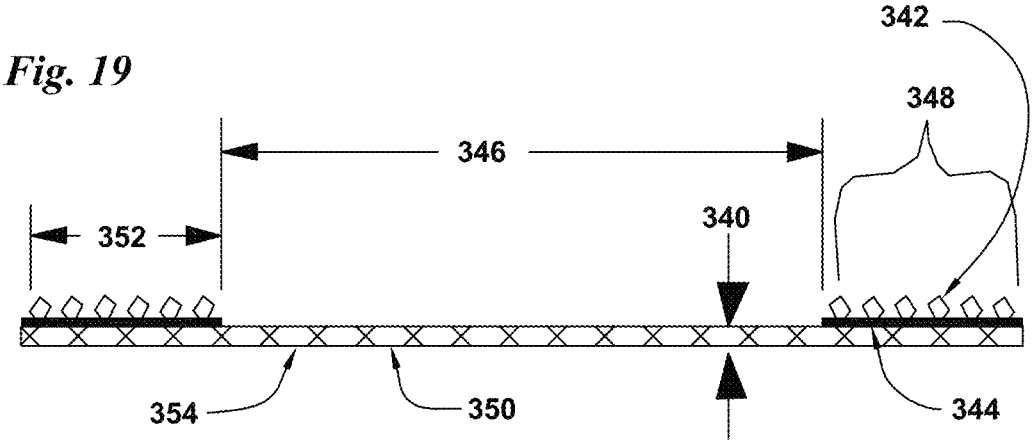

ABRASIVE LAPPING HEAD WITH FLOATING AND RIGID WORKPIECE CARRIER

CROSS-REFERENCE TO RELATED APPLICATION

The present patent application claims the benefit of priority to U.S. Provisional Patent Application Ser. No. 62/882,827, filed Aug. 5, 2019. The aforementioned patent application is incorporated by reference herein in its entirety for any purpose whatsoever.

BACKGROUND

Field

The present disclosure relates to the field of abrasive treatment of surfaces such as grinding, polishing and lapping.

Description of Related Art

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring.

U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

Various abrading machines and abrading processes are described in U.S. Pat. No. 5,364,655 (Nakamura et al), U.S. Pat. No. 6,712,673 (Albrecht, et al), U.S. Pat. No. 7,097,544 (Tolles et al), U.S. Pat. No. 7,137,874 (Bovio, et al), U.S. Pat. No. 7,255,632 (Tolles et al), U.S. Pat. No. 8,292,694 (Togawa et al), U.S. Pat. No. 8,332,064 (Torikoshi et al), U.S. Pat. No. 8,348,720 (Ko), U.S. Pat. No. 8,357,029 (Fukushima et al), U.S. Pat. No. 8,382,558 (Watanabe et al), U.S. Pat. No. 8,398,456 (Kobayashi et al), U.S. Pat. No. 8,407,882 (Seki et al), U.S. Pat. No. 8,408,970 (Ueda), U.S. Pat. No. 8,480,456 (Ko), U.S. Pat. No. 8,545,290 (Abrahamians et al), U.S. Pat. No. 8,592,313 (Yamaguchi et al), U.S. Pat. No. 8,734,207 (Ko), U.S. Pat. No. 8,926,411 (Schwappach et al), U.S. Pat. No. 9,079,285 (Kramer et al), U.S. Pat. No. 9,149,904 (Moudry et al), and U.S. Pat. No. 9,403,255 (Fukushima et al).

Further various abrading machines and abrading processes are described in U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (Hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

Also, various CMP machines, resilient pads, materials and processes are described in U.S. Pat. No. 8,101,093 (de Rege Thesauro et al.), U.S. Pat. No. 8,101,060 (Lee), U.S. Pat. No. 8,071,479 (Liu), U.S. Pat. No. 8,062,096 (Brusic et al.), U.S. Pat. No. 8,047,899 (Chen et al.), U.S. Pat. No. 8,043,140 (Fujita), U.S. Pat. No. 8,025,813 (Liu et al.), U.S. Pat. No. 8,002,860 (Koyama et al.), U.S. Pat. No. 7,972,396 (Feng et al.), U.S. Pat. No. 7,955,964 (Wu et al.), U.S. Pat. No. 7,922,783 (Sakurai et al.), U.S. Pat. No. 7,897,250 (Iwase et al.), U.S. Pat. No. 7,884,020 (Hirabayashi et al.), U.S. Pat. No. 7,840,305 (Behr et al.), U.S. Pat. No. 7,838,482 (Fukasawa et al.), U.S. Pat. No. 7,837,800 (Fukasawa et al.), U.S. Pat. No. 7,833,907 (Anderson et al.), U.S. Pat. No. 7,822,500 (Kobayashi et al.), U.S. Pat. No. 7,807,252 (Hendron et al.), U.S. Pat. No. 7,762,870 (Ono et al.), U.S. Pat. No. 7,754,611 (Chen et al.), U.S. Pat. No. 7,753,761 (Fujita), U.S. Pat. No. 7,741,656 (Nakayama et al.), U.S. Pat. No. 7,731,568 (Shimomura et al.), U.S. Pat. No. 7,708,621 (Saito), U.S. Pat. No. 7,699,684 (Prasad), U.S. Pat. No. 7,648,410 (Choi), U.S. Pat. No. 7,618,529 (Ameen et al.), U.S. Pat. No. 7,579,071 (Huh et al.), U.S. Pat. No. 7,572,172 (Aoyama et al.), U.S. Pat. No. 7,568,970 (Wang), U.S. Pat. No. 7,553,214 (Menk et al.), U.S. Pat. No. 7,520,798 (Muldowney), U.S. Pat. No. 7,510,974 (Li et al.), U.S. Pat. No. 7,491,116 (Sung), U.S. Pat. No. 7,488,236 (Shimomura et al.), U.S. Pat. No. 7,488,240 (Saito), U.S. Pat. No. 7,488,235 (Park et al.), U.S. Pat. No. 7,485,241 (Schroeder et al.), U.S. Pat. No. 7,485,028 (Wilkinson et al), U.S. Pat. No. 7,456,107 (Keleher et al.), U.S. Pat. No. 7,452,817 (Yoon et al.), U.S. Pat. No. 7,445,847 (Kulp), U.S. Pat. No. 7,419,910 (Minamihaba et al.), U.S. Pat. No. 7,018,906 (Chen et al.), U.S. Pat. No. 6,899,609 (Hong), U.S. Pat. No. 6,729,944 (Birang et al.), U.S. Pat. No. 6,672,949 (Chopra et al.), U.S. Pat. No. 6,585,567 (Black et al.), U.S. Pat. No. 6,270,392 (Hayashi et al.), U.S. Pat. No. 6,165,056 (Hayashi et al.), U.S. Pat. No. 6,116,993 (Tanaka), U.S. Pat. No. 6,074,277 (Arai), U.S. Pat. No. 6,027,398 (Numoto et al.), U.S. Pat. No. 5,985,093 (Chen), U.S. Pat. No. 5,944,583 (Cruz et al.), U.S. Pat. No. 5,874,318 (Baker et al.), U.S. Pat. No. 5,683,289 (Hempel Jr.), U.S. Pat. No. 5,643,053 (Shendon), U.S. Pat. No. 5,597,346 (Hempel Jr.).

Other wafer or workpiece carrier heads are described in U.S. Pat. No. 5,421,768 (Fujiwara et al.), U.S. Pat. No. 5,443,416 (Volodarsky et al.), U.S. Pat. No. 5,738,574 (Tolles et al.), U.S. Pat. No. 5,993,302 (Chen et al.), U.S. Pat. No. 6,050,882 (Chen), U.S. Pat. No. 6,056,632 (Mitchel et al.), U.S. Pat. No. 6,080,050 (Chen et al.), U.S. Pat. No. 6,126,116 (Zuniga et al.), U.S. Pat. No. 6,132,298 (Zuniga et al.), U.S. Pat. No. 6,146,259 (Zuniga et al.), U.S. Pat. No. 6,179,956 (Nagahara et al.), U.S. Pat. No. 6,183,354 (Zuniga et al.), U.S. Pat. No. 6,251,215 (Zuniga et al.), U.S. Pat. No. 6,299,741 (Sun et al.), U.S. Pat. No. 6,361,420 (Zuniga et al.), U.S. Pat. No. 6,390,901 (Hiyama et al.), U.S. Pat. No. 6,390,905 (Korovin et al.), U.S. Pat. No. 6,394,882 (Chen), U.S. Pat. No. 6,436,828 (Chen et al.), U.S. Pat. No. 6,443,821 (Kimura et al.), U.S. Pat. No. 6,447,368 (Fruitman et al.), U.S. Pat. No. 6,491,570 (Sommer et al.), U.S. Pat. No. 6,506,105 (Kajiwara et al.), U.S. Pat. No. 6,558,232 (Kajiwara et al.), U.S. Pat. No. 6,592,434 (Vanell et al.), U.S. Pat. No. 6,659,850 (Korovin et al.), U.S. Pat. No. 6,837,779 (Smith et al.), U.S. Pat. No. 6,899,607 (Brown), U.S. Pat. No. 7,001,257 (Chen et al.), U.S. Pat. No. 7,081,042 (Chen et al.), U.S. Pat. No. 7,101,273 (Tseng et al.), U.S. Pat. No. 7,292,427 (Murdock et al.), U.S. Pat. No. 7,527,271 (Oh et al.), U.S. Pat. No. 7,601,050 (Zuniga et al.), U.S. Pat. No. 7,883,397 (Zuniga et al.), U.S. Pat. No. 7,947,190 (Brown), U.S. Pat. No. 7,950,985 (Zuniga et al.), U.S. Pat. No. 8,021,215 (Zuniga et al.), U.S. Pat. No. 8,029,640 (Zuniga et al.), and U.S. Pat. No. 8,088,299 (Chen et al.).

A number of other wafer or workpiece carrier heads are described in the following patents: U.S. Pat. No. 5,329,732 (Karlsrud et al), U.S. Pat. No. 5,449,316 (Strasbaugh), U.S. Pat. No. 5,423,716 (Strasbaugh), U.S. Pat. No. 5,335,453 (Baldy et al.), U.S. Pat. No. 5,964,653 (Perlov et al.), U.S. Pat. No. 5,961,169 (Kalenian et al.), U.S. Pat. No. 6,024,630 (Shendon et al.), U.S. Pat. No. 6,159,073 (Wiswesser et al.), U.S. Pat. No. 6,162,116 (Zuniga et al.), U.S. Pat. No. 6,224,472 (Lai et al.), U.S. Pat. No. 6,439,978 (Jones et al.), U.S. Pat. No. 6,663,466 (Chen et al.), U.S. Pat. No. 6,592,439 (Li et al.), U.S. Pat. No. 6,908,366 (Gagliardi), U.S. Pat. No. 7,008,295 (Wiswesser et al.), U.S. Pat. No. 7,018,275 (Zuniga et al.), U.S. Pat. No. 7,086,929 (Wiswesser), U.S. Pat. No. 7,101,272 (Chen et al.), U.S. Pat. No. 7,527,271 (Oh et al.), U.S. Pat. No. 8,021,215 (Zuniga et al.), U.S. Pat. No. 8,066,551 (Chen et al.), U.S. Pat. No. 8,070,909 (Shanmugasundram et al). The present disclosure provides improvements over the state of the art, as set forth below.

SUMMARY OF THE DISCLOSURE

In some implementations, the present disclosure relates to a high-speed abrasive lapping or polishing workpiece head system for use with rotary, abrasive-coated flat-surfaced platens. An abrasive lapping machine, supporting a translatable workpiece carrier head, is used for abrasive lapping and polishing wafers, displays, workpieces and industrial seals. The Tapper machine typically has a high rotational speed air bearing spindle with a precision-flat platen that allows fixed-abrasive coated island discs to be quickly and interchangeably attached to the platen with vacuum. The abrasive technology system described here provides flat-surfaced and smooth-polished surfaces for workpieces including: sapphire wafers, semiconductor wafers, SOS wafers, LED wafers, watch face windows, cell phone camera lenses and displays, computer displays and for other hard-material metal or ceramic workpieces such as rotary seals. The lapping and polishing production speeds of this system using fixed abrasive coated island discs are many times faster than with conventional liquid abrasive slurry lapping systems. The floating lapping head can also be used with liquid abrasive slurries.

The workpieces are attached to a free-floating carrier head that allows one surface of the workpiece to be in conformal abrading contact with a moving flat-surfaced abrasive. To provide uniform material removal across the full surface of the workpiece, the carrier is rotated in the same direction as the platen at the same desired high rotation speeds as the platen. Often these rotating platens and workpiece head carrier heads have abrading speeds of over 10,000 surface feet per minute (SFPM). Here, a 12 inch diameter abrasive coated platen, and a workpiece (or wafer) carrier head, can both operate at 3,000 rpm to obtain these desired high abrading speeds. Diamond abrasive particles are often used as they provide unexcelled material removal rates at these high abrading speeds.

The workpiece carrier device in some implementations made in accordance with the present disclosure can be a combination-type workpiece carrier head abrading system that can be used in two different abrading modes. In the first mode of operation, the rotating workpiece carrier that is attached to a rotating spindle "floats" the workpiece that assumes a conforming contact with the platen abrasive surface as it is held in controlled abrading-pressure contact with the moving abrasive on a rotating platen. In the second mode of operation, the rotating workpiece carrier is attached rigidly to the rotating workpiece spindle during the abrading procedure.

For a typical workpiece "floating-mode" abrading or polishing procedure, the whole rotatable workpiece spindle assembly is lowered until the workpiece attached to a non-rotating workpiece carrier is positioned in flat-surfaced conforming contact with a stationary flat-surfaced rotatable platen abrasive surface. Then, both the workpiece carrier head and the platen are simultaneously rotated with slowly increased rotation speeds as the abrading pressure is slowly increased during the abrading procedure.

For a typical workpiece "rigid-mode" abrading procedure, a raised carrier workpiece attachment plate is lowered until the carrier attachment plate is in "non-floating" conformal flat-surfaced contact with a stationary flat-surfaced rotatable platen surface. Then the workpiece carrier workpiece attachment plate is rigidly attached to the carrier head. Then the carrier head is raised, an abrasive disc is attached to the platen, a workpiece is attached to the workpiece carrier plate and the whole rotatable workpiece head assembly is lowered until the workpiece contacts the abrasive surface. After this, both the workpiece carrier head and the platen are simultaneously rotated with slowly increased rotation speeds as the abrading pressure is slowly increased during the abrading procedure. During construction of the lapper machine, the workpiece carrier head spindle is aligned to be perpendicular to the flat platen surface to provide abraded flat workpiece surfaces. This rigid abrading system can be used to create parallel opposed surfaces of a workpiece by simply abrading one workpiece surface, flipping the workpiece over and abrading the second opposed workpiece surface.

High speed flat lapping is typically performed using flexible abrasive discs that have an annular band of abrasive-coated raised islands. These raised-island discs are attached to flat-surfaced platens that rotate at high abrading speeds. Coolant water or water mist is applied to the abrading surface to remove heat generated by the abrading action, and, to remove abrading debris. The use of the raised island discs prevents hydroplaning of the lapped workpieces when they are lapped at high speeds with the presence of coolant water. Hydroplaning causes the workpieces to tilt which results in non-flat lapped workpiece surfaces. Excess water is routed from contact with the workpiece flat surfaces into the recessed passageways that surround the abrasive coated raised island structures. The coolant water also continuously flushes the abrading debris from the top abrasive surface of the raised-island into the recessed channels.

Also, by using workpieces that extend out slightly in a radial direction over both the inner and outer annular edges of the fixed abrasive, the abrasive is worn down uniformly across the annular-band surface of the raised islands. Uniform wear of the abrasive coated raised islands across the radial width of the annular band of abrasive continually provides a precision-flat abrasive surface that contacts the abraded surface of the workpieces. If desired, a conditioning tool can periodically be used to refine the flat surface of the raised island abrasive.

To operate successfully at high abrading speeds, the flexible abrasive discs are conformally attached to the flat surfaces of precision-flat rotary platens. Also, the abrasive discs are preferably precisely uniform in thickness across their full annular abrading surface to provide full utilization of all the abrasive and to provide smooth abrading contact with the workpiece. Abrasive discs having circumferential thickness variations will provide undesirable "bumpy" abrasive contact with a workpiece when the discs are rotated at high speeds. The flexible discs are quickly attached to the platens with the use of vacuum. A range of sizes of abrasive particles are typically used to optimize an abrading operation. Diamond particles, having a range of particle sizes from 100 microns to sub-microns are encapsulated in ceramic beads that are coated on the top surfaces of the raised islands. Typically, diamond or other abrasive material such as cubic boron nitride, silicon carbide, aluminum oxide, silica and other materials are used for abrading. Abrasive discs having particle sizes of 30 microns or larger are used for coarse abrading. Sequentially, abrasive discs having medium sized abrasive particles of 10 or 3 microns are then used to initiate polishing. The final smooth workpiece polishing is then done by smaller 1 micron or sub-micron sized abrasive particles.

In many applications it is necessary or critical that the opposed surfaces of an abraded or polished workpiece are precisely parallel. For example, it is necessary for semiconductor wafers to have parallel surfaces to enable focusing of photolithographic light beams uniformly across the full exposed surface of the wafer as the backside of the wafer is attached to a precision-flat platen surface. Likewise, it is very desirable that abrasive lapped and polished hardened steel or hard ceramic rotary seals have parallel opposed surfaces to allow the seals to be rotated at high speeds.

To provide abraded workpiece surfaces that are parallel, the workpiece rotatable spindle axis of the workpiece carrier head is aligned to be precisely perpendicular to the rotatable flat platen abrasive surface. When the workpiece carrier head spindle is rotated while the workpiece is abraded, the flatness of the abraded workpiece is directly related to the accuracy of the precision perpendicular alignment of the workpiece head spindle to the abrasive disc rotational platen surface and to the inherent structural stiffness of the workpiece head spindle device. To maintain this precision perpendicular alignment during abrading action, the abrading machine can be configured with a workpiece carrier head spindle having a long axial length with wide-spaced spindle shaft support bearings. This provides structural stiffness of the spindle to resist abrading forces that are imposed on the workpiece which results in minimal deflection of the spindle device.

A second aspect of providing the precision perpendicular alignment of the spindle axis to the platen surface is to mount a precision-flat abrasive disc platen spindle on a spherical-action platen mounting device. This spherical-action mount can be rotated until the platen surface is precisely perpendicular to the workpiece or workpiece spindle axis. The spherical-action mount device is then locked in this established alignment position. Use of the platen spindle spherical-action mount allows precision perpendicular alignment even when the abrading machine frame components are not precisely aligned perpendicular with each other.

Conventional workpiece-polishing workpiece heads are typically limited to slower speeds and cannot attain the high rotational speeds that are required for high speed lapping and polishing. Even very thin and ultra-hard discs such as sapphire can be easily abraded and polished at very high production rates with this high-speed abrading system especially when using diamond abrasives. Extremely hard tungsten carbide (used as cutting tool bits for machine tools) can be "cut like butter" using diamond abrasives at high speeds.

The semiconductor and LED industry typically uses flexible CMP pads that are saturated with a liquid abrasive slurry to polish workpieces. Liquid abrasive slurry has also been used extensively to polish sapphire wafers. However, slurry polishing of sapphire is slow and can take many hours. By comparison, sapphire workpieces can be polished using fixed abrasive raised island discs at very high abrading speeds in a few minutes. This increase in productivity offers large cost reduction advantages.

The CMP pads are resilient, and the carrier head thrusts the workpieces down into the surface-depths of the rotating pads as the workpieces are rotated. Because of the inherently slow spring-back of the resilient CMP pads, the abrading speeds of the CMP pads is quite limited. By comparison, the fixed-abrasive abrasive is coated on island-type flexible polymer disc substrates which results in discs that are quite rigid in a direction perpendicular to the abrasive surfaces. The flexible precision-thickness fixed-abrasive island discs are quickly attached conformally to the precision-flat platen surfaces with vacuum. Here, the workpieces pressed with abrading pressure forces into the platen abrasive surfaces do not distort the fixed abrasive disc surface as happens with the resilient CMP pads.

Deformation of the CMP pads allows the pads to provide somewhat-uniform abrading pressures across the full inner diameter area of the workpiece. However, significant distortion of the CMP pads occurs at the periphery of the workpiece as the rotating pad moves against the stationary-positioned but rotating workpiece. This workpiece-edge pad distortion causes excessive workpiece deposition material removal at the outer annular portion of the workpiece. As a result, the polished workpiece is not precisely flat across the full surface of the workpiece. In order to compensate for the uneven material removal across the surface of the workpiece due to the workpiece-periphery CMP pad distortion, multiple annular abrading pressure chambers are used with conventional membrane-type workpiece carrier heads to apply different localized abrading pressures at different radial locations on the workpieces.

This patent application references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434; 7,520,800; 8,062,098; 8,256,091; 8,328,600; 8,430,717; 8,545,583; 8,647,171; 8,740,668; 8,758,088; 8,845,394; 8,998,677; 8,998,678; 9,039,488; 9,011,207; 9,199,354, 9,233,452 and 9,604,339 and all contents of which are incorporated herein by reference for any purpose whatsoever.

The present disclosure describes implementations of a rotatable combination floating and rigid workpiece abrading head device having a curved (e.g., spherical) bearing that allows a rotating abraded workpiece attached to a workpiece carrier plate to assume flat-surfaced contact with the horizontal moving flat abrasive surface on a rotatable platen when in the floating mode. When the head is in a rigid mode, the workpiece can be rigidly held perpendicular to the platen moving abrasive surface. The workpiece head spherical bearing can have an offset spherical center of rotation that is located at or very close to the abraded surface of the workpiece to eliminate tilting of the workpiece due to lateral frictional abrading forces. Tilting of the workpiece during abrading can result in producing non-flat workpieces. The workpiece head also can have an internal pressure chamber that applies controlled abrading pressure uniformly across the full abraded surface of a workpiece. The offset spherical action work holder can be used for polishing sapphire or semiconductor wafers or lapping other workpiece substrates. Vacuum can also be supplied to the carrier head internal pressure chamber to quickly lift the workpiece carrier head and the workpiece away from contact with the platen abrasive during an abrading operation.

Use of a large diameter two-part spherical bearing in implementations in accordance with the present disclosure can provide a radially-wide base that applies distributed abrading pressures to a workpiece that is supported by the spherical rotor workpiece carrier plate. By comparison, if a small diameter spherical bearing is used, the downward abrading force is applied to the small spherical bearing which transmits the force to a small central radial area of the workpiece carrier plate. In this implementation, the applied abrading force can be concentrated at this small radial area of the carrier plate and is distributed across the full abraded surface of a large diameter workpiece by the structural stiffness of the workpiece carrier plate.

To provide a uniform abrading pressure on a large diameter workpiece using a small diameter spherical bearing, the workpiece carrier plate can be constructed of a thick and rigid material to avoid vertical deflection of the workpiece carrier plate across its full radial width. If the carrier plate has a dimensional deflection across its radial width during a common high abrading force procedure, the carrier plate deflection can be expected to cause non-uniform abrading pressure to exist over the radial width of the workpiece carrier plate, and corresponding, across the radial width of workpiece attached to the carrier plate.

However, when a large diameter curved (e.g., spherical) bearing is used, the abrading forces are applied over a larger diameter area which reduces the concentration of the applied force at the bearing center. Use of a larger diameter spherical bearing reduces the required thickness of the carrier plate to provide a uniform abrading pressure over the abraded surface of a workpiece.

The workpiece carrier head device can be a combination-type workpiece carrier head abrading system that can be used in two different abrading modes. In the first mode of operation, the rotating workpiece carrier plate, having an attached workpiece or wafer, that is attached to the workpiece carrier head, can "float" the workpiece or wafer as it is held in controlled abrading-pressure contact with the moving abrasive. In the second mode of operation, the rotating workpiece carrier plate can be attached rigidly to a slidable vertical-motion housing component of the rotating workpiece head where spherical rotation of the workpiece carrier plate is prevented. To precisely align the workpiece carrier plate in a rigid mode operation, the whole rotatable workpiece spindle assembly can be lowered until the workpiece carrier plate is in "non-floating" rigid conformal contact with the flat rotatable platen moving abrasive surface. Then the workpiece carrier plate can be rigidly attached to the vertical-motion carrier head slidable housing. Here, wafers or workpieces attached to the carrier plate can be then brought into abrading contact with the platen abrasive and held in that position as the workpiece is abraded. This rigid abrading system can be used to create parallel opposed surfaces of a workpiece by simply abrading one workpiece surface, flipping the workpiece over and abrading the second opposed workpiece surface.

Also, the workpiece head can have a workpiece rotational drive shaft device that can contact the workpiece carrier plate at a position very close to the abraded surface of the workpiece to prevent tilting of the workpiece due to the torque forces applied by the drive shaft to rotate the workpiece during an abrading operation. Here, the drive shaft device can have a splined ball-end that is inserted into a splined socket device, having vertical splined walls, that is attached to the workpiece carrier plate. The drive shaft device ball end can be slidably attached to the splined socket device and rotationally engages the splined socket device to rotate the workpiece carrier plate. Because the vertical drive shaft device has a spherical-shaped spline-type ball end that is slidably engaged with the splined flat-surfaced vertical walls of the socket device, the contact of spherical-shaped spline-type ball end with the splined socket device forms a spherical-action rotational drive joint that allows the rotationally driven workpiece carrier plate to be tilted during an abrading operation while providing rotational torque to the workpiece carrier plate.

During abrading action, when rotational torque is applied by the drive shaft spherical ball end, symmetric-balanced two-point rotational forces are applied by the splined spherical ball-end vertical shaft that contacts the floating splined socket device, that is inserted into a receptacle in the workpiece carrier plate, which creates a rotational torque on the floating splined socket device. In turn, two opposed horizontal pin-arms of the floating splined socket device transmits symmetric-balanced two-point rotational forces to locations on the workpiece carrier plate that is a very small distance from the horizontal abraded surface of the workpiece. Positioning the workpiece rotational forces close to the workpiece abraded surface prevents tilting of the workpiece due to the torque applied by the rotational drive shaft splined spherical ball-end to rotate the workpiece carrier plate.

Floating of the drive shaft splined socket device vertically but restraining it horizontally (or radially) within the workpiece carrier plate allows the workpiece carrier plate rotational torque to be applied at opposed positions to the splined walls of the splined socket device at a location a small distance vertically above the splined socket device two-opposed pin-arms, without tilting the splined socket device. This allows the workpiece carrier plate rotational torque to be transmitted from the splined spherical ball-end shaft directly to, and shared equally by, the two opposed pin-arms of the splined socket device. Rotational torque is applied at the diameter-center of the two opposed horizontal cylindrical-shaped pin-arms at or near the free ends of the pin-arms which extend from the splined socket device and individually contact the vertical walls of the splined socket device receptacle in the workpiece carrier plate.

The splined spherical ball-end drive shaft device can have at least two spherical-shaped diagonally opposed ball end spherical-shaped splines but preferably has six spherical-shaped splines. The splined socket device can have a corresponding at least two spherical-shaped diagonally opposed vertical wall splines but preferably has six spherical-shaped wall splines. The ball-end shaft spherical ball drive shaft has a geometric size that is slightly smaller than the vertical spline walls of the splined socket device and there is a loose fit between the ball-end drive shaft splined spherical ball and the splined socket device when the ball-end drive shaft spherical ball is inserted into the spherical splined socket device. When torque is applied to the splined spherical ball-end drive shaft, equal-magnitude rotational forces are applied at opposed points on the vertical spline walls of the splined socket device whereby the torsional axis of the applied workpiece carrier plate rotational torque is coincident with the longitudinal axis of the vertical spherical spline walls of the splined socket device.

The diameter of the cylindrical opposed pin-arms of the splined socket device typically is 0.125 inches but can range from 0.062 to 0.250 inches, for example, or any dimension therebetween in increments of 0.001 inches. The torque force application point at the diameter-center of the two opposed pin-arms of the spherical splined socket device is preferably located 0.125 inches vertically from the horizontal workpiece mounting surface of the workpiece carrier plate but can have a range of location distances of from 0.010 inches to 0.500 inches, for example, or any dimension therebetween in increments of 0.001 inches.

Precision-thickness fixed-abrasive flexible discs having disc thickness variations of less than 0.0001 inches (3 microns) across the full annular bands of abrasive-coated raised islands can allow flat-surfaced contact with workpieces to be used at very high abrading speeds. Use of a rotary platen vacuum flexible abrasive disc attachment system can allow quick set-up changes where different sizes of abrasive particles and different types of abrasive material can be quickly attached to the flat platen surfaces.

Semiconductor wafers require extremely flat surfaces when using photolithography to deposit patterns of materials to form circuits across the full flat surface of a wafer. When theses wafers are abrasively polished between deposition steps, the surfaces of the wafers should remain precisely flat.

Water coolant, water mist and atomized water spray are used with these raised island abrasive discs, which allows them to be used at very high abrading speeds, often in excess of 10,000 surface feet per minute (SFPM). The same types of chemicals that are used in the conventional CMP pad polishing of semiconductor and sapphire wafers can also be used with this fixed-abrasive lapping or polishing system to enhance abrading material removal rates. These liquid chemicals can be applied as a mixture with the coolant water that is used to cool both the wafers and the fixed abrasive coatings on the rotating abrading platen. This mixture of coolant water and chemicals continually washes the abrading debris away from the abrading surfaces of the fixed-abrasive coated raised islands which prevents unwanted abrading contact of the abrasive debris with the abraded surfaces of the wafers.

Slurry lapping with CMP pads is often done at very slow abrading speeds of about 50 rpm or about 5 mph (8 kph). By comparison, the high-speed flat lapping system often operates at or above 3,000 rpm or 100 mph (160 kph). This is a speed difference ratio of 20 to 1. Increasing abrading speeds increase the material removal rates. Because the abrading speeds are so high, very low abrading pressures are used. These low abrading pressures reduce the amount of subsurface damage of expensive wafers such as semiconductor or sapphire wafers. High abrading speeds result in high wafer production rates and large cost savings.

Workpieces and wafers can typically be rotated with implementations of the illustrated abrading system at rotational speeds that are approximately equal to the rotational speeds of the platens to provide equally-localized abrading speeds radially across the full surface of the workpieces and wafers. Wafers can be rotated in the same rotation direction as the platens. For example, a 12 inch (300 mm) diameter abrasive disc platen and workpiece head can have rotational speeds of 3,000 rpm. To effectively use raised island abrasive discs at these very high abrading speeds, the discs should be uniform in thickness and the rotating platen that the flexible disc is attached to should have a precision-flat surface.

Embodiments made in accordance with the present disclosure can provide spherical-action types of workpiece heads that are used to provide flat-surfaced contact of workpieces and wafers with flexible flat-surfaced, raised-island, fixed-abrasive discs that are attached with vacuum to a precision-flat platen that rotates at very high speeds. An off-set spherical-action workpiece head can be used where the abrading friction forces that are applied to the workpieces by the moving abrasive does not tend to tilt the workpieces that are attached to the offset workpiece heads. Here, the spherical center of rotation of the workpiece carrier can be located nominally at the abraded surface of the wafer or workpiece. Because of this location, the lateral abrading-friction type of abrading forces imposed on the workpiece abraded surface can be directed through the spherical rotation center. When this abrading force vector intersects the spherical rotation center there is no tilting torque applied to the workpiece during abrading. Tilting can cause non-flat abraded workpiece surfaces.

The workpiece heads can also have a linear-bearing set of close-fitting concentric housings that allows the workpiece carrier workpiece attachment plate to move in a vertical direction toward and away from the platen abraded surface. An outer housing that supports a spherical bearing rotor device can be in close-proximity low-friction sliding contact with a drive housing supporting a matching-spherical-diameter spherical bearing housing that is attached to a rotatable carrier head rotational drive spindle. Air or fluid pressure can be supplied to a sealed chamber within the workpiece carrier head to apply uniform abrading pressures across workpiece surfaces where the workpieces are attached with vacuum to the workpiece carrier during an abrasive polishing procedure. To increase productivity, one or more of the workpiece heads can be spaced around the periphery of the platen and each of the individual heads can be used simultaneously to provide abrading contact of workpieces with the rotary platen disc abrasive surface.

With respect to one embodiment in accordance with the present disclosure, the uniform removal of a thin layer of material from workpiece surfaces can be quickly and reliably achieved by attaching the workpiece to a flexible thin polymer, glass, ceramic or metal backing disc. Low-tack adhesives or low-temperature melting wax (commonly used for mounting semiconductor wafers) can be used to attach the workpieces to the workpiece mounting backing disc. The workpiece attachment backing disc can be flexible in a direction perpendicular to the disc flat surface but is rigid through the thickness of the disc. This allows the backing disc to be conformably attached with vacuum to the workpiece carrier plate where the workpiece is rigidly attached to the rigid workpiece carrier plate. The workpiece carrier plates can be constructed from solid or porous glass, ceramics, polymers and metals. When in abrading contact with the platen abrasive, the abrading pressure can be uniform across the full abraded surface of the workpiece.

With respect to another embodiment in accordance with the present disclosure, the uniform removal of a thin layer from a workpiece surface can be reliably achieved by attaching the workpiece to a resilient pad with a low-tack adhesive. This resilient pad and the attached workpiece can then be attached to a rigid or semi-rigid workpiece carrier with vacuum. The nominally flexible workpiece will be supported by the resilient pad where the full surface of the workpiece will be pressed by the workpiece carrier, with controlled uniform abrading pressure, onto the surface of the precision-flat raised-island abrasive surface. If the abrading pressure is uniform across the full surface of the workpiece due to the resiliency of the workpiece attachment pad, material can be uniformly removed from the workpiece surface during the abrading process. Here, a workpiece that is flexible in a direction normal to the workpiece flat surfaces but is rigid in a direct along the workpiece flat surfaces, can be in uniform-pressure abrading contact with a rigid abrasive surface. The configuration of the workpiece carrier head of particular implementations in accordance with the present disclosure eliminates the non-uniform abrading pressure that occurs with the use of a CMP abrasive-slurry resilient polishing pad. After the workpiece is polished, the resilient pad can be peeled from the surface of the workpiece In another embodiment of the present disclosure, the workpiece can also be attached to a carrier that has a multi-layer flexible bottom where the workpiece is attached to this flexible bottom with vacuum. The flexible bottom can be restrained radially at its outer periphery to a rigid annular ring. The vacuum-attached workpiece can be integrally attached to the flexible bottom that is restrained at its periphery and no rolling contact is made by the rigid and fragile silicon workpiece outer periphery with a radial restraining device. The flexibility of the workpiece and the flexible carrier bottom allows applied fluid pressure to exert a controlled abrading pressure across the surface of the workpiece to provide uniform material from the full surface of the workpiece. The flexible carrier bottom can be constructed from elastomeric materials or from composite laminations of polymer, metal and fiber-impregnated cloth materials.

In a further embodiment of the spherical bearing workpiece head device, the workpiece can also be attached to a flexible carrier plate membrane having shallow vacuum grooves on the membrane surface where the workpiece is attached to this flexible bottom with vacuum. The flexible membrane bottom can be restrained radially at its outer periphery to resist lateral friction-type abrading forces. The flexibility of the membrane allows applied fluid pressure to exert a controlled abrading pressure across the surface of the workpiece to provide uniform material removal from the full surface of the workpiece. The flexible workpiece carrier bottom can be constructed from elastomeric materials or from composite laminations of polymer, metal and fiber-impregnated cloth materials.

The vacuum that is used to attach the workpiece, or a workpiece attachment backing disc, to the workpiece carrier plate and the air or liquid fluid that is used to create an abrading pressure or vacuum in the sealed carrier head pressure chambers can be supplied by tubes or fluid passageways that are connected to a single-port or multiple-port rotary union that has stationary fluid ports and rotating fluid ports. The rotary union can be attached to the workpiece carrier rotary drive spindle. Air or liquid fluids or vacuum can be routed to these fluid ports to supply them to the internal components of the workpiece carrier head. The vacuum tube portions that are connected to the rotatable workpiece carrier plate can be flexible which allows the carrier plate to be tilted and allow the floating spherical-action workpiece carrier head sliding housing to be moved vertically. Conventional rotary unions typically cannot be used at high rotational speeds. They can have sliding seals that are in forced contact with stationary seals which results in significant frictional heating when rotated at high speeds. An air bearing rotary union having non-contact seals and no frictional heating can be used here to provide multi-port operation at rotational speeds of up to 3,000 rpm and more.

The tension springs that counterbalance the weight of the vertical sliding portion of the workpiece carrier head can allow the workpiece carrier head to be neutral-balanced for applying abrading pressure to the workpiece. The workpiece abrading pressure can be substantially controlled by the selected pressure in the pressure chamber. Use of the counterbalancing springs can allow the workpiece abrading pressure to be adjusted and maintained to be very low. The low abrading pressures of less than 1.0 psi or less than 0.5 psi or even less than 0.2 psi have the advantage of reducing subsurface abrading damage to the workpieces. Subsurface damage is well known in the abrading industry to be approximately proportional to the abrading pressure. Large abrading pressures tends to result in large subsurface damage to workpieces.

The workpiece carrier head is typically used at high rotational speeds of 500 or 1,500 and even 3,000 rpm. Abrasive particle filled erodible beads (not shown) can be coated on annular patterns of fixed-abrasive disc islands (not shown) to avoid hydroplaning of water spray cooled workpieces when operated at very high abrading speeds. By comparison, conventional liquid abrasive slurry lapping and polishing typically operate at the very low rotational speeds of approximately 50 rpm.

To achieve satisfactory material removal rates (MRR) of very hard materials including sapphire, very high abrading pressures or very long abrading times are often used with the very slow speed liquid abrasive slurry abrasive lapping and polishing systems. The high abrading pressures can cause substantial workpiece subsurface damage. By contrast, the high-speed island disc abrasive system has very high material removal rates even when using very low abrading pressures which results in very low subsurface damage. Preston's Equation provides a well-known representation of abrading material removal rates being proportional to both the abrading pressure and the abrading speed.

In one example test case, a 12" diameter abrasive disc having an annular band pattern of 0.25" diameter islands sparsely coated with large 0.016" diameter equal-sized erodible porous ceramic that encapsulated 75 micron diamond abrasive particles was used to polish sapphire workpieces at 1.9 psi abrading pressure at a rotational speed of 500 rpm. A total of 0.0016" of sapphire was removed in one minute of abrading time. This material removal rate was approximately 40 times that of a conventional liquid abrasive slurry sapphire polishing operation. The high speed lapping machine used for this test had a precision-flat air bearing platen with vacuum attachment of the island abrasive disc can be operated at rotational speeds of up to 3,000 rpm and abrading pressures of up to 10 psi.

The mass moment of inertia of the workpiece carrier plate can be modified by the choice of construction materials and the geometry of the plate. Use of lightweight materials such as aluminum and small plate thicknesses and diameters reduce the rotational torque required to accelerate and decelerate the carrier plate and allow the plate to follow once-around spherical tilting required for non-flat abrasive platens. However, at high rotational speeds, use of heavy construction materials such as steel, thick plates and large carrier plate diameters provide high workpiece carrier plate moments of mass inertia which resist once-around tilting or wobbling of the workpiece plate and attached workpiece as they are rotated during an abrading operation. These carrier plate high mass inertias keep the carrier plate and the attached workpiece stabilized in flat conformal surface contact with the flat platen abrasive surface and prevents the workpiece from having a periodic tilting or oscillations when rotated at high speeds which results in increased precision abraded flatness of the workpieces. Periodic tilting oscillations of the workpiece carrier plate during rotation can result in multiple geometric non-flat workpiece surface shapes including saddle-shaped workpiece surfaces.

In another embodiment, flexible discs having annular bands of large abrasive particles or large abrasive particle-filled beads that are bonded to non-island disc backings can be used to avoid hydroplaning where the height of the adjacent individual particles or beads is greater than the thickness of the film of coolant water or coolant liquids applied to a disc when used at high abrading speeds. Excess coolant water resides in the gap spacing between adjacent abrasive particles or abrasive beads, leaving the exposed top surface of the abrasive particles or beads in abrading contact with workpiece surfaces. Material is abraded away from the workpiece surfaces without the workpieces "floating" or hydroplaning on a layer of coolant liquid when abrading at high speeds. Here, the large-sized abrasive particles or large abrasive beads "act" as islands to prevent hydroplaning. The above advantages and features are of representative embodiments only, and are presented only to assist in understanding the disclosure. It should be understood that these are not to be considered limitations on the disclosure as defined by the claims. Additional features and advantages of embodiments of the disclosure will become apparent in the following description, from the drawings, and from the claims.

BRIEF DESCRIPTION OF THE DRAWINGS

Further objects and advantages of the disclosure will become apparent from the following description and from the accompanying drawings, wherein:

FIG. 18 is a top view of an abrasive conditioning ring disc used to abrade-an abrasive disc.

FIG. 19 is a cross section view of an abrasive conditioning ring disc abrasive annular band.

DETAILED DESCRIPTION

Figure 1:
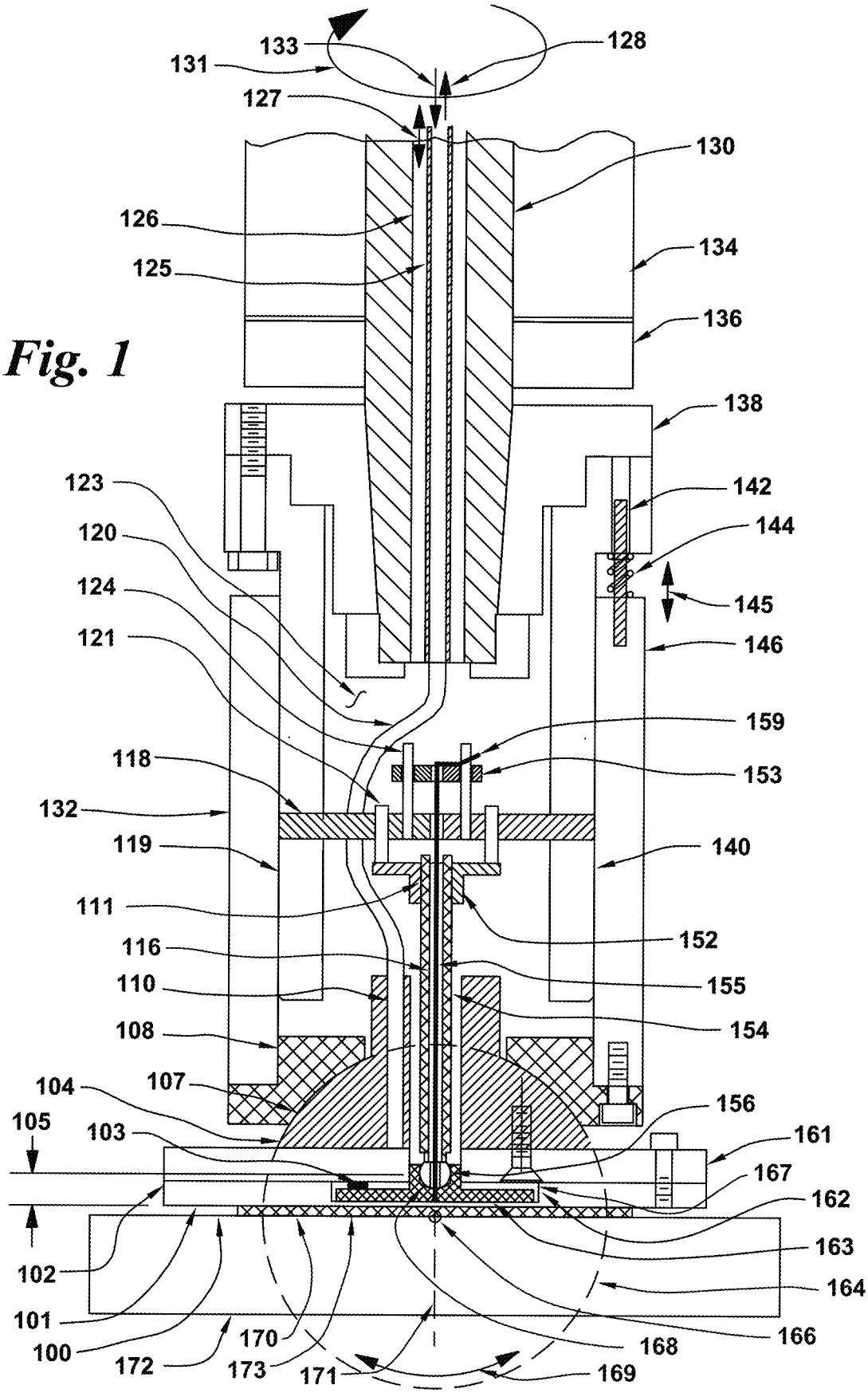
FIG. 1 is a cross section view of a floating workpiece carrier head with concentric housings.

For ease of illustration, in the following description the same reference numerals may be used in different diagrams to refer to the same elements or additional instances of the same element. Applicant has performed significant work in the field of the present disclosure, as set forth in the below summary.

U.S. Pat. No. 6,769,969 (Duescher) describes flexible abrasive discs that have annular bands of abrasive coated raised islands. These discs use fixed-abrasive particles for high speed flat lapping as compared with other lapping systems that use loose-abrasive liquid slurries. The flexible raised island abrasive discs are attached to the surface of a rotary platen to abrasively lap the surfaces of workpieces.

U.S. Pat. No. 8,062,098 (Duescher) describes the use of a spherical-action workpiece carrier that has an off-set center of rotation that coincides with the abraded surface of the workpiece. This device reduces tilting of the workpiece that is caused by horizontal abrading forces that are applied to the workpiece abraded surface by the moving platen abrasive. A spherical bearing is incorporated in the carrier to provide this spherical action motion as the workpiece is rotated by the carrier. However, there is a significant disadvantage to the spherical bearing rotors described in this patent. Here, it is taught that the rotors are rotationally driven by drive devices that are attached to the top portions of the rotors rather than being attached at the base of the rotor close to the workpiece as described in the present patent. Application of rotational torque to overcome rotational abrading friction forces by the drive device having the rotor-top attachment results in a leveraged drive force being imposed on the rotor that tilts the rotor as the rotor is rotated. Abrading tests where workpieces were attached to a rotor bottom surface on this type of top-driven spherical rotor caused tilting of the rotor and resulted in non-flat workpiece abraded surfaces which are totally unacceptable for the intended use of precision flat lapping of workpieces.

U.S. Pat. No. 8,328,600 (Duescher) describes the use of spherical-action mounts for air bearing and conventional flat-surfaced abrasive-covered spindles used for abrading where the air bearing spindle flat platen surface can be easily aligned to be perpendicular to another device. In embodiments in accordance with the present disclosure, this type of air bearing spindle, and conventional flat-surfaced abrasive-covered spindle platens, can be used where the air bearing spindle platen surface, or the platen flat abrasive surface, can be easily aligned to be perpendicular with the rotational axis of a floating workpiece carrier head device.

U.S. Pat. No. 9,199,354 (Duescher) describes the use of an abrasive workpiece polishing floating workpiece head having a spherical-action bearing with an off-set spherical center of rotation that is located at the abraded surface of a workpiece attached to the workpiece head floating workpiece carrier plate. The use of an offset spherical bearing rotation center prevents tilting of the workpiece and workpiece carrier plate caused by the lateral friction abrading forces directed along the abraded surface of the workpiece that are imposed on the workpiece by the contacting abrasive on the rotating platen. A flexible elastomeric diaphragm allows the workpiece attachment plate to move vertically for controlled abrading pressure contact with a rotatable platen abrasive.

However, Applicant has come to appreciate that torsional rotational forces are also required to rotate the workpiece during an abrading procedure. The workpiece rotational torque can overcome the torsional abrading friction present at the interface of the platen abrasive surface and the workpiece abraded surface in order to rotate the workpiece. These torsional friction forces on the workpiece are different than the lateral or linear friction forces imposed on the workpiece by the moving platen abrasive. As clearly shown in FIG. 1 and FIG. 3 in U.S. Pat. No. 9,199,354, it is taught that a long vertical pin attached to the workpiece carrier plate slidably engages a rigid rotation drive arm member horizontally attached to a workpiece carrier head drive housing at a location a very substantial distance from the abraded surface of the workpiece to apply a single torsional force that rotates the workpiece carrier plate and the attached workpiece.

The use of a single sliding horizontal drive arm to apply sufficient force to a long vertical drive pin to overcome the substantial torsional abrasive friction forces on the workpiece causes a workpiece carrier plate tilting torque to exist during an abrading procedure. The workpiece tilting torque is caused by the combination of the required sliding pin engagement force acting with a nominal "lever-arm" distance of the length of the pin attached to the workpiece carrier plate. The "effective length" lever-arm of the vertical pin is represented by the vertical measured distance from where the horizontal drive arm contacts the vertical drive pin to the rotational center of the spherical bearing.

Also, the workpiece tilting effect is magnified substantially by use of the single-point drive arm and drive pin sliding mechanism where the single offset sliding contact force transmission point is located a substantial horizontal distance from the vertical axis of rotation of the workpiece carrier head. This offset single torsional drive mechanism causes the workpiece to be tilted each revolution of the workpiece during an abrading operation which results in non-flat abraded areas of the workpiece surface.

By comparison, with respect to implementations in accordance with the present disclosure, the spherical-spline sliding joint contact points that transmit rotational torque to rotate the workpiece can be located a very small distance from the abraded surface of the workpiece. Here, the workpiece rotational torque is applied symmetrically at two positions that are located equal distances from the workpiece carrier rotation axis. Further, the spherical splined ball joint allows the workpiece and workpiece carrier plate to be tilted (due for instance to non-parallel opposed workpiece surfaces) during an abrading procedure without imposing unwanted reactive torque-drive forces that would result in unwanted tilting of the workpiece.

Embodiments in accordance with the present disclosure can have a lubricated sliding-joint air pressure-sealed concentric set of floating and rotationally driven housings which provide very stiff structural support of the workpiece attachment plate that is attached to the slide housing due to the incompressibility of the thin film of liquid lubricant applied between the slide housing and the close-fit concentric drive housing. The liquid lubricant applied between the slide housing and the close-fit concentric drive housing also provides a fluid pressure seal between the slide housing and the close-fit concentric drive housing to provide an internal abrading pressure chamber internal to the floating vertical movement workpiece or wafer head.

For purposes of illustration, and not limitation, FIG. 1 is a cross section view of a floating workpiece carrier head with concentric housings. A combination floating and rigid workpiece carrier head 132 rotatable abrading device having a hollow drive housing 140 and a concentric close-fitting hollow slide housing 146 that slides along the rotation axis (not shown) of the drive housing 140. Both the hollow drive housing 140 and the concentric hollow slide housing 146 have inside and outside closed curve surfaces where the closed curve surfaces include circles, ellipses and polygons. The closed curve surfaces extend uniformly along the inside and outside lengths of both the hollow drive housing 140 and the concentric hollow slide housing 146 to form cylinder-like and linear straight-line surfaces along the inside and outside lengths of both the hollow drive housing 140 and the concentric hollow slide housing 146. The closed curve shape of the hollow drive housing 140 outside surface and the inside surface of the concentric hollow slide housing 146 both have matching closed curve shapes that have nominally equal sizes where the inside surface of the concentric hollow slide housing 146 is in sliding contact with the outside surface of the hollow drive housing 140 and a very small gap of less than 0.005 and preferably less than 0.001 inches exists between the concentric hollow slide housing 146 and the hollow drive housing 140.

A preferably incompressible liquid lubricant (not shown) can be applied in the gap between the concentric hollow slide housing 146 and the hollow drive housing 140 which allows low friction movement of the concentric hollow slide housing 146 relative to the hollow drive housing 140. Also, the incompressible liquid lubricant applied in the gap between the concentric hollow slide housing 146 and the hollow drive housing 140 provides a very structurally stiff radial force coupling of the hollow slide housing 146 with the hollow drive housing 140 that prevents radial motion of the hollow slide housing 146 to the hollow drive housing 140. The incompressible liquid lubricant prevents the lateral abrading forces imposed on the hollow slide housing 146 by abrading contact of the workpiece 170 with the moving flat-surfaced abrasive 100 coating on the rotary platen 172 from tilting the hollow slide housing 146 relative to the hollow drive housing 140. Tilting of the hollow slide housing 146 relative to the hollow drive housing 140 during an abrading procedure can cause non-flat workpiece 170 abraded surfaces.

The film of incompressible liquid lubricant applied in the gap between the concentric hollow slide housing 146 and the hollow drive housing 140 also provides a fluid pressure seal between the hollow slide housing 146 and the hollow drive housing 140. The rotary workpiece carrier head 132 is rotationally 131 driven at high rotation speeds of up to 3,000 rpm or more by a stationary rotary spindle device 134 that has a rotary spindle shaft 130.

The rotary workpiece carrier head 132 has a flat-surfaced workpiece 170, having an abraded surface 173, that is attached by vacuum to a floating workpiece plate 102 that is rotationally driven by a splined ball-end hollow shaft device 154 that has a shaft open passageway 116 along its axial length. The splined ball-end shaft device 154 has a splined ball end 156 that floats freely in a spherical ball splined receptacle device 168 having rotational drive arms 163 that contact a recessed receptacle 167 that has vertical slot walls 162 in the workpiece carrier plate 102. The splined ball-end shaft device 154 splined ball end 156 allows the carrier plate 102 to rotate with spherical action about the spherical diameter 164 while the splined ball-end shaft device 154 maintains a nominally vertical position as the carrier plate 102 rotates.

In one embodiment, the ball-end hollow shaft device 154 can be fabricated from a ball-end Allen wrench produced by the Bondhus Company, Monticello, Minn. and the mating nominally spherical-splined receptacle device 168 having rotational cylindrical-pin drive arms 163 can be fabricated from a standard socket-head Allen-wrench screw head. Other spherical-action splined drive shaft devices than 154, 156 and 168 shown here, can also be used to provide spherical motion of the drive shaft 154 and provide torque to rotate the carrier plate 102. The spherical-splined receptacle device 168 having rotational drive arms 163 is loosely fitted into the shape-matching recessed receptacle 167 having contact recessed vertical slot walls 162 in the workpiece carrier plate 102 to allow torque applied to the ball end shaft 154 to be translated to the spherical-splined receptacle device 168 rotational drive arms 163. The spherical center of the splined ball-end shaft device 154 splined ball end 156 is positioned at a distance 105 that is less the 1.5 inch and preferably less than 1.0 inch and more preferably less than 0.5 inches from the workpiece 170 mounting surface 101 of the workpiece plate 102 to minimize torsional forces applied to the splined ball end 156 from tilting the workpiece carrier plate 102.

A fork-type shaft drive device 152 is attached to the splined ball-end shaft device 154 and the forks 121 of the fork-type device 152 are attached to a cross-pin drive device 118 that is attached to a workpiece head spindle drive housing 140 where rotation of the workpiece head spindle housing 140 rotates the splined ball-end hollow shaft device 154 which rotates the spherical splined receptacle device 168 rotational drive arms 163 contacting the recessed receptacle 162 having vertical slot walls in the carrier plate 102 thereby rotating the carrier plate 102 and the workpiece 170. A spring clip (not shown) maintains contact of the splined ball end 156 with the spherical splined receptacle device 168 as the splined ball-end shaft device 154 floats freely in the nominally spherical splined receptacle device 168.

A slide closed curve geometry workpiece head housing 146 moves vertically 145 relative to the closed curve workpiece head spindle drive housing 140 and the splined ball end 156 maintains contact with the spherical splined receptacle device 168 as the fork-type device 152 two forks 121 are attached to the cross-pin drive device 118 that is attached to the workpiece head spindle housing 140 as the fork-type device 152 having an axial splined surface 111 slides vertically along a matching splined surface (not shown) on the upper portion of the splined ball-end shaft device 154.

The rotary workpiece carrier head 132 is attached to a stationary rotary spindle device 134 that has a rotatable spindle plate 136 and the rotary spindle shaft 130 where the rotary spindle shaft 130 has a hollow open passageway 126 that extends along the length of the spindle shaft 130. The hollow open passageway 126 provides a passageway for pressurized fluid or vacuum 127 that is transmitted from a rotary spindle shaft 130 rotary union device (not shown) to a sealed pressure chamber 123. A flexible vacuum tube 120 connected to a hollow tube 125 contained in the hollow open passageway 126 provides vacuum 128 or pressure 133 from the rotary union to the workpiece 170 workpiece carrier plate carrier plate 102 where the vacuum 128 is used to attach the flat-surfaced workpiece 170 to the flat-surfaced carrier plate 102. Air pressure 133 can also be supplied through the rotary union in the same vacuum tube 120 to provide pressurized separation of an attached workpiece 170 from the workpiece plate 102 upon completion of the abrading action on the workpiece 170.

A spindle flange 138 is attached to the rotary spindle shaft 130 and the workpiece head spindle housing 140 is attached to the rotational spindle flange 138 and where the workpiece head housing 146 is positioned concentrically with the workpiece head spindle housing 140 and where the workpiece head slide housing 146 is in slidable contact with the workpiece head spindle housing 140 at the low-friction closed curve fluid pressure sealed sliding surface 119. The low-friction sliding surface 119 allows the workpiece head housing 146 to move vertically 145 relative to the workpiece head spindle housing 140 and it restrains the workpiece head housing 146 from moving horizontally, or radially, relative to the workpiece head spindle housing 140. The low-friction closed curve sliding surface 119 can be a grease or oil lubricated surface or it can be a non-lubricated low-friction surface such as a deposited diamond like coated (DLC) low friction and wear resistant coating or it can be a low-friction organic or non-organic mold-release coated surface or lubricants including oils, greases or molybdenum disulfide lubricant or combinations thereof. The sliding surface 119 can be fluid pressure sealed by an incompressible liquid lubricant applied to the sliding surface 119 or an O-ring can be attached to either the slide housing 146 or the spindle rotation drive housing 140 to fluid pressure seal sliding surface 119. An incompressible liquid lubricant applied to the sliding surface 119 prevents radial movement of the workpiece head slide housing 146 relative to workpiece head spindle drive housing 140.

The workpiece plate 102 can be moved vertically relative to the workpiece head spindle housing 140 and tilted relative to the workpiece head spindle housing 140. Tilting of the plain spherical bearing rotor 104 and the workpiece plate 102 which is attached to the spherical bearing rotor 104 is provided by the spherical sliding action of the plain spherical bearing rotor 104 at the mutual low-friction sliding surface 107 of the spherical bearing housing 108 and the spherical bearing rotor 104. The plain-surfaced spherical bearing rotor 104 is nested in sliding contact with the spherical bearing housing 108. The low-friction sliding surface 107 can be a grease or oil lubricated surface or it can be a non-lubricated low-friction surface such as a deposited diamond like coated (DLC) low friction and wear resistant coating or it can be a low-friction organic or non-organic mold-release coated surface or combinations thereof or it can be a low-friction air bearing surface.

The mutual spherical curvature of the spherical bearing housing 108 and the matching and contacting spherical-surface spherical bearing rotor 104 also restrains the spherical bearing rotor 104 and the workpiece 170 from moving horizontally, or radially, relative to the workpiece head drive housing 140 rotation axis to resist lateral horizontal friction abrading forces (not shown) that are applied to the workpiece 170 by the flat-surfaced abrasive 100 coating on the rotary platen 172.

The workpiece carrier rotor 104 can be spherically tilted due to numerous causes during abrading action including: flat-surfaced workpieces 170 that have non-parallel opposed surfaces; misalignment of components of the workpiece carrier head 132; misalignment of other components of the abrading machine (not shown); and a platen 172 that has an abrasive surface 100 that is not flat.

Pressurized air or other fluids such as water or vacuum 127 supplied through the rotary spindle shaft 130 hollow passageway 126 is coupled with the sealed chamber 123 to provide controlled and distributed abrading pressure to the workpiece 170 and to provide a lifting force with vacuum to move the workpiece plate 102 and the workpiece head housing 146 upward relative to the workpiece head spindle housing 140. The sealed abrading pressure chamber 123 is formed by a number of the components of the workpiece carrier head 132 including: the rotational drive spindle flange 138, the workpiece head rotor 104, the spherical low friction surface 107 of the spherical bearing rotor 104, the spherical bearing housing 108, the workpiece head housing 146 and the workpiece head spindle housing 140. Pressurized air supplied through the rotary spindle shaft 130 hollow passageway 126 can also be coupled with distributed internal air passages in the spherical bearing housing 108 to provide a friction free air film in the sliding surface 107 area between the spherical bearing rotor 104 and the spherical bearing housing 108.

The controlled pressure of the fluid 127 present in the sealed chamber 123 provides uniform pressure across the pressure-exposed surface of the spherical bearing housing 108 and the workpiece carrier rotor 104 which transmits the pressure to the upper workpiece plate 161 which transmits the uniform applied pressure to the workpiece plate 102. Here, the applied fluid 127 pressure is directly and uniformly transmitted to the workpiece 170 that is attached to the workpiece plate 102 and to the workpiece 170 abraded surface that is in abrading contact with the flat-surfaced abrasive coating 100 on the rotary platen 172. During an abrading event, the "plain" mutual contact surfaces of the carrier spherical bearing rotor 104 and the carrier spherical bearing housing 108 provide a sealed spherical low friction joint 107 surface that allows abrading pressure to exist in the pressure chamber 123.

When the sealed chamber 123 is pressurized by a fluid 127, the workpiece plate 102 can move vertically downward in a direction 145 to bring the workpiece 102 into abrading contact with the flat-surfaced abrasive coating 100 on the rotary platen 172. Likewise, when vacuum 127 is applied to the sealed chamber 123, the workpiece plate 102 can be moved vertically upward in a direction 145 by the vacuum 127 to quickly move the workpiece 170 from abrading contact with the flat-surfaced abrasive coating 100 on the rotary platen 172.

Workpieces such as semiconductor or sapphire wafers or industrial sealing devices 170 are attached with vacuum 128 that is applied to the workpiece surfaces through vacuum port holes (not shown) that have a common vacuum distribution passageway (not shown) in the workpiece or wafer plate 102 which is fluid-connected with the vacuum source 128. Vacuum 128 is routed by a vacuum pipe 125 in the rotary spindle shaft 130 hollow open passageway 126 to the workpiece plate 102 vacuum distribution passageways by a flexible hollow tube 120 that is attached to a workpiece carrier rotor 104 vacuum passageway 110. Vacuum in the vacuum passageway 110 is connected to the common vacuum passageways and vacuum port holes in the workpiece or wafer plate 102 which provide vacuum attachment of the workpiece 170 to the workpiece plate 102. The flexible hollow tube 120 connected to the passageway 110 in the workpiece carrier rotor 104 flexes near the attachment point to the workpiece carrier rotor 104 as the workpiece carrier rotor 104 and the attached workpiece plate 102 and the attached workpiece 170 are tilted.

The flat-surfaced workpiece 170 is firmly attached to the workpiece carrier plate 102 by the large attachment pressure created by the vacuum 128. The flexible hollow tube 120 is fluid-coupled with the fluid rotary union. When the flat-surfaced workpieces 170 and the workpiece plate 102 are subjected to horizontal abrading friction forces (not shown) that are parallel to the abraded surface of the workpieces 170, the workpieces 170 remain firmly attached in-place on the workpiece plate 102. These abrading friction forces are resisted by the workpiece plate 102 as it is held radially in place by the spherical bearing rotor 104 which is held radially by the spherical bearing housing 108 which is supported by the slide linear workpiece head housing 146 which is radially supported by the closed curve surface lubricated workpiece head spindle housing 140 at the housing sliding surface 119.

The spherical low friction surface 107 of the plain spherical bearing rotor 104 and the plain spherical bearing housing 108 maintains air pressure sealed contact of the plain spherical bearing rotor 104 surface with the plain spherical bearing housing 108 surface to allow the pressure chamber 123 to maintain its pressurized seal when various components of the workpiece head carrier head 132 move relative to each other and the spherical bearing rotor 104 and the spherical bearing housing 108 rotate relative to each other.

Two compression springs (not shown) provide lifting forces to the workpiece carrier plate 102 to counteract the weight of the assembly including the workpiece, the workpiece carrier plate 102, the upper workpiece plate 161 and the spherical bearing rotor 104. Because of the forces applied by the compression springs, the spherical bearing rotor 104 remains in mutual contact with the spherical bearing housing 108 at the spherical low friction joint surface 107. The two parallel compression springs are concentric with respective parallel freestanding vertical guide rods 157 having one end of each vertical guide rod 157 attached to and supported by the spherical bearing housing 108 where the compression springs slide along the vertical guide rods 157.

The workpiece carrier plate 102 is pulled upward by the compression springs which act against a bridge plate 153 that has an attached flexible lift wire 155 having a lift wire free end 159 that is attached to the bridge plate 153 and where the opposed end of the flexible lift wire 155 is strung through an open through-hole in the cross-pin drive device 118 and through the open passageway 116 along the axial length of the hollow splined ball-end shaft device 154 and through an opening in the splined receptacle device 168 where the free end of the lift wire 155 is attached to the bottom surface of the spherical splined receptacle device 168. Two guide pin rods 124 that are attached to the cross-pin drive device 118 are slidably coupled with respective holes in the bridge plate 153 to stabilize the radial position of the bridge plate 153 and to maintain the concentric position of the flexible lift wire 155 in the respective through-hole in the cross-pin drive device 118 and concentric with the open passageway 116 along the axial length of the hollow splined ball-end shaft device 154 when the workpiece head 132 is rotated and the bridge plate 153 is subjected to centrifugal forces due to high speed rotation of the workpiece head 132.

The receptacle device 168 rotational drive arms 163 are held vertically in place in the workpiece carrier plate 102 shape-matching recessed receptacle 167 by vertical-restraining devices 103 that act as spacers between the upper surfaces of the drive arms 163 and the workpiece carrier upper plate 161 that is attached to the workpiece carrier plate 102. There are two opposed vertical-restraining devices 103 that are positioned at equal distances radially from a rotation axis 171 that is concentric with the splined ball-end hollow shaft device 154 shaft open passageway 116 along its axial length. The workpiece carrier upper plate 161 is attached to the spherical bearing rotor 104.

The location of the attachment point of the flexible lift wire 155 to the bottom surface of the receptacle device 168 is at a position close to the workpiece 170 mounting surface 101 of the workpiece plate 102 and, because the lift wire 155 is located at the rotational center of the hollow splined ball-end shaft device 154, prevents tilting of the workpiece carrier plate 102 and the attached workpiece 170 by the lifting forces of the lift wire 155. Positioning the two vertical-restraining devices 103 at equal distances radially from a rotation axis 171 that is concentric with the splined ball-end hollow shaft device 154 shaft open passageway 116 along its axial length also results in non-tilting of the workpiece carrier plate 102 and the attached workpiece 170 by the lifting forces of the lift wire 155. To further prevent tilting of the workpiece carrier plate 102 and the attached workpiece 170 by lifting forces applied by the lift wire 155, the attachment point of the lift wire 155 to the bottom surface of the receptacle device 168 is at a position within 1.5 inches or preferably within 0.500 inches and more preferably within 0.200 inches of the workpiece 170 mounting surface 101 of the workpiece plate 102.

The small 0.005 to 0.020 inch diameter solid high strength lift wire can be fabricated from various materials including metals, polymers and ceramics and can have a single strand or multiple strands or can be constructed as woven cables or non-stretch woven polymer filaments or can be constructed as combinations of these materials. These lift wires are very stiff longitudinally but very flexible in a transverse direction which prevents torque being applied to the workpiece carrier plate 102 and the attached workpiece 170 by the longitudinal lifting forces of the lift wire 155.

A drive pin 142 is attached to the slide workpiece head housing 146 and is contained in a cylindrical hole in the workpiece head spindle housing 140 which allows the workpiece head housing 146 to move vertically 145 relative to the workpiece head spindle housing 140 and prevent rotation of the workpiece head housing 146 relative to the workpiece head spindle housing 140. A compression spring 144 surrounding the drive pin 142 applies a downward force on the workpiece head housing 146 to maintain a gap between the workpiece head spindle drive housing 140 and the workpiece head slide housing 146 by counteracting a tension spring (not shown) that urges the workpiece head slide housing 146 upward toward the upper top portion of the workpiece head spindle drive housing 140.

The spherical center of rotation 166 of the plain-surfaced spherical bearing rotor 104 and the plain-surfaced spherical bearing housing 108 having a spherical diameter 164 is located at the abraded surface 173 of the workpiece 170 or within less than 1.0 inches or preferably less than 0.5 inches or most preferably less than 0.2 inches of the abraded surface 173 of the workpiece 170 that contacts the platen 172 abrasive surface 100. Location of the spherical center of rotation 166 at the abraded surface 173 of the workpiece 170 prevents tilting of the workpiece carrier rotor 104 and the workpiece 170 due to the lateral or horizontal abrading forces (not shown) that are applied to the abraded surface 173 of the workpiece 170. Prevention of torsional tilting of the workpiece carrier rotor 104 and the workpiece 170 occurs because the horizontal abrading force vectors (not shown) intersect the center of rotation 166 of the spherical bearing rotor 104 and the spherical bearing housing 108 where the abrading force does not have a torsional "lever arm" to form a workpiece carrier plate 102 tilting torque.

Figure 2:
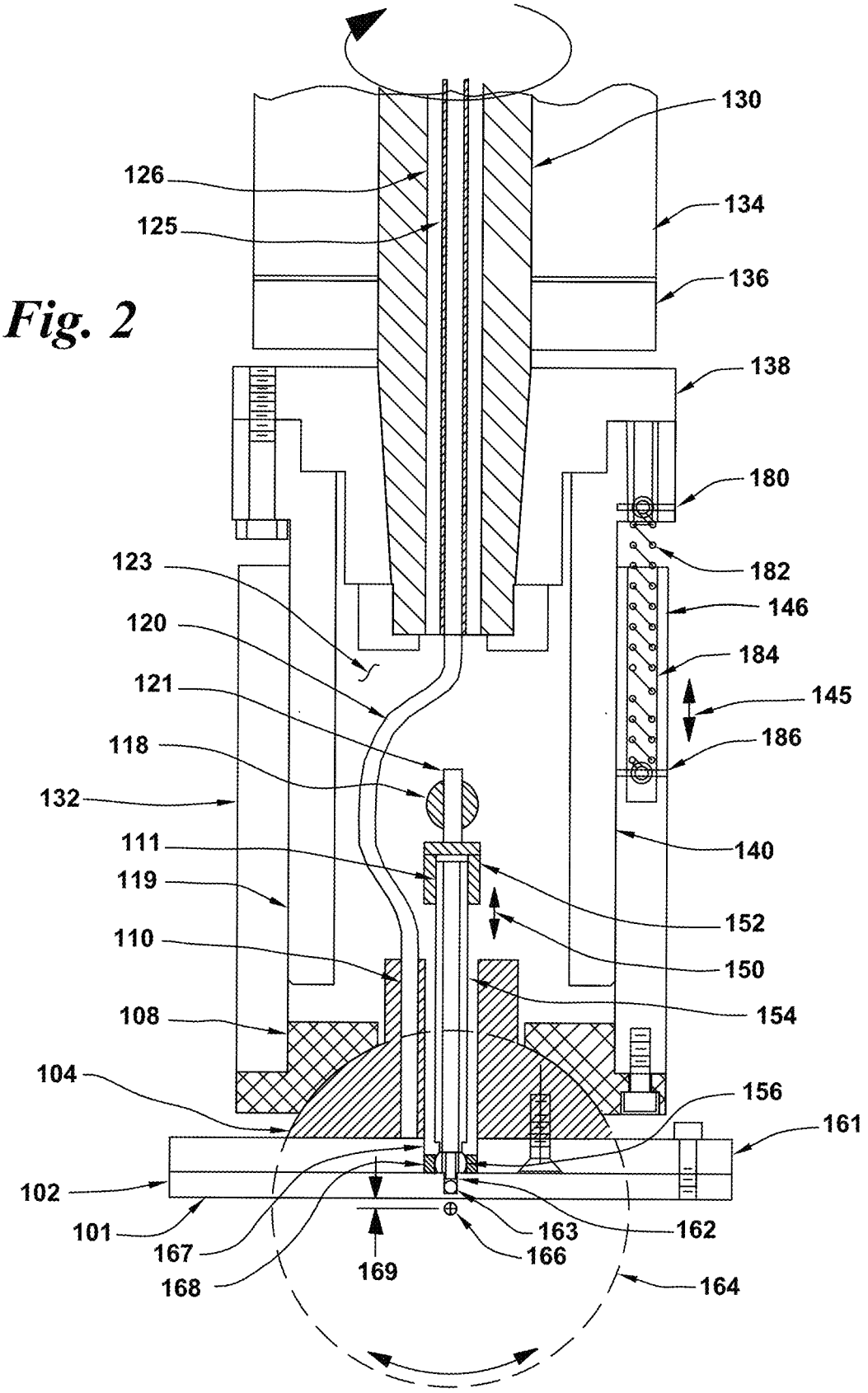
FIG. 2 is a cross section view of a floating workpiece carrier head with concentric housings.

FIG. 2 is a cross section view of the FIG. 1 workpiece carrier rotating abrading device where FIG. 2 is rotated 90 degrees from FIG. 1 to better show specific features of selected components of the workpiece carrier head. The rotary workpiece carrier head 132 is attached to a stationary rotary spindle device 134 that has a rotatable spindle plate 136 and the rotary spindle shaft 130 where the rotary spindle shaft 130 has a hollow open passageway 126 that extends along the length of the spindle shaft 130. A spindle flange 138 is attached to the rotary spindle shaft 130 and the workpiece head spindle housing 140 is attached to the spindle flange 138 and where the workpiece head slide housing 146 is positioned concentrically with the workpiece head spindle housing 140 and where the workpiece head housing 146 is in slidable contact with the workpiece head spindle drive housing 140 at a low-friction fluid pressure sealed sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a nominally spherical splined receptacle device 168 having rotational drive arms 163 that contact vertical slot walls 162 of a recessed receptacle 167 that is located in the workpiece carrier plate 102. The splined ball-end shaft device 154 splined ball end 156 allows the carrier plate 102 to rotate with spherical action about the spherical bearing rotor 104 spherical rotation center 166 having a spherical diameter 164 while the splined ball-end shaft device 154 maintains a nominally vertical position as the carrier plate 102 rotates. The spherical bearing spherical rotation center 166 is located an offset distance 169 from the workpiece carrier plate carrier plate 102 workpiece mounting surface 101 where the distance 169 is less than 2.0 inches and preferably less than 0.50 inches and more preferably less than 0.20 inches. The spherical bearing spherical rotation center 166 offset distance 169 can be measured where the spherical bearing spherical rotation center 166 is located in the open space way from the carrier plate carrier plate 102 workpiece mounting surface 101 or the spherical rotation center 166 offset distance 169 can be measured where the spherical bearing spherical rotation center 166 is located inboard away from the workpiece mounting surface 101 toward the workpiece head spindle drive housing 140.

The spherical-splined receptacle device 168 having rotational drive arms 163 is loosely fitted into the shape-matching recessed receptacle 167 having contact recessed vertical slot walls 162 in the workpiece carrier plate 102 which allows torque applied by the ball end shaft 154 to be translated to the workpiece carrier head 132 workpiece plate 102.

A splined ball end 156 spring clip (not shown) slidably traps the splined ball end 156 within the spherical splined receptacle device 168 to maintains contact of the splined ball end 156 with the spherical splined receptacle device 168 as the splined ball-end shaft device 154 floats freely in the nominally spherical splined receptacle device 168. The slide workpiece head housing 146 moves vertically 145 relative to the workpiece head spindle housing 140 and the splined ball end 156 maintains contact with the spherical splined receptacle device 168 as the workpiece head slide housing 146 is slid along the workpiece head spindle drive housing 140.

A flexible vacuum tube 120 connected to a hollow tube 125 contained in the hollow open passageway 126 within the rotary spindle shaft 130 provides vacuum or pressure from a rotary union (not shown) to the workpiece carrier plate carrier plate 102 workpiece mounting surface 101. The flexible hollow tube 120 is connected to the passageway 110 in the workpiece carrier rotor 104 and flexes near its attachment point to the workpiece carrier rotor 104 as the workpiece carrier rotor 104 and the attached workpiece plate 102 are tilted.

One or more tension springs 182 are used to counterbalance the composite weight of the slide workpiece head housing 146, the workpiece carrier spherical bearing rotor 104, the carrier spherical bearing housing 108, the workpiece carrier plate 102, the workpiece carrier upper plate 161, and the splined ball-end shaft device 154. The tension springs 182 prevent this composite weight from being adding to the controlled abrading pressure present in the pressure chamber 123 when applying a selected abrading pressure to the wafer or workpiece (not shown) that is attached to the workpiece carrier plate 102. The tension springs 182 are contained in receptacle holes 184 in the slide workpiece head housing 146 and are attached to the workpiece head housing 146 by removable lower spring pins 186 and attached to the workpiece head spindle housing 140 by removable upper spring pins 180.

The slide closed curve geometry workpiece head housing 146 moves vertically 145 relative to the closed curve workpiece head spindle drive housing 140 and the splined ball end 156 maintains contact with the spherical splined receptacle device 168 as the fork-type device 152 two forks 121 are attached to the cross-pin drive device 118 that is attached to the workpiece head spindle drive housing 140 as the fork-type device 152 having an axial splined surface 111 slides vertically 150 along a matching splined surface (not shown) on the upper portion of the splined ball-end shaft device 154.

Figure 3:
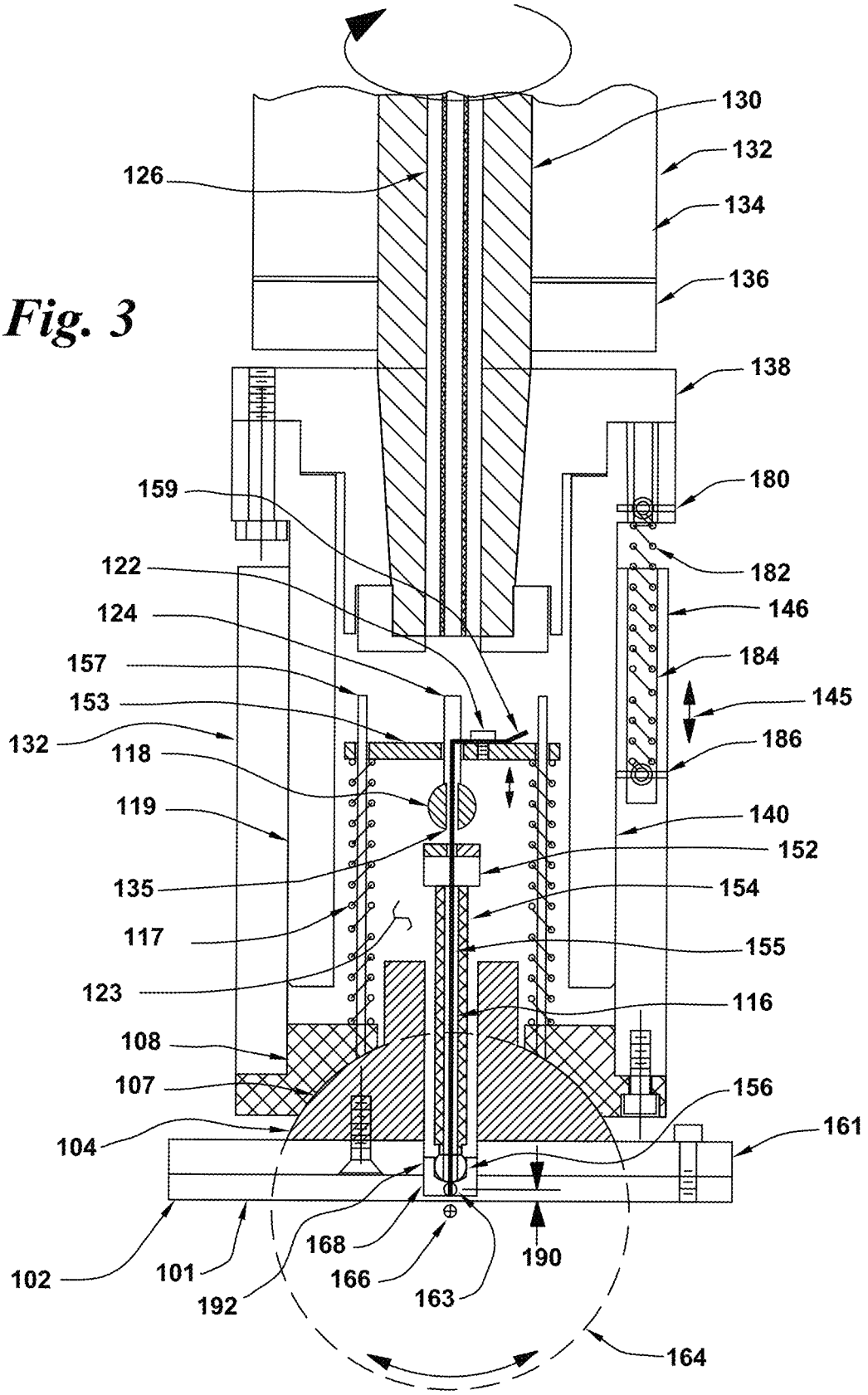
FIG. 3 is a cross section view of a spherical rotor weight is counterbalanced with springs.

FIG. 3 is a cross section view of the FIG. 1 workpiece carrier rotating abrading device where the spherical rotor weight is counterbalanced with springs. The rotary workpiece carrier head 132 is attached to a stationary rotary spindle device 134 that has a rotatable spindle plate 136 and the rotary spindle shaft 130 where the rotary spindle shaft 130 has a hollow open passageway 126 that extends along the length of the spindle shaft 130. A spindle flange 138 is attached to the rotary spindle shaft 130 and the workpiece head spindle drive housing 140 is attached to the spindle flange 138 and where the workpiece head housing 146 is positioned concentrically with the workpiece head spindle drive housing 140 and where the workpiece head housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a nominally spherical splined receptacle device 168 having rotational drive arms 163 that contact vertical slot walls of a recessed receptacle 192 located in the workpiece carrier plate 102. The splined ball-end shaft device 154 splined ball end 156 allows the carrier plate 102 to rotate with spherical action about the spherical bearing rotor 104 spherical rotation center 166 having a spherical diameter 164 while the splined ball-end shaft device 154 maintains a nominally vertical position as the carrier plate 102 rotates.

The spherical-splined receptacle device 168 having rotational drive arms 163 is loosely fitted into the shape-matching recessed receptacle (not shown) where contact of the rotational drive arms 163 with the recessed vertical slot walls in the workpiece carrier plate 102 which allows torque applied by the ball end shaft 154 to be translated to the workpiece carrier head 132 workpiece plate 102. The slide workpiece head housing 146 moves vertically 145 relative to the workpiece head spindle drive housing 140 and the splined ball end 156 maintains contact with the spherical splined receptacle device 168.

One or more tension springs 182 are used to counterbalance the composite weight of the slide workpiece head slide housing 146, the workpiece carrier spherical bearing rotor 104, the carrier spherical bearing housing 108, the workpiece carrier plate 102, the workpiece carrier upper plate 161, and the splined ball-end shaft device 154. The tension springs 182 are contained in receptacle holes 184 in the slide workpiece head housing 146 and are attached to the workpiece head housing 146 by removable lower spring pins 186 and attached to the workpiece head spindle drive housing 140 by removable upper spring pins 180.

Compression springs 117 are slidably positioned concentrically around cantilevered vertical guide shafts 157 that are attached to the carrier spherical bearing housing 108 where one end of the compression springs 117 contact the carrier spherical bearing housing 108 and the opposed end of the compression springs 117 contact a lift arm 153 that is slidably attached to the cantilevered vertical guide shafts 157. A flexible wire or cable 155 has a free end 159 is shown attached with a fastener 122 to the lift arm 153 where the flexible wire 155 is also routed through a hole 135 in the cross-pin drive device 118 that is attached to the workpiece head spindle drive housing 140. The wire 155 is also routed through a passageway 116 that extends through the length of the splined ball-end shaft device 154 where the other opposed end of the wire 155 is attached to the spherical-splined receptacle device 168 rotational drive arm 163.

The point of attachment of the wire 155 to the drive arm 163 is positioned a very small distance 190 from the workpiece mounting surface 101 of the workpiece plate 102 to minimize lifting forces applied along the length of the wire 155 from tilting the workpiece plate 102. To minimize the tilting torque on the workpiece plate 102, the distance 190 is less than 1.5 inches, or less than 1.0 inches, but preferably less than 0.5 inch and even more preferably less than 0.25 inches.

The compression springs 117 are compressed sufficiently to apply a force that counteracts the weight of the workpiece carrier spherical bearing rotor 104, the workpiece carrier plate 102, the workpiece carrier upper plate 161 and the workpiece (not shown) to prevent separation of the carrier spherical bearing rotor 104 from the carrier spherical bearing housing 108 due to the weight of these components. During an abrading event, the "plain" mutual contact surface 107 of the carrier spherical bearing rotor 104 and the carrier spherical bearing housing 108 provide a sealed surface that allows abrading pressure in the pressure chamber 123.

The compression springs 117 provide sufficient lifting forces to counteract the combined weights of the workpiece carrier rotor 104, the workpiece carrier plate 102 and the workpiece 170 to maintain a fluid pressure sealed pressure chamber 123. Use of the compression springs 117 providing lifting forces acting between the spherical bearing housing 108 and the workpiece carrier spherical rotor 104 and the receptacle device 168 allows the separation of the rotary workpiece carrier head 132 from the stationary rotary spindle device 134 to adjust the lifting force tension in the lift wire 155 compression springs 117.

Because of the forces applied by the compression springs 117, the spherical bearing rotor 104 remains in mutual contact with the spherical bearing housing 108 at the spherical low friction joint surface 107. The two parallel compression springs 117 are concentric with respective parallel freestanding vertical guide rods 157 having one end of each vertical guide rod 157 attached to and supported by the spherical bearing housing 108 where the compression springs 117 slide along the vertical guide rods 157.

Two guide pin rods 124 that are attached to the cross-pin drive device 118 are slidably coupled with respective holes in the bridge plate 153 to stabilize the radial position of the bridge plate 153 and to maintain the concentric position of the flexible lift wire 155 in the respective through-hole 135 in the cross-pin drive device 118 and concentric with the open passageway 116 along the axial length of the hollow splined ball-end shaft device 154 when the workpiece head 132 is rotated and the bridge plate 153 is subjected to centrifugal forces due to high speed rotation of the workpiece head 132.

The location of the attachment point of the flexible lift wire 155 to the bottom surface of the receptacle device 168 or to the spherical-splined receptacle device 168 rotational drive arm 163 is at a position close to the workpiece mounting surface 101 of the workpiece plate 102. Location of the lift wire 155 at the rotational center of the hollow splined ball-end shaft device 154 prevents tilting of the workpiece carrier plate 102 and the attached workpiece by the lifting forces of the lift wire 155.

The small 0.005 to 0.020 inch diameter solid high strength steel or woven cable or non-stretch woven polymer fiber line is very stiff longitudinally but very flexible in a transverse direction which prevents torque being applied to the workpiece carrier plate 102 and the attached workpiece 170 by the longitudinal lifting forces of the lift wire 155. The compression springs 117 provide sufficient lifting forces to counteract the combined weights of the workpiece carrier rotor 104, the workpiece carrier plate 102 and the workpiece 170 to maintain a fluid pressure sealed pressure chamber 123. Use of the compression springs 117 providing lifting forces acting between the spherical bearing housing 108 and the workpiece carrier spherical rotor 104 and the receptacle device 168 allows the separation of the rotary workpiece carrier head 132 from the stationary rotary spindle device 134 to adjust the lifting force tension in the lift wire 155 compression springs 117.

Figure 4:
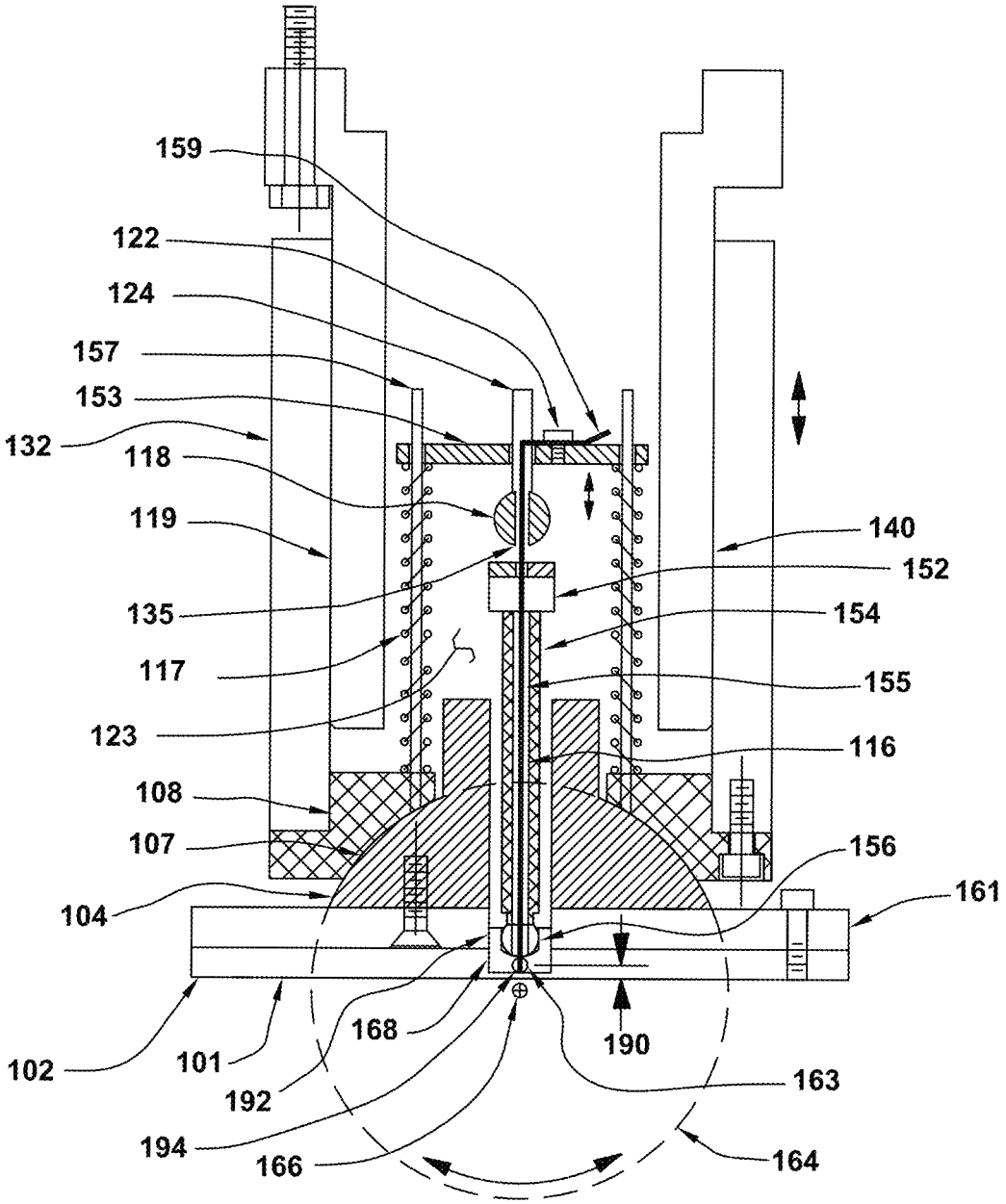
FIG. 4 is a cross section view of a separated workpiece carrier rotating abrading device.

FIG. 4 is a cross section view of the workpiece carrier rotating abrading device that is separated from the spindle flange. When the workpiece carrier head 132 is separated from the spindle flange (not shown) the head 132 remains coupled together as an assembly. The workpiece head slide housing 146 is positioned concentrically with the workpiece head spindle drive housing 140 and the workpiece head slide housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a nominally spherical splined receptacle device 168 having rotational drive arms 163 that contact vertical slot walls of a recessed receptacle 192 located in the workpiece carrier plate 102. The splined ball-end shaft device 154 splined ball end 156 allows the carrier plate 102 to rotate with spherical action about the spherical bearing rotor 104 spherical rotation center 166 having a spherical diameter 164 while the splined ball-end shaft device 154 maintains a nominally vertical position as the carrier plate 102 rotates.

When the workpiece carrier head 132 is separated from the spindle flange (not shown) the head 132 remains coupled together because the weight of the disconnected head components are counteracted by the tension springs 182 which are used to counterbalance the composite weight of the slide workpiece head slide housing 146, the workpiece carrier spherical bearing rotor 104, the carrier spherical bearing housing 108, the workpiece carrier plate 102, the workpiece carrier upper plate 161, and the splined ball-end shaft device 154 even though the workpiece head slide housing 146 is in slidable contact with the workpiece head spindle drive housing 140 at the low-friction sliding surface 119. The tension springs 182 are contained in receptacle holes 184 in the slide workpiece head slide housing 146 and are attached to the workpiece head slide housing 146 by removable lower spring pins 186 and attached to the workpiece head spindle drive housing 140 by removable upper spring pins 180.

Compression springs 117 are slidably positioned concentrically around cantilevered vertical guide shafts 157 that are attached to the carrier spherical bearing housing 108 where one end of the compression springs 117 contact the carrier spherical bearing housing 108 and the opposed end of the compression springs 117 contact a lift arm 153 that is slidably attached to the cantilevered vertical guide shafts 157. A flexible wire or cable 155 has a free end 159 is shown attached with a fastener 122 to the lift arm 153 where the flexible wire 155 is also routed through a hole 135 in the cross-pin drive device 118 that is attached to the workpiece head spindle drive housing 140. The wire 155 is also routed through a passageway 116 that extends through the length of the splined ball-end shaft device 154 where the other opposed end of the wire 155 is attached to the spherical-splined receptacle device 168 rotational drive arm 163.

The compression springs 117 provides sufficient lifting forces to counteract the combined weights of the workpiece carrier rotor 104, the workpiece carrier plate 102 and the workpiece 170 to maintain conformal contact of the mutual low-friction sliding surface 107 of the workpiece carrier spherical rotor 104 and the workpiece carrier spherical housing 108. Use of the compression springs 117 providing lifting forces acting between the spherical bearing housing 108 and the workpiece carrier spherical rotor 104 and the receptacle device 168 allows the separation of the rotary workpiece carrier head 132 from the stationary rotary spindle device 134 without separation of the slide housing 146 assembly from the drive housing 140. to adjust and service the workpiece carrier head 132.

Because of the forces applied by the compression springs 117, the spherical bearing rotor 104 remains in mutual contact with the spherical bearing housing 108 at the spherical low friction surface 107. The two parallel compression springs 117 are concentric with respective parallel freestanding vertical guide rods 157 having one end of each vertical guide rod 157 attached to and supported by the spherical bearing housing 108 where the compression springs 117 slide along the vertical guide rods 157.

Two guide pin rods 124 that are attached to the cross-pin drive device 118 are slidably coupled with respective holes in the bridge plate 153 to stabilize the radial position of the bridge plate 153 and to maintain the concentric position of the flexible lift wire 155 in the respective through-hole 135 in the cross-pin drive device 118 and concentric with the open passageway 116 along the axial length of the hollow splined ball-end shaft device 154 when the workpiece head 132 is rotated and the bridge plate 153 is subjected to centrifugal forces due to high speed rotation of the workpiece head 132.

The point of attachment 194 of the wire 155 to the drive arm 163 is positioned a very small distance 190 from the workpiece mounting surface 101 of the workpiece plate 102 to minimize lifting forces applied along the length of the wire 155 from tilting the workpiece plate 102. To minimize the tilting torque on the workpiece plate 102, the distance 190 is less than 1.0 inch, but preferably less than 0.5 inch and even more preferably less than 0.25 inches.

The location of the attachment point of the flexible lift wire 155 to the bottom surface of the receptacle device 168 or to the spherical-splined receptacle device 168 rotational drive arm 163 is at a position close to the workpiece mounting surface 101 of the workpiece plate 102. Location of the lift wire 155 at the rotational center of the hollow splined ball-end shaft device 154 prevents tilting of the workpiece carrier plate 102 and the attached workpiece by the lifting forces of the lift wire 155.

Figure 5:
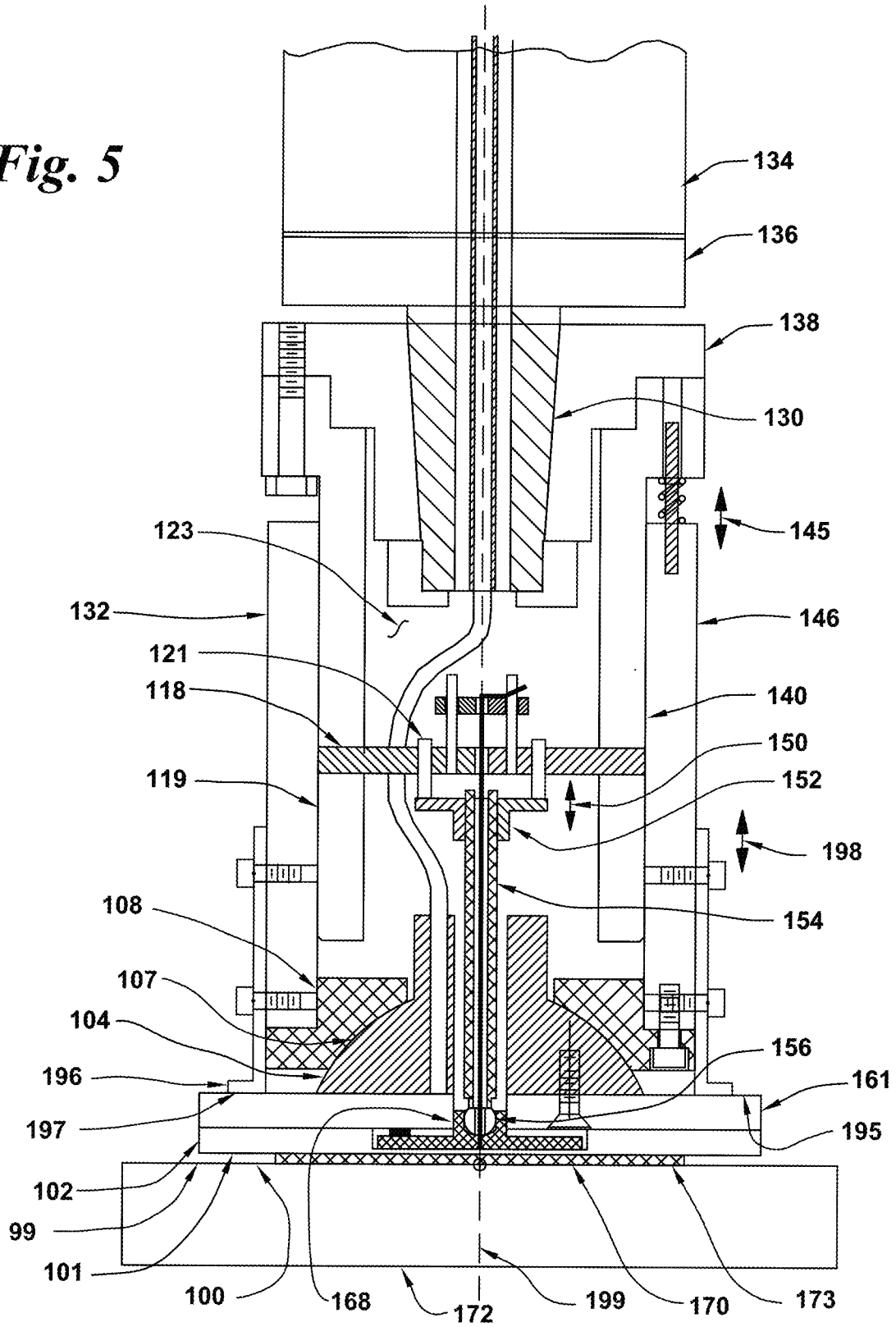
FIG. 5 is a cross section view of a rigid mode workpiece head.

FIG. 5 is a cross section view of the FIG. 1 workpiece head describing the adjustable rigid mode abrading device attached to the workpiece carrier slide housing and where the slide housing has an attached spherical bearing housing device. The rotary workpiece carrier head 132 is attached to a stationary rotary spindle device 134 that has a rotatable spindle plate 136 and a rotary spindle shaft 130 where the rotary spindle shaft 130 has a hollow open passageway that extends along the length of the spindle shaft 130. The hollow open passageway provides a passageway for pressurized fluid or vacuum that is transmitted from the rotary spindle shaft 130 rotary union device (not shown) to a sealed pressure chamber 123. A spindle flange 138 is attached to the rotary spindle shaft 130 and the workpiece head spindle drive housing 140 is attached to the spindle flange 138 and where the workpiece head slide housing 146 is positioned concentrically with the workpiece head spindle drive housing 140 and where the workpiece head slide housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a spherical ball splined receptacle device having rotational drive arms that contact vertical slot walls of a recessed receptacle located in the workpiece carrier plate 102.

A fork-type shaft drive device is attached to the splined ball-end shaft device 154 and the forks of the fork-type device are attached to a cross-pin drive device 118 that is attached to a workpiece head spindle drive housing 140 where rotation of the workpiece head spindle housing 140 rotates the splined ball-end hollow shaft device 154 which rotates the spherical splined receptacle device rotational drive arms contacting the recessed receptacle having vertical slot walls in the carrier plate 102 thereby rotating the carrier plate 102 and the workpiece 170 attached to the carrier plate 102. The slide closed curve geometry workpiece head slide housing 146 is movable vertically 145 along the vertical drive housing rotation axis 199 relative to the closed curve workpiece head spindle drive housing 140.

Another configuration is where the splined ball end 156 maintains contact with the spherical splined receptacle device 168 as the fork-type device 152 two forks 121 are slidably attached to the cross-pin drive device 118 that is attached to the workpiece head spindle drive housing 140 as the fork-type device 152 having an axial splined surface 111 slides vertically 150.

The workpiece plate 102 can be moved vertically relative to the workpiece head spindle drive housing 140 and tilted relative to the workpiece head spindle drive housing 140 vertical drive housing rotation axis 199. Tilting of the plain spherical bearing rotor 104 and the workpiece plate 102 which is attached to the spherical bearing rotor 104 is provided by the spherical sliding action of the plain sliding bearing spherical bearing rotor 104 at the mutual low-friction sliding surface 107 of the spherical bearing housing 108 and the spherical bearing rotor 104. The plain-surfaced spherical bearing rotor 104 is nested in sliding contact with the spherical bearing housing 108.

Pressure in the sealed pressure chamber 123 is directly and uniformly transmitted to the spherical bearing rotor 104 and transmitted to the upper workpiece plate 161 which transmits the uniform applied pressure to the workpiece plate 102 and transmitted to the workpiece 170 that is attached to the workpiece plate 102 mounting surface 101 and transmitted to the workpiece 170 abraded surface 173 that is in abrading contact with the flat-surfaced abrasive coating 100 on the rotary platen 172.

The rotary workpiece carrier head 132 can be used in a rigid mode where the workpiece plate 102 is prevented from tilting spherically during a workpiece carrier floating mode abrading procedure. Here, one or more rigid abrading devices 196 are adjustably attached to the workpiece head slide housing 146 where the rigid abrading devices 196 can be positioned in contact with the top surface 195 of the upper workpiece plate 161 when the workpiece plate 102 workpiece mounting surface 101 is positioned in flat conformal contact with the platen 172 flat mounting surface 99 after the platen 172 flat mounting surface 99 is aligned perpendicular to the workpiece head spindle drive housing 140 vertical axis of rotation 199. After positioning the workpiece plate 102 mounting surface 101 in conformal contact with the platen 172 flat mounting surface 99, the rigid abrading devices 196 are structurally attached to the workpiece head slide housing 146.

The rotary workpiece carrier head 132 can then be raised vertically along the workpiece head spindle drive housing 140 vertical axis of rotation 199, one or more workpieces 170 attached to the carrier plate 102, an abrasive material having a flat exposed surface 100 is attached to the platen 172 and the rotary workpiece carrier head 132 lowered where the workpiece 170 abraded surface 173 contacts the platen 172 abrasive surface 100. Both the platen 172 and the workpiece plate 102 are rotated to abrade the workpiece 170 abraded surface 173 where the workpiece 170 abraded surface 173 is perpendicular to the drive housing 140 vertical axis of rotation 199. After abrading, the workpiece 170 can then be separated from the workpiece plate 102, the workpiece 170 turned over and the workpiece 170 abraded surface 173 attached to the workpiece plate 102 and the abrading procedure repeated where both opposed abraded surfaces of the workpiece 170 are parallel to each other.

To reestablish the workpiece carrier floating mode operation, the rigid abrading devices 196 are adjustably attached to the workpiece head slide housing 146 in a position where they do not contact the workpiece carrier 102 or they are removed from the workpiece head slide housing 146.

Figure 6:
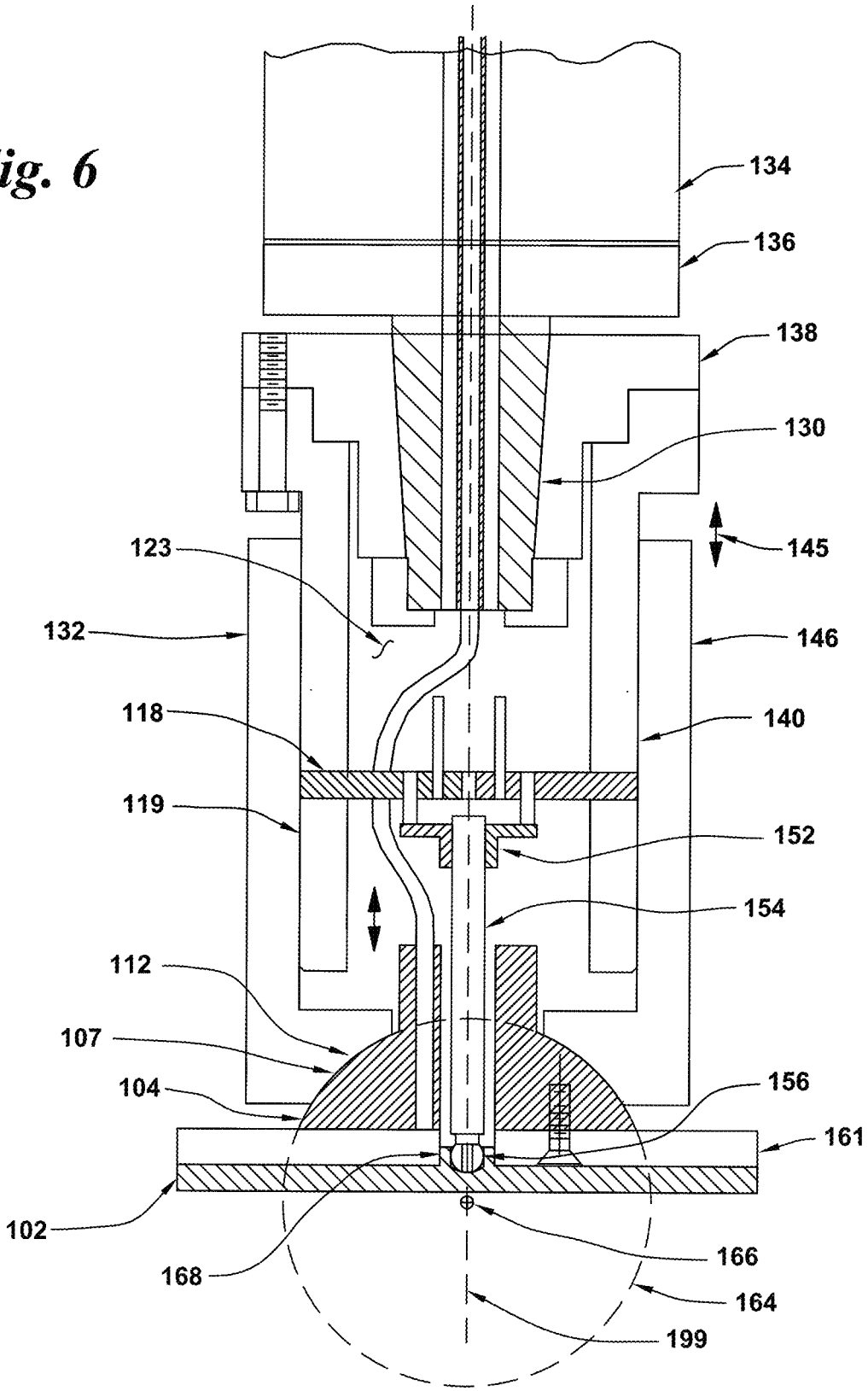
FIG. 6 is a cross section view of a workpiece head integral spherical bearing housing.

FIG. 6 is a cross section view of the FIG. 1 workpiece head describing a slide housing having an integral spherical bearing housing. The rotary workpiece carrier head 132 is attached to a stationary rotary spindle device 134 that has a rotatable spindle plate 136 and the rotary spindle shaft 130 where the rotary spindle shaft 130 has a hollow open passageway that extends along the length of the spindle shaft 130. The hollow open passageway provides a passageway for pressurized fluid or vacuum that is transmitted from the rotary spindle shaft 130 rotary union device (not shown) to a sealed pressure chamber 123. A spindle flange 138 is attached to the rotary spindle shaft 130 and the workpiece head spindle drive housing 140 is attached to the spindle flange 138 and where the workpiece head slide housing 146 is positioned concentrically with the workpiece head spindle drive housing 140 and where the workpiece head slide housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a carrier plate 102 spherical ball splined receptacle device 168 that is a structural part of the workpiece carrier plate 102. The splined ball-end shaft device 154 splined ball end 156 allows the carrier plate 102 to rotate with spherical rotation action about the spherical bearing rotor 104 spherical rotation center 166 having a spherical diameter 164 while the splined ball-end shaft device 154 maintains a nominally vertical position as the carrier plate 102 rotates.

A fork-type shaft drive device 152 is attached to and slides along the splined ball-end shaft device 154 and the forks 121 of the fork-type device 152 are attached to a cross-pin drive device 118 that is attached to a workpiece head spindle drive housing 140 where rotation of the workpiece head spindle housing 140 rotates the splined ball-end hollow shaft device 154 which rotates the spherical ball splined receptacle device 168

The workpiece plate 102 can be moved vertically relative to the workpiece head spindle drive housing 140 and tilted relative to the workpiece head spindle drive housing 140 vertical drive housing rotation axis 199. Tilting of the plain sliding surface spherical bearing rotor 104 is provided by the spherical sliding action of the plain sliding bearing spherical bearing rotor 104 at the mutual low-friction sliding surface 107 of the workpiece head slide housing 146 integral spherical bearing housing surface 112. The plain-surfaced spherical slide bearing rotor 104 is nested in sliding contact with workpiece head slide housing 146 integral spherical bearing housing surface 112. Pressure in the sealed pressure chamber 123 is directly and uniformly transmitted to the spherical bearing rotor 104 and transmitted to the upper workpiece plate 161 which transmits the uniform applied pressure to the workpiece plate 102.

Figure 7:
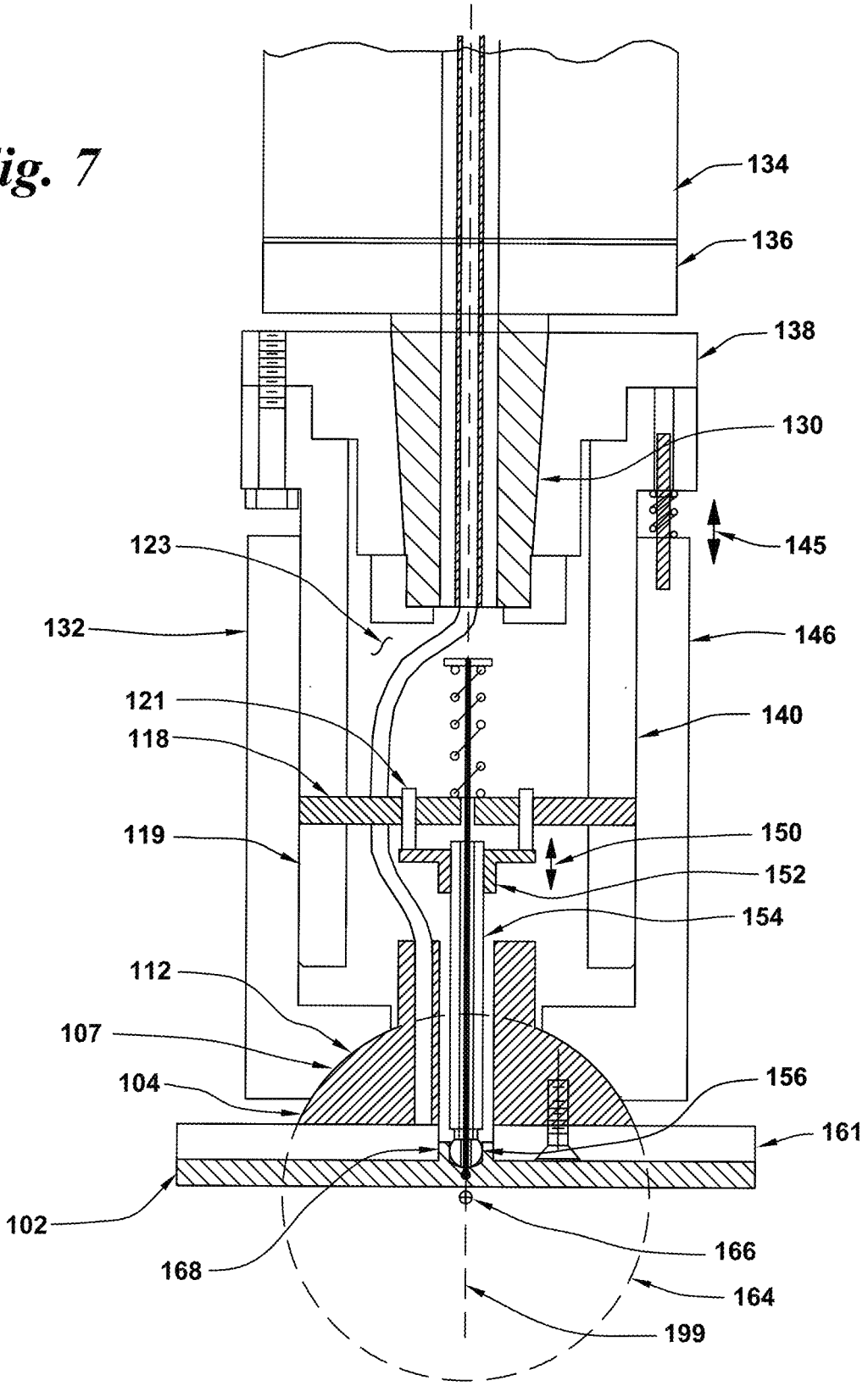
FIG. 7 is a cross section view of a workpiece head hollow workpiece rotation shaft.

FIG. 7 is a cross section view of the FIG. 1 workpiece head describing a slide housing having a hollow workpiece rotation shaft. The rotary workpiece carrier head 132 is attached to a stationary rotary spindle device 134 that has a rotatable spindle plate 136 and the rotary spindle shaft 130 where the rotary spindle shaft 130 has a hollow open passageway that extends along the length of the spindle shaft 130. The hollow open passageway provides a passageway for pressurized fluid or vacuum that is transmitted from the rotary spindle shaft 130 rotary union device (not shown) to a sealed pressure chamber 123. A spindle flange 138 is attached to the rotary spindle shaft 130 and the workpiece head spindle drive housing 140 is attached to the spindle flange 138 and where the workpiece head slide housing 146 is positioned concentrically with the workpiece head spindle drive housing 140 and where the workpiece head slide housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end shaft device 154 has a splined ball end 156 that floats freely in a carrier plate 102 spherical ball splined receptacle device 168 that is a structural part of the workpiece carrier plate 102. The splined ball-end shaft device 154 splined ball end 156 allows the carrier plate 102 to rotate with spherical rotation action about the spherical bearing rotor 104 spherical rotation center 166 having a spherical diameter 164 while the splined ball-end shaft device 154 maintains a nominally vertical position as the carrier plate 102 rotates.

A fork-type shaft drive device 152 is attached to and slides along the splined ball-end shaft device 154 and the forks 121 of the fork-type device 152 are attached to a cross-pin drive device 118 that is attached to a workpiece head spindle drive housing 140 where rotation of the workpiece head spindle housing 140 rotates the splined ball-end hollow shaft device 154 which rotates the spherical ball splined receptacle device 168.

Another configuration is where the splined ball end 156 maintains contact with the spherical splined receptacle device 168 as the fork-type device 152 two forks 121 are slidably attached to the cross-pin drive device 118 that is attached to the workpiece head spindle drive housing 140 as the fork-type device 152 having an axial splined surface 111 slides vertically 150.

The workpiece plate 102 can be moved vertically relative to the workpiece head spindle drive housing 140 and tilted relative to the workpiece head spindle drive housing 140 vertical drive housing rotation axis 199. Tilting of the plain sliding surface spherical bearing rotor 104 is provided by the spherical sliding action of the plain sliding bearing spherical bearing rotor 104 at the mutual low-friction sliding surface 107 of the workpiece head slide housing 146 integral spherical bearing housing surface 112. The plain-surfaced spherical slide bearing rotor 104 is nested in sliding contact with the workpiece head slide housing 146 integral spherical bearing housing surface 112. Pressure in the sealed pressure chamber 123 is directly and uniformly transmitted to the spherical bearing rotor 104 and the workpiece head slide housing 146 which transmits the pressure to the spherical slide bearing rotor 104 and where the pressure is transmitted to the upper workpiece plate 161 which transmits the uniform applied pressure to the workpiece plate 102.

Figure 8:
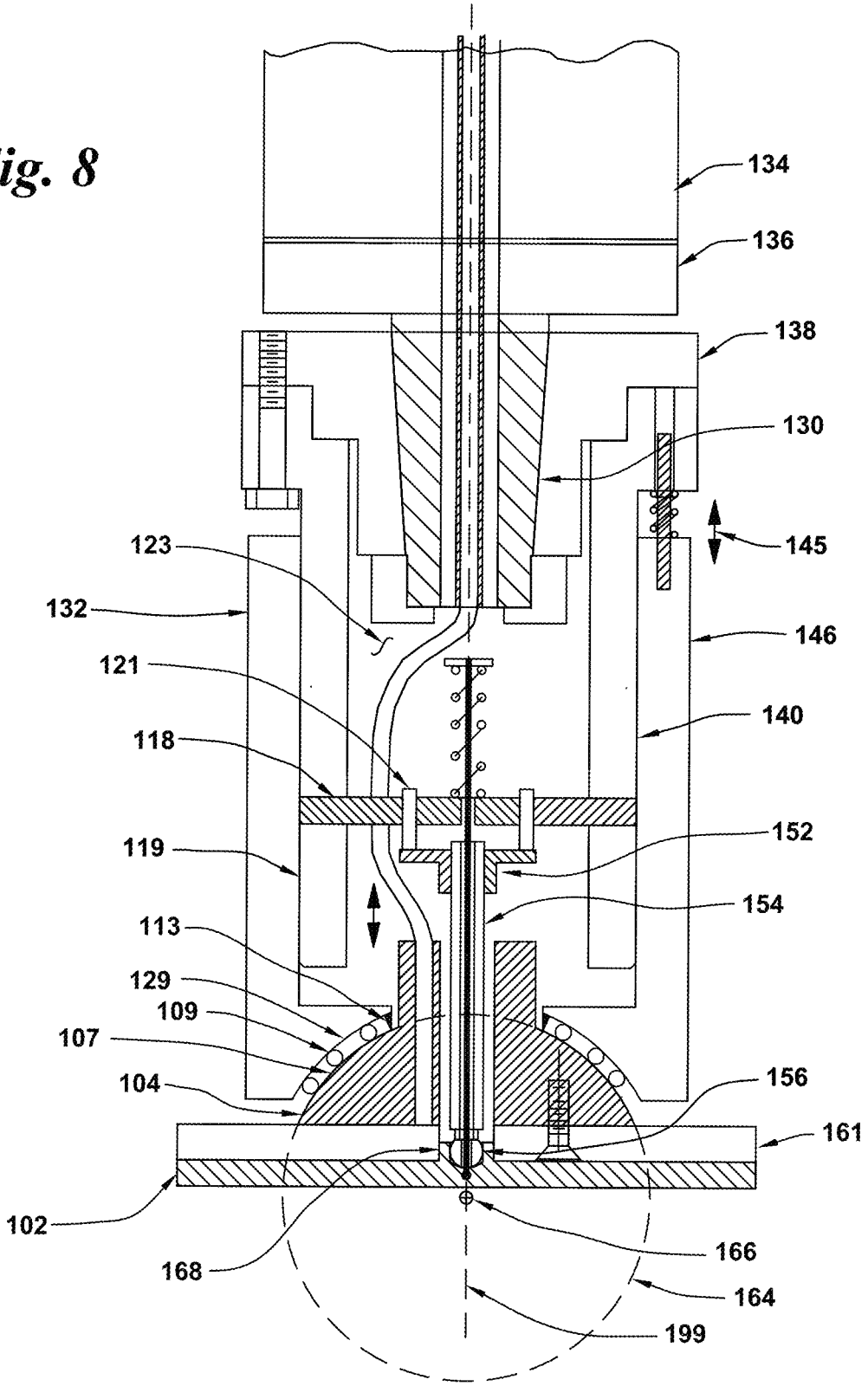
FIG. 8 is a cross section view of a workpiece head roller-bearing type spherical bearing.

FIG. 8 is a cross section view of a workpiece head similar to the workpiece head described in FIG. 1 having a roller-bearing type spherical bearing housing device. The rotary workpiece carrier head 132 is attached to a stationary rotary spindle device 134 that has a rotatable spindle plate 136 and the rotary spindle shaft 130 where the rotary spindle shaft 130 has a hollow open passageway that extends along the length of the spindle shaft 130. The hollow open passageway provides a passageway for pressurized fluid or vacuum that is transmitted from the rotary spindle shaft 130 rotary union device (not shown) to a sealed pressure chamber 123. A spindle flange 138 is attached to the rotary spindle shaft 130 and the workpiece head spindle drive housing 140 is attached to the spindle flange 138 and where the workpiece head slide housing 146 is positioned concentrically with the workpiece head spindle drive housing 140 and where the workpiece head slide housing 146 is in slidable contact with the workpiece head spindle drive housing 140 at a low-friction closed curve sliding surface 119.

The rotary workpiece carrier head 132 has a workpiece plate 102 that is rotationally driven by a splined ball-end hollow shaft device 154 that has a shaft open passageway along its axial length. The splined ball-end hollow shaft device 154 has a splined ball end 156 that floats freely in a carrier plate 102 spherical ball splined receptacle device 168 that is a structural part of the workpiece carrier plate 102. The splined ball-end shaft device 154 splined ball end 156 allows the carrier plate 102 to rotate with spherical rotation action about the spherical bearing rotor 104 spherical rotation center 166 having a spherical diameter 164 while the splined ball-end shaft device 154 maintains a nominally vertical position as the carrier plate 102 rotates.

A fork-type shaft drive device 152 is attached to and slides along the splined ball-end shaft device 154 and the forks 121 of the fork-type device 152 are attached to a cross-pin drive device 118 that is attached to a workpiece head spindle drive housing 140 where rotation of the workpiece head spindle housing 140 rotates the splined ball-end hollow shaft device 154 which rotates the spherical ball splined receptacle device 168.

Another configuration is where the splined ball end 156 maintains contact with the spherical splined receptacle device 168 as the fork-type device 152 two forks 121 are slidably attached to the cross-pin drive device 118 that is attached to the workpiece head spindle drive housing 140 as the fork-type device 152 having an axial splined surface 111 slides vertically 150.

The workpiece plate 102 can be moved vertically relative to the workpiece head spindle drive housing 140 and tilted relative to the workpiece head spindle drive housing 140 vertical drive housing rotation axis 199. Tilting of the plain sliding surface spherical bearing rotor 104 is provided by the rotation of the ball bearings 109 positioned in the gap between the spherical bearing rotor 104 and the workpiece head slide housing 146 spherical bearing housing spherical surface 129. The plain-surfaced spherical slide bearing rotor 104 is in rotatable contact with the ball bearing rollers 109 that contact the workpiece head slide housing 146 spherical bearing housing spherical surface 129 and the surface 107 of the workpiece head slide housing 146.

A fluid pressure seal device 113 is positioned in the gap between the spherical bearing rotor 104 and the workpiece head slide housing 146 spherical bearing housing spherical surface 129 which allows a sealed pressure chamber 123 to be formed without fluid pressure leakage between the ball bearing rollers 109. The fluid pressure seal 113 seals the bearing roller 109 gap between the spherical bearing housing 108 and the spherical bearing rotor 104. Pressure in the sealed pressure chamber 123 is directly and uniformly transmitted to the spherical bearing rotor 104 and transmitted to the upper workpiece plate 161 which transmits the uniform applied pressure to the workpiece plate 102.

Figure 9:
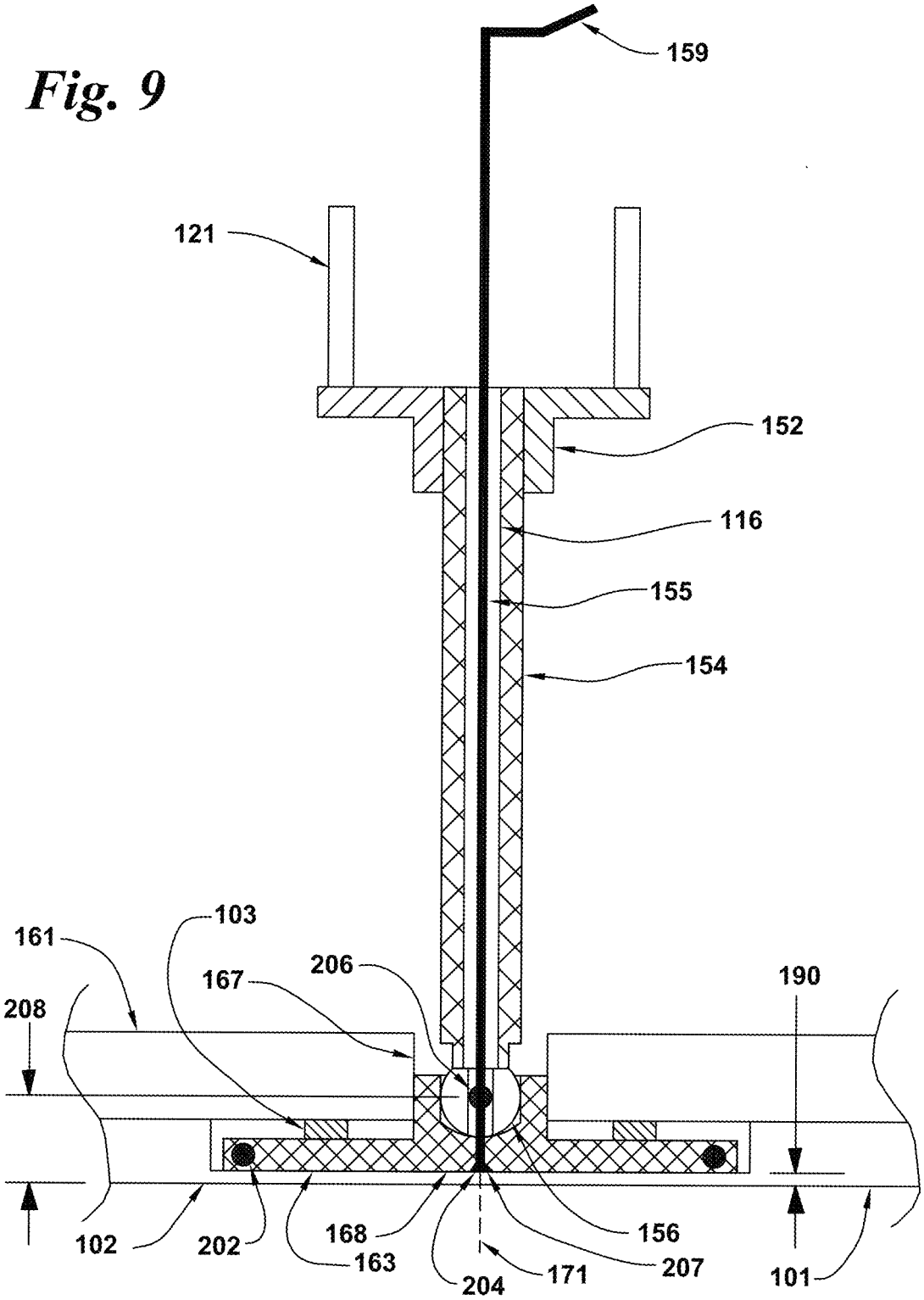
FIG. 9 is a cross section view of a rotational hollow splined ball-end hollow shaft device.

FIG. 9 is a cross section view of a rotational hollow splined ball-end hollow shaft device. A rotary workpiece carrier head (not shown) has a workpiece plate 102 that is rotationally driven by a splined ball-end hollow shaft device 154 that has a shaft open passageway 116 along its axial length. The splined ball-end hollow shaft device 154 has a splined ball end 156 that floats freely in a carrier plate 102 spherical ball splined receptacle device 168 that is attached to or is a structural part of the splined ball-end shaft device 154 splined ball end 156 which allows the carrier plate 102 to rotate with spherical rotation action about the spherical bearing rotor (not shown) spherical rotation center (not shown) while the splined ball-end shaft device 154 maintains a nominally vertical position as the carrier plate 102 rotates.

The splined ball-end shaft device 154 splined ball end 156 has a splined ball end rotation center 206 that is located a splined ball offset distance 208 from the workpiece mounting surface 101 of the workpiece plate 102 to minimize rotational torque forces applied to the splined ball-end shaft device 154 from tilting the workpiece plate 102. To minimize the tilting torque on the workpiece plate 102, the offset distance 208 is less than 1.5 inches, or less than 1.0 inches, but preferably less than 0.5 inch and even more preferably less than 0.25 inches.

A fork-type shaft drive device 152 is attached to and slides along the splined ball-end shaft device 154 and the forks 121 of the fork-type device 152 are rotated by a workpiece head spindle drive housing (not shown) where rotation of the workpiece head spindle housing rotates the splined ball-end hollow shaft device 154 which rotates the spherical ball splined receptacle device 168 which rotates the workpiece carrier plate 102.

The workpiece carrier plate 102 can be pulled upward by springs (not shown) which act against a bridge plate (not shown) that has an attached flexible lift wire 155 having a lift wire free end 159 that is attached to the bridge plate. The opposed end 207 of the flexible lift wire 155 is strung through an open through-hole in a cross-pin drive device (not shown) and through the open passageway 116 along the axial length of the hollow splined ball-end shaft device 154 and through an opening in the splined receptacle device 168 and is attached to the spherical splined receptacle device 168 at a position 204 that is located a distance 190 measured to the bottom surface of the workpiece carrier plate 102. Also, as an alternative, the opposed end 207 of the flexible lift wire 155 can be attached to the workpiece plate 102.

The point of attachment 204 of the lift wire 155 to the spherical splined receptacle device 168 is positioned the distance 190 from the workpiece mounting surface 101 of the workpiece plate 102 to minimize lifting forces applied along the length of the wire 155 from tilting the workpiece plate 102. To minimize the tilting torque on the workpiece plate 102, the distance 190 is less than 1.5 inches, or less than 1.0 inches, but preferably less than 0.5 inches and even more preferably less than 0.25 inches.

The receptacle device 168 is shown with rotational drive arms 163 that are held vertically in place in the workpiece carrier plate 102 shape-matching recessed receptacle 167 by vertical-restraining devices 103 that act as spacers between the upper surfaces of the drive arms 163 and the workpiece carrier upper plate 161 that is attached to the workpiece carrier plate 102. The drive arms 163 can be flexible where each drive arm 163 would contact the workpiece plate 102 at contact points 202. The two opposed vertical-restraining devices 103 are shown positioned at equal distances radially from a rotation axis 171 that is concentric with the splined ball-end hollow shaft device 154 shaft open passageway 116 along its axial length. The workpiece carrier upper plate 161 is attached to the spherical bearing rotor (not shown). There are a number of different possible configurations of the attachment of the lift wire 155 to the workpiece plate 102 that will perform the same function as the described configuration.

Figure 10:
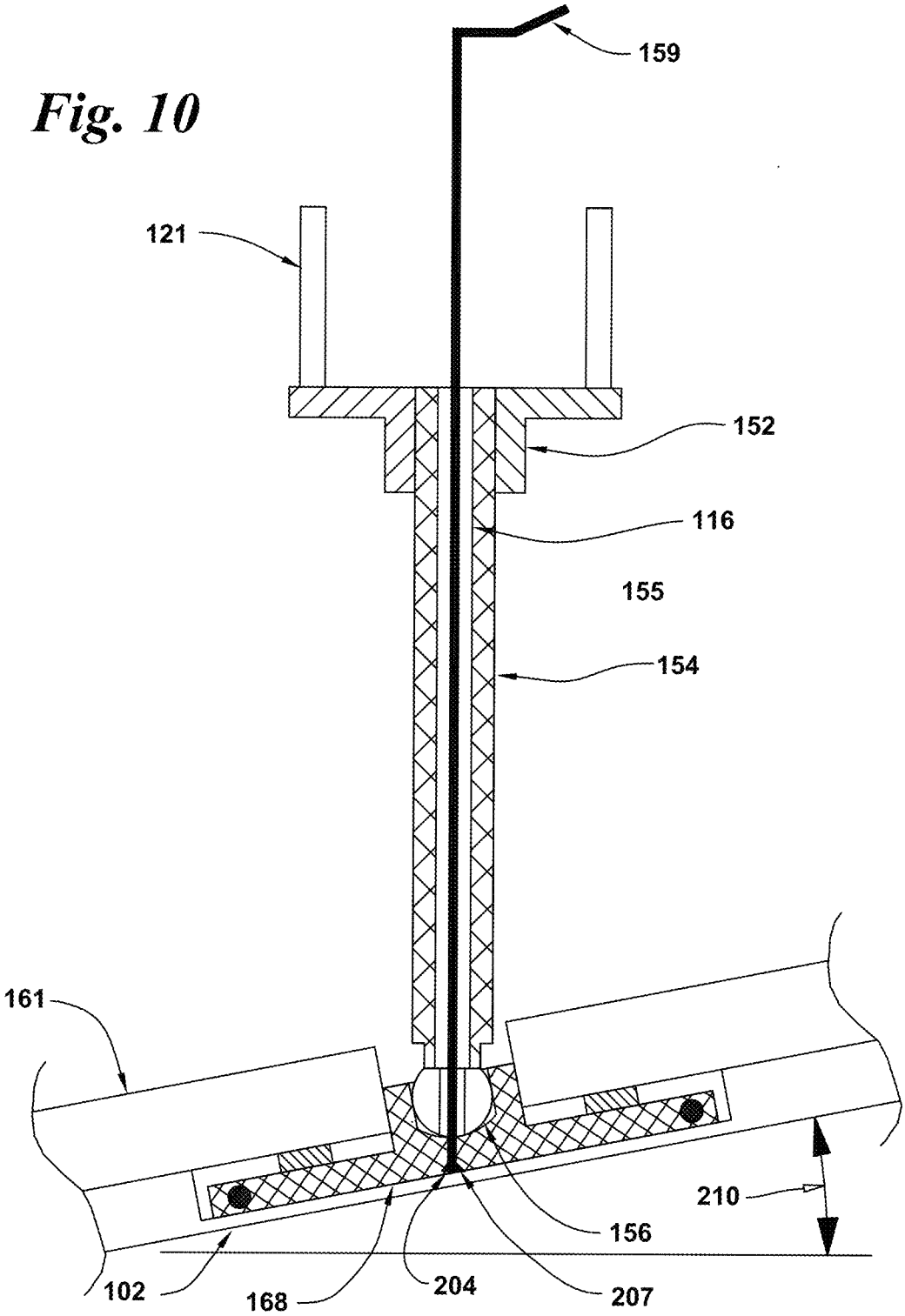
FIG. 10 is a cross section view of a splined ball-end hollow shaft tilted carrier plate.

FIG. 10 is a cross section view of a rotational hollow splined ball-end hollow shaft device with a tilted workpiece carrier plate. A rotary workpiece carrier head (not shown) has a workpiece plate 102 that is rotationally driven by a splined ball-end hollow shaft device 154 that has a shaft open passageway 116 along its axial length. The splined ball-end hollow shaft device 154 has a splined ball end 156 that floats freely in a carrier plate 102 spherical ball splined receptacle device 168 that is attached to or is a structural part of the splined ball-end shaft device 154 splined ball end 156 which allows the carrier plate 102 to rotate with spherical rotation action about the spherical bearing rotor (not shown) spherical rotation center (not shown) while the splined ball-end shaft device 154 maintains a nominally vertical position as the carrier plate 102 rotates. The carrier plate 102 rotates spherically an angle 210 measured from horizontal.

A fork-type shaft drive device 152 is attached to and slides along the splined ball-end shaft device 154 and the forks 121 of the fork-type device 152 are rotated by a workpiece head spindle drive housing (not shown) where rotation of the workpiece head spindle housing rotates the splined ball-end hollow shaft device 154 which rotates the spherical ball splined receptacle device 168 which rotates the workpiece carrier plate 102.

The workpiece carrier plate 102 can be pulled upward by springs (not shown) which act against a bridge plate (not shown) that has an attached flexible lift wire 155 having a lift wire free end 159 that is attached to the bridge plate. The opposed end 207 of the flexible lift wire 155 is strung through an open through-hole in a cross-pin drive device (not shown) and through the open passageway 116 along the axial length of the hollow splined ball-end shaft device 154 and through an opening in the splined receptacle device 168 and is attached to the spherical splined receptacle device 168 at a position 204 that is located a small distance measured to the bottom surface of the workpiece carrier plate 102. Also, as an alternative, the opposed end 207 of the flexible lift wire 155 can be attached to the workpiece plate 102.

A workpiece carrier upper plate 161 is attached to the workpiece carrier plate 102 and the workpiece carrier upper plate 161 is also attached to a spherical bearing rotor (not shown). There are a number of different possible configurations of the attachment of the lift wire 155 to the workpiece plate 102 that will perform the same function as the described configuration.

Figure 11:
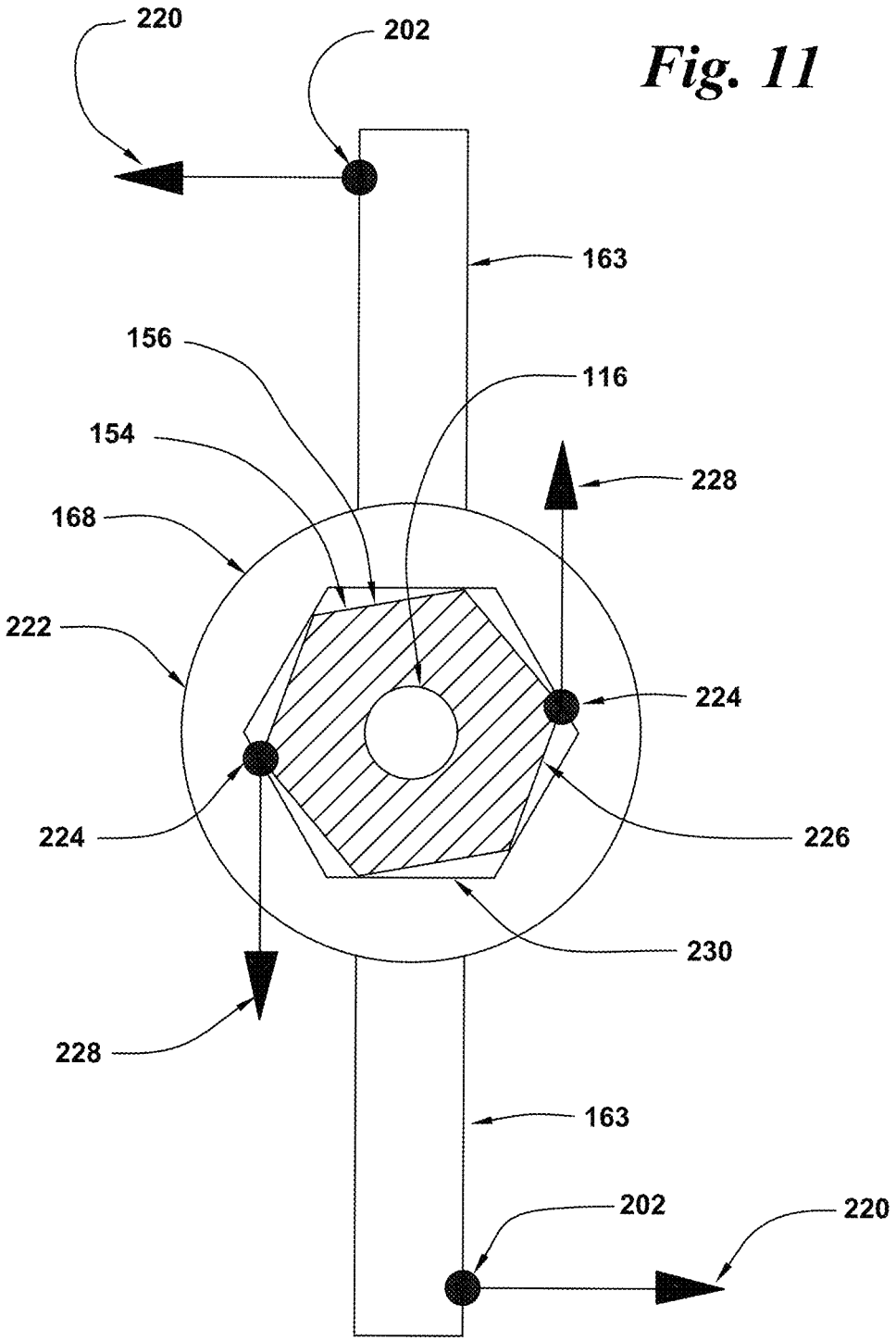
FIG. 11 is a cross section view of a spherical ball splined receptacle ball-end device.

FIG. 11 is a cross section view of a spherical ball splined receptacle device that is coupled with a splined ball-end hollow shaft device. A rotary workpiece carrier head (not shown) has a workpiece carrier plate (not shown) that is rotationally driven by a splined ball-end hollow shaft device 154 that has a shaft open passageway 116 along its axial length. The splined ball-end hollow shaft device 154 has a splined ball end 156 that floats freely in a carrier plate spherical ball splined receptacle device 168 that is shown with a hexagonal shape having flat surfaces 230. The splined ball end 156 also has a hexagonal shape with flat surfaces 226 where the splined ball end 156 rotates within the spherical ball splined receptacle device 168 where the splined ball end 156 engages the spherical ball splined receptacle device 168 at contact points 224. Torque forces 228 located at the receptacle device 168 contact points 224 transmit torque from the splined ball-end hollow shaft device 154 to the spherical ball splined receptacle device 168.

The receptacle device 168 is shown with rotational drive arms 163 that contact the workpiece carrier plate. The drive arms 163 can be flexible where each drive arm 163 would contact the workpiece plate at contact points 202. Torque forces 220 at the contact points 202 apply torque to the workpiece carrier plate. The configuration of the splined ball-end hollow shaft device 154 that applies rotational torque forces to the workpiece carrier plate illustrates a specific configuration that accomplishes this spherical-action torque-transfer function while many other embodiments can perform the same function.

Figure 12:
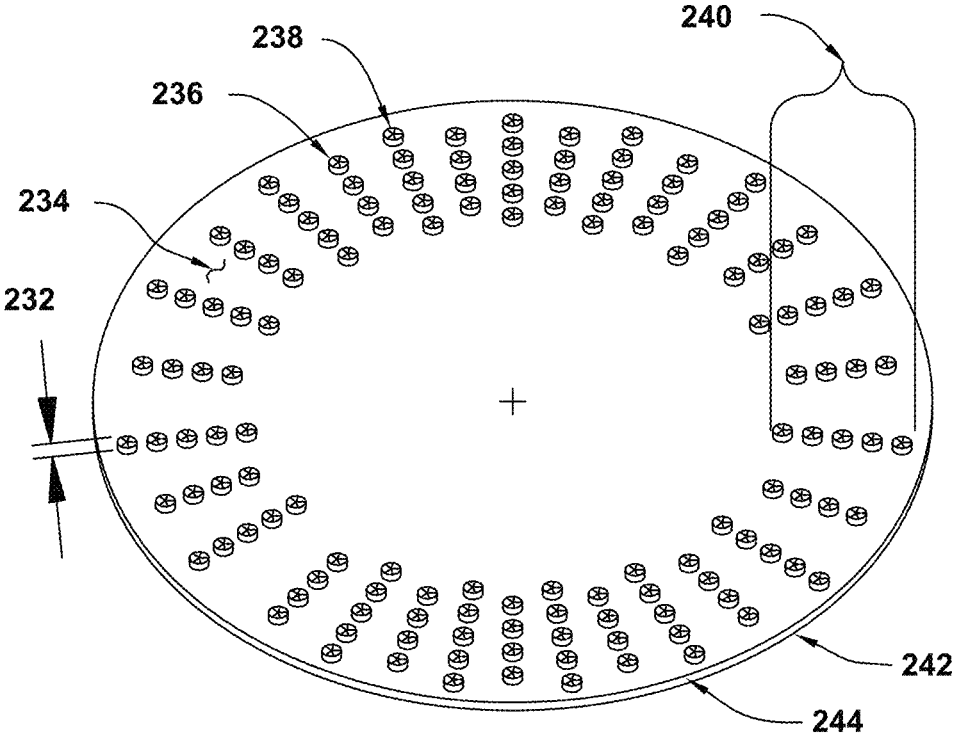
FIG. 12 is an isometric view of an abrasive disc with an annual band of raised islands.

FIG. 12 is an isometric view of an abrasive disc with an annual band of raised islands. A flexible abrasive disc 242 has attached raised island structures 236 that are top-coated with abrasive particles 238 where the island structures 236 are attached to a disc 242 transparent or non-transparent backing 244. The raised-island disc 242 has annular bands of abrasive-coated 238 raised islands 236 where the annular bands have a radial width of 240. Each island 236 has a typical width 232. The islands 236 can be circular as shown here or can have a variety of shapes including rectangular, oval, trapezoid, diamond, pie-shape or radial bars where the abrasive-coated 238 raised islands 236 allow the abrasive discs 242 to be used successfully at very high abrading speeds in the presence of coolant water without hydroplaning of the workpieces (not shown). There are channel gap openings 234 that exist on the abrasive disc 242 between the raised island structures 236. Circular shaped islands are preferred to avoid sharp edges of non-circular islands (not shown) where abrasive beads or particles have weak structural attachment to the islands and tend to break off the islands during abrading.

For high speed flat lapping or polishing, the abrasive disc 242 has an overall thickness variation, as measured from the top of the abrasive-coated 238 raised islands 236 to the bottom surface of the abrasive disc backing 244, that is typically less than 0.0001 inches 2.54 micron). This abrasive disc 242 precision surface flatness is necessary to provide an abrasive coating that is uniformly flat across the full annular band abrading surface of the abrasive disc 242 which allows the abrasive disc 242 to be used at very high abrading speeds of 10,000 surface feet (3,048 m) per minute or more. These high abrading speeds are desirable as the workpiece material removal rate is directly proportional to the abrading speeds.

Figure 13:
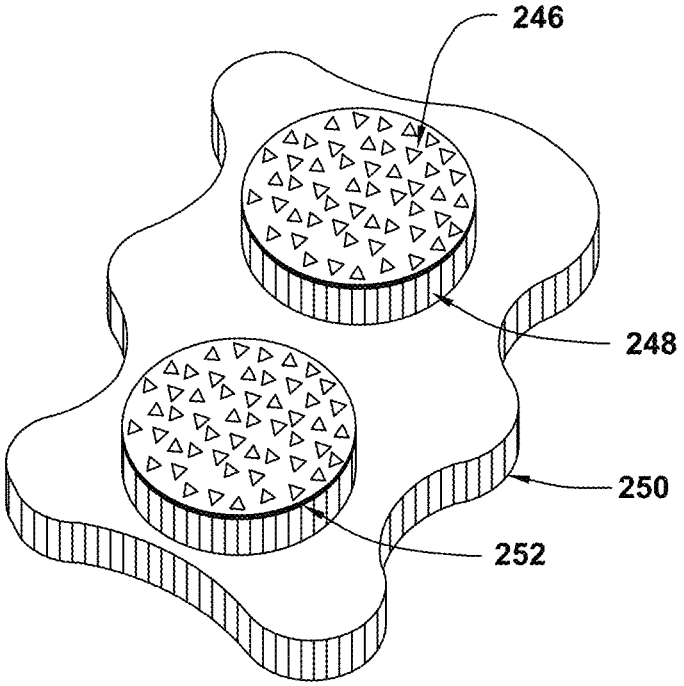
FIG. 13 is an isometric view of a portion of an abrasive disc with individual raised islands.

FIG. 13 is an isometric view of a portion of an abrasive disc with individual raised islands. A transparent or non-transparent backing sheet 250 has raised island structures 248 that are top-coated with a solidified abrasive-slurry layer mixture 252 which is filled with abrasive particles 246. The fixed-abrasive coating 252 on the raised islands 248 includes individual abrasive particles 246 or ceramic spherical beads (not shown) having bead diameters from 300 to 50 microns that are filled with very small diamond, cubic boron nitride (CBN), titanium carbide, silica, aluminum oxide or other material abrasive particles. The sizes of the abrasive particles 246 contained in the beads ranges from 200 microns to submicron sizes. The various sized abrasive particles are typically used to lap or polish LED wafers, sapphire wafers, semiconductor wafers and industrial workpieces.

Figure 14:
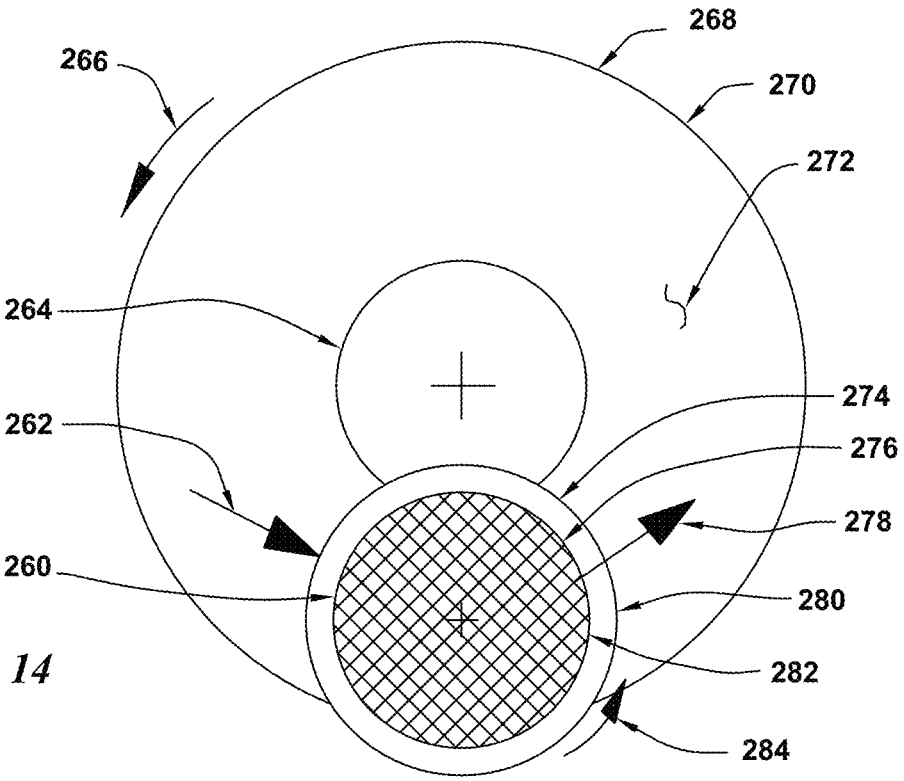
FIG. 14 is a top view of a workpiece carrier head with an abrasive coated rotary platen.

The FIG. 14 is a top view of a workpiece carrier head in abrading position with an abrasive coated rotary platen. The workpiece carrier head 258 having a workpiece carrier plate 280 and an abrasive 272 coated platen 268 is used for lapping or polishing semiconductor wafers or other workpiece substrates 276. A workpiece carrier plate 274 has a flat-surfaced workpiece 276 that is rotationally driven. An abrasive disc 270 that has an annular band of abrasive 272 having an inner abrasive periphery 264 is attached to a rotating platen 268. The workpiece 276 overhangs both the inner and outer radii of the annular band 272 of fixed abrasive to provide uniform wear-down of both the annular band 272 of fixed abrasive and the abraded surface of the workpiece 276.

The workpiece 276 is rotated in a rotation direction 284 that is the same as the platen 268 rotation direction 266 and the workpiece 276 and the platen 268 are typically rotated at approximately at the same rpm rotation speeds as the workpiece 276 is in flat-surfaced abrading contact with the annular band of abrasive 272 to provide uniform wear-down of both the annular band 272 of fixed abrasive and the abraded surface of the workpiece 276. The moving abrasive 272 applies an "upstream" abrading force 262 on the shown upstream side 260 of the workpiece 276 as the platen 268 is rotated. Likewise, a "downstream" abrading force 278 on the shown downstream side 282 of the workpiece 276 as the platen 268 is rotated. When the platen 268 has a precision-flat surface and the water cooled fixed-abrasive raised-island disc 270 has a precisely uniform thickness over the full annular abrasive surface 272, the platen 268 can be rotated at very high speeds to provide high speed material removal from the surface of the workpiece 276 without hydroplaning of the workpiece 276.

Figure 15:
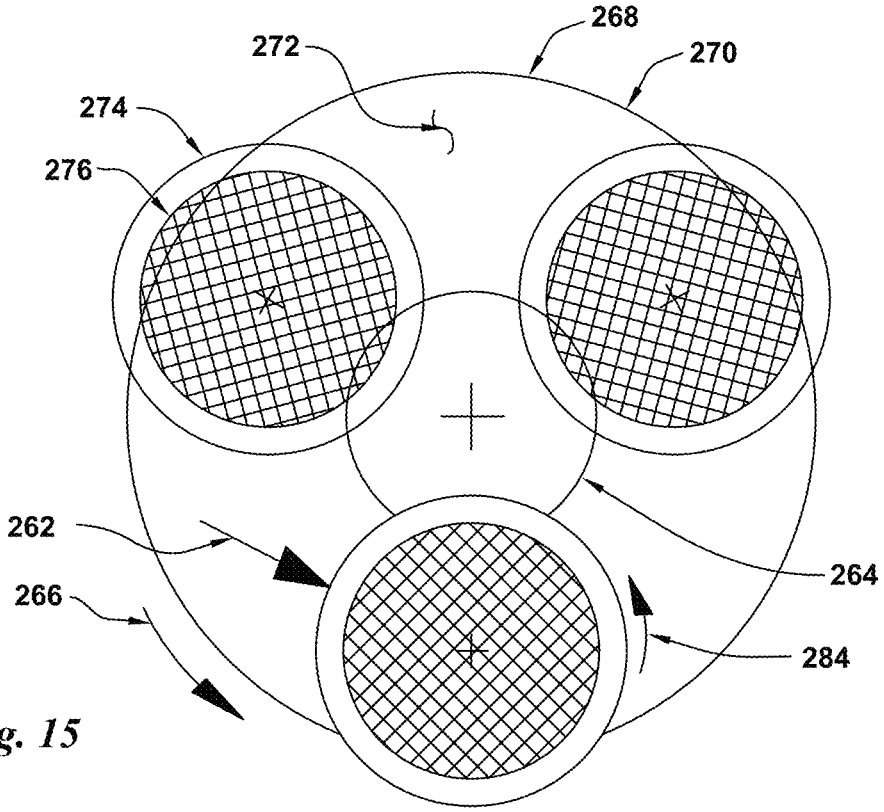
FIG. 15 is a top view of multiple workpiece carrier plates contacting an abrasive platen.

FIG. 15 is a top view of multiple workpiece carrier plates in contact with an abrasive coated platen. The multiple workpiece carrier plates 274 are used with an abrasive 272 coated platen 268 to provide simultaneous lapping or polishing multiple semiconductor wafers or other workpiece substrates 276. Three independent workpiece carriers (not shown) having rotationally driven workpiece carrier plates 274 with flat-surfaced workpieces 276 that are attached to the workpiece carriers 274 are spaced around a rotatable platen 268. An abrasive disc 270 that has an annular band of abrasive 272 having an inner abrasive periphery 264 is attached to the rotating platen 268. The outer periphery of the workpieces 276 overhang both the inner and outer radii of the annular band 272 of fixed abrasive to provide uniform wear-down of both the annular band 272 of fixed abrasive and the abraded surface of the workpieces 276.

The workpieces 276 are rotated in a rotation direction 284 that is the same as the platen 268 rotation direction 266 and the workpieces 276 and the platen 268 are typically rotated at approximately at the same rpm rotation speeds as the workpieces 276 are in flat-surfaced abrading contact with the annular band of abrasive 272 o provide uniform wear-down of both the annular band 272 of fixed abrasive and the abraded surfaces of the workpieces 276. The moving abrasive 272 applies an abrading force 262 on the shown upstream side of each of the workpieces 276 as the platen 268 is rotated. When the platen 268 has a precision-flat surface and the water cooled fixed-abrasive raised-island disc 270 has a precisely uniform thickness over the full annular abrasive surface 272, the platen 268 can be rotated at very high speeds to provide high speed material removal simultaneously from the surfaces of the workpieces 276 without hydroplaning of the workpieces 276.

Figure 16:
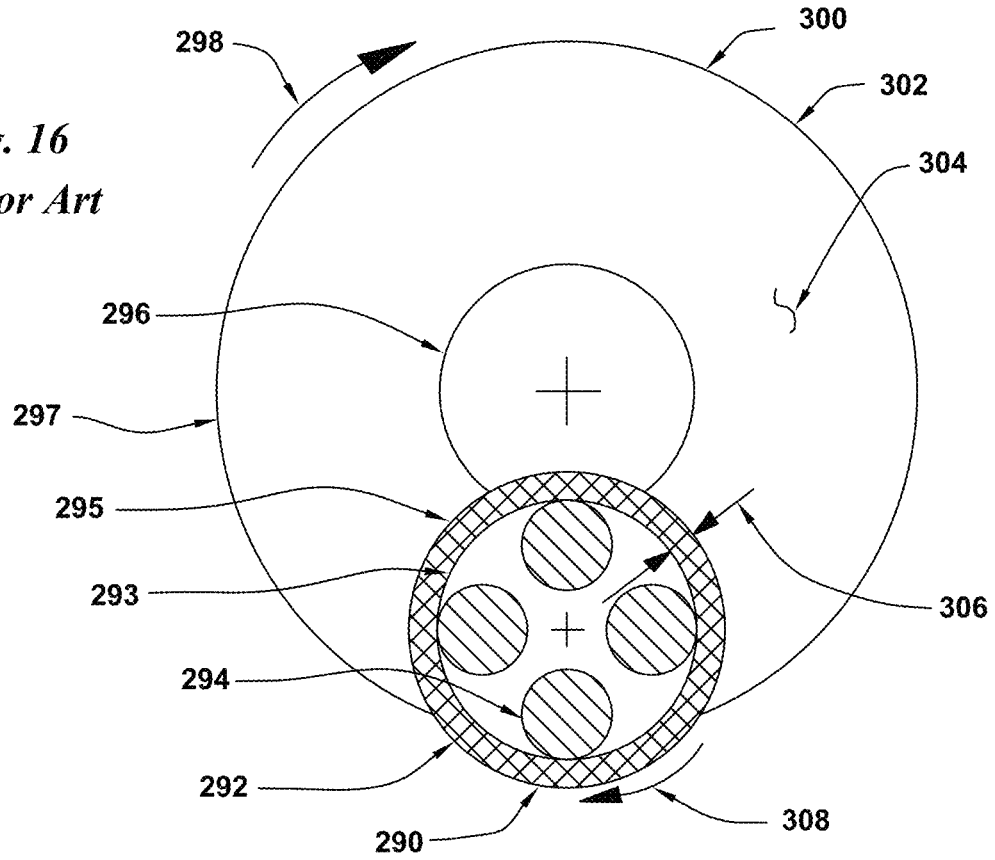
Fig. 16 Prior Art
FIG. 16 is a top view of a prior art abrasive conditioning ring used to abrade a slurry platen.

FIG. 16 is a top view of a prior art abrasive conditioning ring used to abrade-flat the abrasive surface of a rotary platen using a liquid abrasive slurry. An abrasive conditioning ring 290 having an annular abrading surface 292 is used to abrade-flat the abrading surface 304 of a rotatable platen 300. By applying a coating of a liquid abrasive slurry to the platen 300 abrading surface 304. The abrading surface 304 of the rotatable platen 300 typically requires periodic conditioning to maintain a precision flat abrasive surface 304 during long-abrading use of the liquid abrasive slurry coated surface 304 to provide precision flat abraded workpieces 294.

The abrasive conditioning ring 290 overhangs both the inner radius periphery 296 and the outer radius periphery 297 of the platen 300 annular band that is coated with a liquid abrasive slurry 304 to provide a uniform flat surface of the platen 300. The platen surface is progressively worn during abrasive lapping and polishing into a non-flat condition by the liquid abrasive slurry that is present between the workpieces 294 and the platen 300. Non-flat platen surfaces cause non-flat workpiece 294 surfaces. Abrading pressure on the abrasive conditioning ring 290 can be adjusted by adding weights to the abrasive conditioning ring 290.

The annular abrasive conditioning ring 290 has an inner radius 293 and an outer radius 295 and has a narrow radial width 306 that retains a uniform flat abrading 292 surface as the abrasive conditioning ring 290 uniformly abrades the whole abrading 304 surface of the platen 300. The abrasive conditioning ring 290 is constructed as an annular device having an annular band 292 with an annular width 306 where single or multiple workpieces 294 are positioned or trapped within the annular band of abrasive 292 and where the workpieces 294 are rotated by the abrasive conditioning ring 290 as it rotates.

The abrasive conditioning ring 290 is placed in flat-surfaced contact with the platen 300 liquid abrasive slurry coated surface 304 where the higher localized surface speed at the outer radial periphery 297 of the platen 300 compared to the lower surface speed at the inner radius periphery 296 of the platen 300 applies a sliding surface friction induced rotational torque that causes the abrasive conditioning ring 290 to be rotated in the same rotation direction 298 as the platen 300 rotational direction 308. The abrasive conditioning ring 290 is in flat-surfaced sliding contact with the platen 300 liquid abrasive slurry coated surface 304 where the rotation speed of the abrasive conditioning ring 290 does not have a rotational speed that is directly controlled or fixed relative to the rotational speed of the platen 300.

Figure 17:
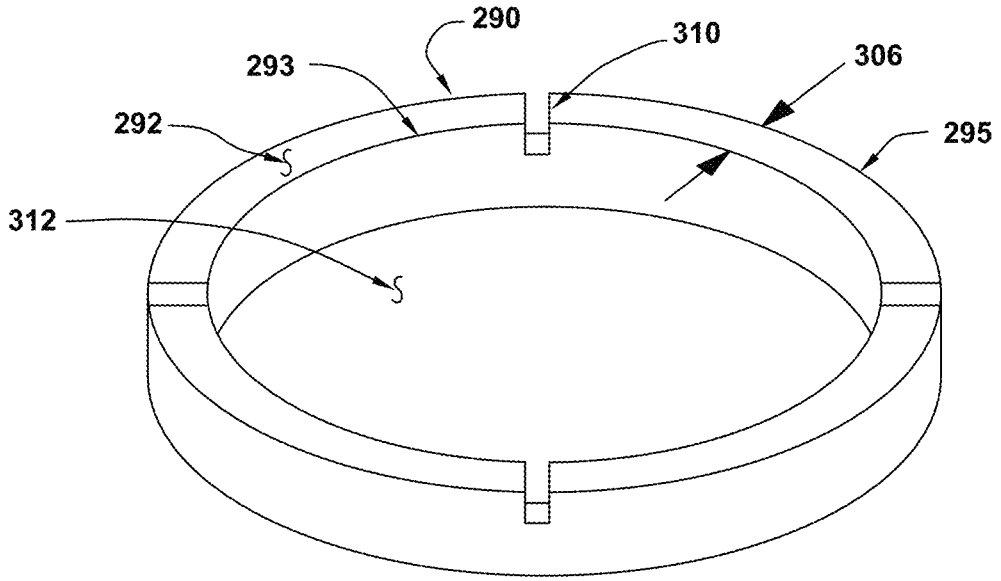
Fig. 17 Prior Art
FIG. 17 is an isometric view of a prior art abrasive conditioning ring annular band.

FIG. 17 is an isometric view of a prior art abrasive conditioning ring having an annular band that is used with a liquid abrasive slurry. The abrasive conditioning ring 290 can have an annular band of fixed abrasive 292 or the abrasive conditioning ring 290 can have a flat annular metal, ceramic or polymer surface 292 that has an annular radial width 306 with an open central area central area 312. The abrasive conditioning ring 290 has an inner radius 293 and an outer radius 295 and also typically has multiple slots 310 that allow liquid abrasive slurry (not shown) to enter the open central area central area 312 where it contacts the abraded surface of the workpieces (not shown) that are trapped within the open central area central area 312 during abrasive lapping or polishing.

FIG. 18 is a top view of an abrasive conditioning ring disc used to abrade-flat the abraded surface of an abrasive disc attached to a rotatable platen. An abrasive conditioning ring disc 322 is used to quickly and simply abrade-flat the abraded surface 332 of an abrasive disc 330 attached to a rotatable platen 328. The abrasive surface 332 of the abrasive disc 330 typically requires periodic conditioning to maintain a precision flat abrasive surface 332 during long-term abrading use of the abrasive disc 330 to provide precision flat abraded workpieces (not shown).

The abrasive conditioning ring disc 322 is attached to a rotatable workpiece carrier head (not shown) workpiece attachment surface (not shown). The abrasive disc 330 shown has an annular band of abrasive 332 having an inner abrasive periphery 324 and an outer periphery 323 and is attached to the rotatable platen 328. The abrasive conditioning ring disc 322 overhangs both the inner periphery 324 and the outer periphery 320 of the annular band of fixed abrasive 332 to provide a uniform flat surface of the annular band of fixed abrasive 332. The abrading pressure on the abrasive conditioning ring disc 322 can be adjusted during the abrading procedure by changing the pressure in the sealed pressure chamber in the rotatable workpiece carrier head.

The abrasive conditioning ring disc 322 is positioned in flat surfaced contact with the abrasive disc 330 abrasive surface 332 attached to the rotatable platen 328. The abrasive conditioning ring disc 322 is rotated in either a clockwise or counterclockwise rotation direction 336 and the platen 328 is rotated in either a clockwise or counterclockwise rotation direction 326 to quickly abrade flat the whole abrasive surface 332 of the abrasive disc 330 attached to the rotatable platen 328. The abrasive conditioning ring disc 322 has a narrow radial width 334 annular band of abrasive 320 that retains a uniform flat abrasive 320 surface as the abrasive conditioning ring disc 322 abrasive 320 uniformly abrades the whole abrasive 332 surface of the abrasive disc 330. The abrasive conditioning ring disc 322 can be constructed as an annular device having an annular band of abrasive 320 with an annular width 334. In another embodiment, the abrasive conditioning ring disc 322 can be constructed from a polymer, ceramic or metal backing having an annular band of abrasive 320 where the abrasive conditioning ring disc backing 335 provides a continuous surface that allows the abrasive conditioning ring disc 322 to be quickly attached with vacuum to a rotatable workpiece carrier head workpiece attachment surface (not shown).

FIG. 19 is a cross section view of an abrasive conditioning ring disc having an annular band of fixed abrasive. An abrasive conditioning ring disc 350 having an annular band 346 of fixed abrasive 342 that has an annular radial width 352 has a central area having a width 352 that is devoid of abrasive 342. The abrasive conditioning ring disc 350 has a rigid or flexible backing 354 that has a backing thickness 340 where the continuous backing 354 provides a vacuum seal used to quickly attach the conditioning ring disc 350 to a workpiece carrier head (not shown). The fixed abrasive 342 is bonded to the disc backing 354 with adhesives or metal plating 344.

Figure 20:
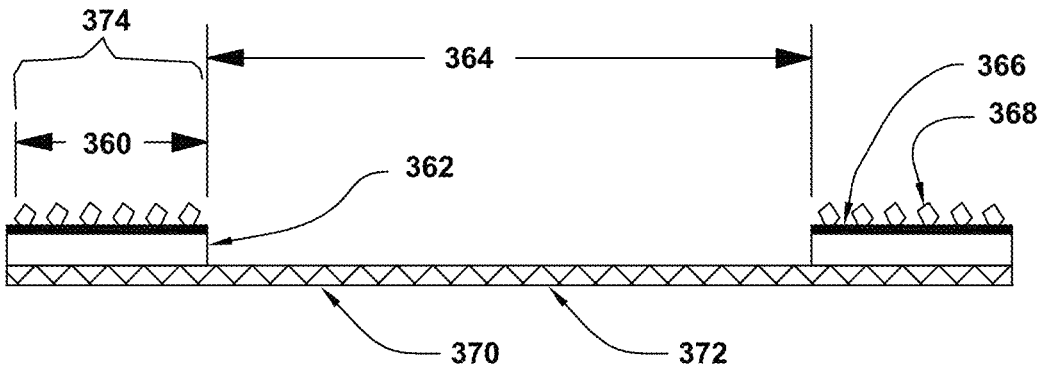
FIG. 20 is a cross section view of an abrasive conditioning ring disc abrasive annular band.

FIG. 20 is a cross section view of an abrasive conditioning ring disc having an annular band of fixed abrasive coated on an annular band attached to a rigid or flexible backing disc. A flexible or rigid abrasive conditioning ring disc 370 has a raised annular band 362 that has an annular band 374 of fixed abrasive 368 that has an annular radial width 360 with a disc 370 central area having a diameter width 364 that is devoid of abrasive 368. The abrasive conditioning ring disc 370 has a rigid or flexible backing 372 where the continuous backing 372 provides a vacuum seal used to quickly attach the conditioning ring disc 370 to a workpiece carrier head (not shown) with vacuum. The fixed abrasive 368 is bonded to the raised annular band 362 with adhesives or metal plating 366.

Figure 21:
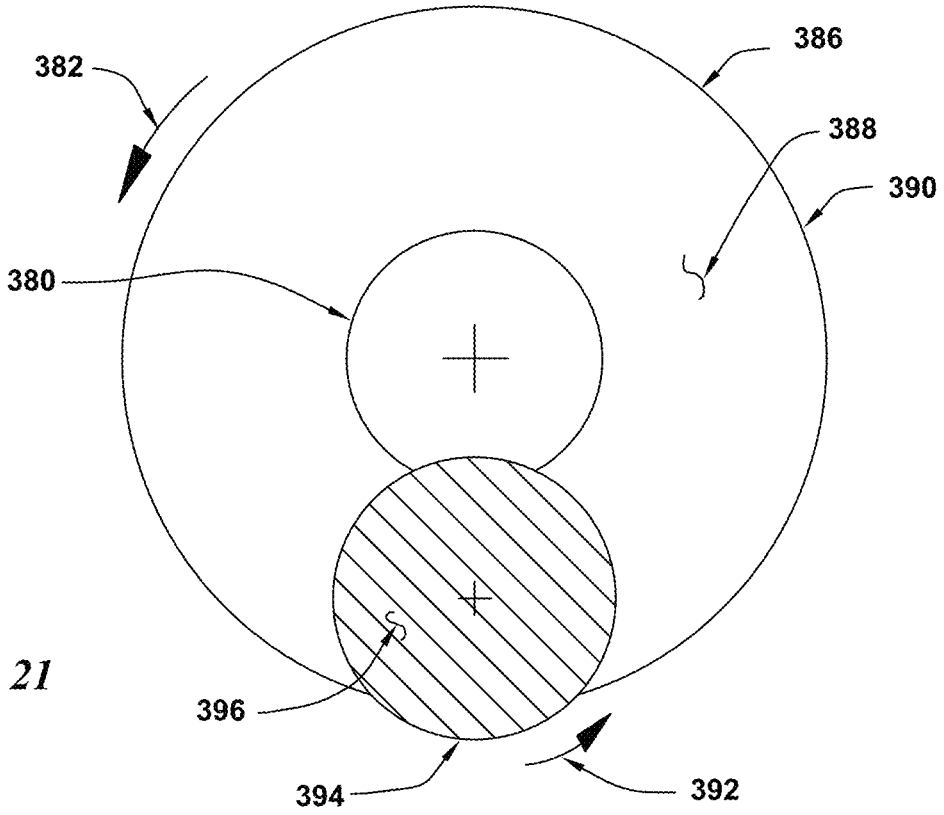
FIG. 21 is a top view of an abrasive coated platen used to flat-lap the wafer head.

FIG. 21 is a top view of an abrasive coated platen used to abrasively flat-lap the wafer attachment surface of a wafer head. The workpiece mounting surface 396 of a workpiece attachment plate 394 of a rotary wafer head (not shown) is placed in flat-surfaced abrading contact with an abrasive disc 386 attached to a rotatable platen 390. The rotary wafer head and workpiece attachment plate 394 is rotated in a direction 392 while the rotatable platen 390 is rotated in a direction 382 to provide a precision-flat workpiece mounting surface 396 of the rotary wafer head. A non-flat workpiece mounting surface 396 of the wafer head results in non-flat workpieces (not shown) that are attached to the wafer head during an abrasive lapping or polishing procedure.

Figure 22:
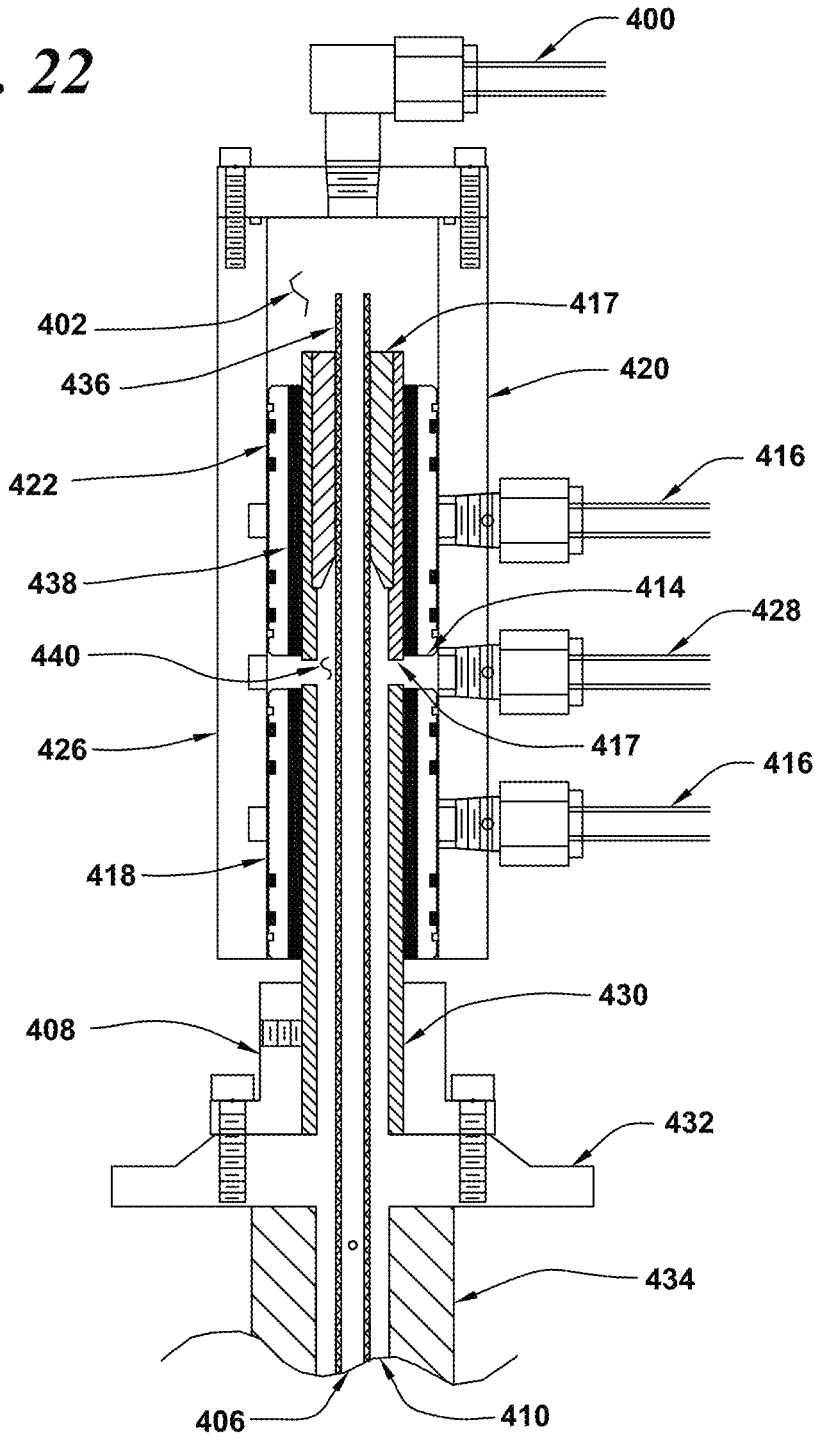
FIG. 22 is a cross section view of a high-speed rotary union that provides air and vacuum.

FIG. 22 is a cross section view of a high-speed rotary union that provides air pressure and vacuum to the workpiece carrier head. The friction-free non-contacting high speed multi-port fluid rotary union 426 can operate continuously at rotational speeds greater than 3,000 rpm and supply pressurized air and vacuum to a high-speed workpiece rotary head (not shown).

Air bearings 418, 422 are supplied with pressurized air by tube fittings 416 and are supported by an air bearing housing 420 which surround a precision-diameter hollow shaft 430 that is supported by a shaft mounting device 408 that is attached with a shaft mounting hub 432 attached to a rotary spindle shaft 434. A gap space 414 is present between the two axially mounted air bearings 418 and 422 to allow pressurized air supplied by the tubing 428 to enter radial port holes 417 in the hollow air bearing shaft 430 to transmit the controlled-pressure air through the annular passage 440 between the vacuum tube 436 and the hollow air bearing shaft 430 internal through-hole 410 to the high-speed workpiece rotary head. The abrading controlled-pressure air supplied by the tubing 428 forces a workpiece (not shown) that is attached to the workpiece rotary head against a flat-surfaced abrasive (not shown) coated platen (not shown) during an abrading operation.

The hollow shaft 430, the air bearings 418 and 422 and the air bearing housing 420 act together as a friction-free non-contacting high speed multi-port fluid rotary union 426. Vacuum can also be supplied by the tubing 428 to enter radial port holes 417 in the hollow air bearing shaft 430 to transmit the vacuum through the annular passage between the vacuum tube 436 and the hollow air bearing shaft 430 internal through-hole 410 to lift the workpiece attached to the high-speed workpiece rotary head away from contact with the platen abrasive. An annular seal device 417 provides a fluid seal between the vacuum tube 436 and the hollow air bearing shaft 430. The air bearings 418 and 422 have porous carbon liners 438 that allow the air bearings 418 and 422 to be operated at low speeds with no damage when no air pressure is supplied by the tubes 416.

Vacuum supplied by the tubing 400 enters a chamber 402 and enters the tube 436 where it exits the tube 436 at position 406 to provide vacuum which attaches a workpiece to the high-speed workpiece rotary head. Air or fluid pressure supplied by the tubing 400 enters a chamber 402 and enters the tube 436 where it exits the tube 436 at position 406 to provide pressure which separates an attached workpiece from the high-speed workpiece rotary head.

The rotatable workpiece carrier head abrasive lapping and polishing apparatus and processes to use it are described here. A rotatable floating workpiece carrier head abrasive lapping and polishing apparatus comprising:

a) a drive housing having an outside closed curve shape, an outside closed curve shaped surface, a drive housing weight, an outside closed curve shape size, a drive housing first end, a drive housing second end, wherein the outside closed curve shape extends uniformly from the drive housing first end to the drive housing second end, a drive housing vertical rotation axis located at the center of the drive housing outside closed curve shape wherein the drive housing vertical rotation axis extends from the drive housing first end to the drive housing second end and a drive housing internal opening extending from the drive housing first end to the drive housing second end wherein the drive housing outside closed curve shaped surface extends from the drive housing first end to the drive housing second end and wherein the drive housing first end is attached to a rotatable drive spindle;

b) a slide housing having an inside closed curve shape, an inside closed curve shaped surface, an inside closed curve shape size, a slide housing first end, a slide housing second end and a slide housing weight;

c) wherein the slide housing inside closed curve shape is the same as the drive housing outside closed curve shape wherein the slide housing inside closed curve shape size is nominally greater than the drive housing outside closed curve shape size and wherein the slide housing is positioned concentrically with the drive housing wherein the slide housing inside closed curve shaped surface is in slidable contact with the drive housing outside closed curve shaped surface wherein the slide housing first end is located approximately at the drive housing first end and wherein a housing slidable contact area is formed between the slide housing inside closed curve shaped surface and the contacting concentric drive housing outside closed curve shaped surface;

d) and wherein the slide housing is slidable relative to the drive housing along the drive housing vertical rotation axis and wherein a fluid pressure seal exists between the slide housing inside closed curve shaped surface and the drive housing outside closed curve shaped surface;

e) and wherein the slide housing second end has a slide housing spherical bearing concave surface having a slide housing spherical bearing concave surface spherical diameter and a slide housing spherical bearing concave surface spherical center of rotation; f) a pivot rotor having a pivot rotor first end and a pivot rotor second end and a pivot rotor weight wherein the pivot rotor second end has a pivot rotor spherical bearing convex surface having a pivot rotor spherical bearing convex surface spherical diameter and a pivot rotor spherical bearing convex surface spherical center of rotation and wherein the pivot rotor spherical bearing convex surface spherical diameter is equal to the slide housing spherical bearing concave surface spherical diameter;

g) wherein the pivot rotor is positioned wherein the pivot rotor spherical bearing convex surface spherical center of rotation is coincident with the spherical bearing housing spherical bearing concave surface spherical center of rotation wherein the pivot rotor spherical bearing convex surface is in slidable contact with the slide housing spherical bearing concave surface and wherein a fluid pressure seal is formed between the pivot rotor spherical bearing convex surface and the slide housing spherical bearing concave surface;

h) a rotatable workpiece carrier plate having a workpiece carrier plate first end and a workpiece carrier plate second end and a workpiece carrier plate weight wherein the workpiece carrier plate first end is attached to the pivot rotor second end and wherein the workpiece carrier plate second end has a workpiece attachment surface and wherein the workpiece carrier plate has a drive spline spherical ball socket and wherein the spherical center of rotation of the pivot rotor is located a spherical rotation center offset distance measured from the pivot rotor spherical center of rotation to the workpiece carrier plate flat workpiece attachment surface;

i) wherein spherical rotation motion of the pivot rotor relative to the spherical bearing housing allows the workpiece carrier plate attached to the pivot rotor to be tilted relative to the drive housing vertical rotation axis;

j) a workpiece carrier plate vertical drive shaft having a vertical drive shaft first end and a vertical drive shaft second end wherein the vertical drive shaft first end is rotationally and slidably attached to the drive housing and the vertical drive shaft second end has a drive spline spherical ball end having a drive spline spherical ball end spherical rotation center wherein the drive spline spherical ball end rotationally and slidably engages the workpiece carrier plate drive spline spherical ball socket wherein rotation of the drive housing around the drive housing vertical rotation axis rotates the vertical drive shaft wherein rotation of the vertical drive shaft rotates the workpiece carrier plate around the drive housing vertical rotation axis;

k) wherein the vertical drive shaft first end remains rotationally and slidably attached with the drive housing and the vertical drive shaft second end drive spline spherical ball end remains rotationally and slidably engaged with the workpiece carrier plate drive spline spherical ball socket when the slide housing is moved relative to the drive housing along the drive housing vertical rotation axis and wherein the drive shaft spline spherical ball maintains rotational and slidable engagement with the workpiece carrier plate drive spline spherical ball socket when the workpiece carrier plate is tilted;

l) wherein a fluid pressure sealed pressure chamber located in the drive housing internal opening is formed by; the drive housing, the slide housing, the pivot rotor, the fluid pressure seal formed between the pivot rotor spherical bearing convex surface and the slide housing spherical bearing concave surface, and the rotatable drive spindle and wherein fluid passageways in the rotatable drive spindle are fluid coupled to the fluid pressure sealed pressure chamber.

Another variation of the apparatus where the drive housing transmits rotational torque to the vertical drive shaft that transmits the rotational torque to the workpiece carrier plate and wherein the workpiece carrier plate is rotationally coupled to the drive housing.

A further variation is where at least one weight counteracting rotor spring having a weight counteracting rotor spring first end and a weight counteracting rotor spring second end wherein the weight counteracting rotor spring first end is attached to the drive housing and the weight counteracting rotor spring second end is attached to the pivot rotor wherein the at least one weight counteracting rotor spring counteracts the weights of the pivot rotor, the slide housing and the workpiece carrier plate and wherein the at least one rotor spring urges the pivot rotor spherical slide bearing convex surface against the spherical bearing housing spherical slide bearing concave surface wherein the pivot rotor spherical slide bearing convex surface maintains contact with the spherical bearing housing spherical slide bearing concave surface.

A process is described to counteract the weights of the slide housing, the pivot rotor and the workpiece carrier plate by applying vacuum to the fluid pressure fluid pressure sealed pressure chamber wherein the fluid pressure sealed pressure chamber vacuum acts on the slide housing and the pivot rotor and creates a vertical upward lifting force that counteracts the weights of the slide housing, the pivot rotor and the workpiece carrier plate.

A further variation of the apparatus is where at least one rigid abrading device having a first end and a second end wherein the at least one rigid abrading device second end is positioned in conformal contact with the workpiece carrier plate first end and wherein the rigid abrading device first end is attached to the slide housing wherein spherical rotation of the workpiece carrier plate is prevented and wherein tilting of the workpiece carrier plate is prevented.

A further variation of the apparatus is where at least one rigid abrading device having a first end and a second end wherein the at least one rigid abrading device second end is positioned in conformal contact with the workpiece carrier plate first end and wherein the at least one rigid abrading device first end is attached to the slide housing.

Another process is described for using the apparatus in a rigid abrading mode compromising:

a) providing a rigid abrading device having a first end and a second end wherein the rigid abrading device first end is loosely attached to the slide housing;
b) providing a rotatable platen having a platen flat surface wherein the platen flat surface is aligned perpendicular to the drive housing vertical rotation axis;
c) moving the slide housing vertically wherein the workpiece carrier plate workpiece attachment surface is positioned in conformal contact with the platen flat surface;
d) moving the rigid abrading device second end in conformal contact with the workpiece carrier plate first end and rigidly attaching the rigid abrading device first end to the slide housing;
e) moving the slide housing vertically upward wherein the workpiece carrier plate workpiece attachment surface moves away from the platen flat surface;
f) providing at least one workpiece having a workpiece top surface and a workpiece bottom surface wherein the at least one workpiece top surface is attached to the workpiece carrier plate second end workpiece attachment surface;
g) attaching abrasive to the platen flat surface, moving the slide housing and the attached at least one workpiece vertically downward wherein the at least one workpiece bottom surface is in abradable contact with the abrasive on the platen flat surface;
h) wherein rotation of the rotatable platen and rotation of the workpiece carrier plate to abrade the at least one workpiece bottom surface whereby the at least one abraded workpiece bottom surface is perpendicular to the drive housing vertical rotation axis.

Further, another process is used to abrade the at least one workpiece top surface using the rigid abrading device wherein after the at least one workpiece bottom surface of the at least one workpiece is abraded compromising:

a) separating the at least one workpiece from the workpiece carrier plate workpiece attachment surface;
b) attaching the at least one workpiece abraded workpiece bottom surface to the workpiece carrier plate second end workpiece attachment surface;
c) moving the slide housing, the workpiece carrier plate and the attached at least one workpiece vertically wherein the at least one workpiece top surface is in abradable contact with the abrasive on the platen flat surface;
d) and rotating the rotatable platen and rotating the workpiece carrier plate having the attached at least one workpiece to abrade the at least one workpiece top surface whereby the at least one workpiece top surface is perpendicular to the drive housing vertical rotation axis and the at least one workpiece top and bottom surfaces are parallel.

A further variation of the apparatus is where the slidable spherical surface contact of the pivot rotor pivot rotor spherical slide bearing convex surface with the spherical bearing housing spherical slide bearing concave surface restrains the workpiece carrier plate in radial directions that are nominally-perpendicular to the drive housing vertical rotation axis.

Another variation of the apparatus is where the workpiece carrier plate vertical drive shaft drive spline spherical ball end spherical rotation center is located a drive shaft ball center 10. The apparatus of claim 9 wherein the drive shaft ball center offset distance is less than 0.5 inches.

Also, the apparatus can be configured where the pivot rotor spherical rotation center offset distance measured from the pivot rotor spherical center of rotation to the workpiece carrier plate workpiece attachment surface is less than 2.0 inches, or less than 1.0 inch or less than 0.5 inches.

Another configuration is where a counteracting housing spring having a first housing spring end attached to the drive housing and a second housing spring end attached to the slide housing counteracts the weight of the slide housing.

And in a further embodiment, the vertical drive shaft is hollow and wherein a flexible lift wire having a lift wire first end and a lift wire second end is routed through the hollow opening in the vertical drive shaft wherein the flexible lift wire first end is attached to a lift spring second end wherein the lift spring first end is attached to the drive housing and wherein the flexible lift wire second end is attached to the workpiece carrier plate.

Also, where the flexible lift wire second end is attached to the workpiece carrier plate at a flexible lift wire second end attachment-point wherein the flexible lift wire second end attachment-point to the workpiece carrier plate is located at a wire attachment distance less than 1.0 inches from the workpiece carrier plate second end workpiece attachment surface and where the wire attachment distance is less than 0.5 inches from the workpiece carrier plate second end workpiece attachment surface. Also, where the flexible lift wire comprises at least one strand of flexible materials selected from the group consisting of: metals, polymers, organic materials, and inorganic materials and combinations thereof.

And, another embodiment is where at least one workpiece having a workpiece top surface and a workpiece bottom surface and an at least one workpiece weight wherein the at least one workpiece top surface is attached to the workpiece carrier plate second end workpiece attachment surface.

Further, a process is described for abrading the at least one workpiece by providing a rotatable platen having a platen flat surface wherein the platen flat surface is aligned perpendicular to the drive housing vertical rotation axis, attaching abrasive to the platen flat surface, moving the slide housing and the attached at least one workpiece vertically downward wherein the at least one workpiece bottom surface is in abradable contact with the abrasive on the platen flat surface and rotating the rotatable platen and rotating the workpiece carrier plate to abrade the at least one workpiece bottom surface.

Another embodiment is where the abrasive attached to the platen flat surface is a flexible abrasive disc having an annular band of abrasive particles or abrasive beads filled with abrasive particles wherein the flexible abrasive disc is attached to the platen flat surface with vacuum.

A further embodiment is where lifting the at least one workpiece from abrading contact with the platen flat surface abrasive by counteracting the weights of the slide housing, the pivot rotor, the workpiece carrier plate and the at least one workpiece by applying vacuum to the fluid pressure sealed pressure chamber wherein the fluid pressure sealed pressure chamber vacuum acts on the slide housing and the pivot rotor and creates a vertical upward lifting force that lifts the at least one workpiece attached to the workpiece carrier plate upward away from abrading contact with the abrasive on the platen flat surface.

Another process is described of providing a uniform abrading pressure on the at least one workpiece abraded surfaces wherein fluid pressure applied to the fluid pressure sealed pressure chamber acts on the slide housing and the pivot rotor and creates an abrading pressure that is transmitted uniformly across the at least one workpiece bottom surface in abradable contact with the abrasive on the platen flat surface.

A process is described where the platen flat surface has vacuum port holes in the platen flat surface wherein fluid passageways in the rotatable drive spindle supplies vacuum to the platen flat surface vacuum port holes wherein a flexible abrasive disc is attached with vacuum to the platen flat surface and fluid passageways in the rotatable drive spindle supplies fluid pressure to the vacuum port holes wherein the flexible abrasive disc is separated from the platen flat surface by the fluid pressure supplied to the platen flat surface vacuum port holes.

Another embodiment is where a flexible tube having a flexible tube first end and a flexible tube second end wherein the flexible tube first end is fluid coupled to a fluid passageway in the rotatable drive spindle and the flexible tube second end is fluid coupled to a pivot rotor fluid passageway extending from the pivot rotor first end to the pivot rotor second end and wherein the pivot rotor fluid passageway at the pivot rotor second end is fluid coupled to fluid port holes in the workpiece carrier plate workpiece attachment surface.

A process is described for using the apparatus to abrade at least one workpiece by supplying vacuum to a fluid passageway in the rotatable drive spindle that is fluid coupled to the flexible tube first end that is fluid coupled to fluid port holes in the workpiece carrier plate workpiece attachment surface to attach at least one workpiece top surface with vacuum to the workpiece carrier plate workpiece attachment surface, providing a rotatable platen having a platen flat surface wherein the platen flat surface is aligned perpendicular to the drive housing vertical rotation axis, attaching abrasive to the platen flat surface, moving slide housing, the workpiece carrier plate and the attached at least one workpiece vertically wherein the at least one workpiece bottom surface is in abradable contact with the abrasive on the platen flat surface and rotating the rotatable platen and rotating the workpiece carrier plate to abrade the at least one workpiece bottom surface.

A further process described to abrade the at least one workpiece is by applying a fluid pressure to the fluid pressure sealed pressure chamber and rotating the rotatable platen and rotating the workpiece carrier plate having the attached at least one workpiece to abrade the at least one workpiece bottom surface.

And another process of providing a uniform abrading pressure on the at least one workpiece abraded surface is where fluid pressure is applied to the fluid pressure sealed pressure chamber wherein the fluid pressure sealed pressure chamber fluid pressure acts on the slide housing and the pivot rotor and creates an abrading pressure that is transmitted uniformly across the at least one workpiece bottom surface in abradable contact with the abrasive surface on the platen flat surface.

Another process is described of separating the at least one workpiece from the workpiece carrier plate workpiece attachment surface after abrading the at least one workpiece by supplying pressurized fluid to the flexible tube first end fluid coupled to the fluid passageways in the workpiece carrier plate thereby applying a fluid force that acts against the at least one workpiece top surface.

Another embodiment of the apparatus is where an abrasive disc is attached to the workpiece carrier plate workpiece attachment surface and an abrasive conditioning ring disc having an annular band of abrasive is attached to the workpiece carrier plate workpiece attachment surface.

A process is described of using the apparatus to abrade flat the abrasive surface of an abrasive attached to a rotatable platen flat surface comprising:

a) providing an abrasive conditioning ring disc having a first end and a second end wherein the conditioning ring disc first end is attached to the workpiece carrier plate second end workpiece attachment surface and wherein the abrasive conditioning ring disc second end has an annular band of abrasive;

b) providing a rotatable platen having a platen flat surface wherein the platen flat surface is aligned perpendicular to the drive housing vertical rotation axis;

c) attaching abrasive to the platen flat surface, moving the slide housing and the attached abrasive conditioning ring disc vertically wherein the attached abrasive conditioning ring disc annular band of abrasive is in conformal contact with the abrasive on the platen flat surface;

d) rotating the rotatable platen and rotating the workpiece carrier plate wherein the abrasive conditioning ring disc annular band of abrasive abrades flat the surface of the abrasive attached to the platen flat surface.

A process is described where fluid pressure applied to the fluid pressure sealed pressure chamber acts upon the slide housing and the pivot rotor thereby urging the slide housing vertically downward and wherein vacuum applied to the fluid pressure sealed pressure chamber acts upon the slide housing and the pivot rotor thereby urging the slide housing vertically upward.

Another process is described for using the apparatus to abrade flat the abrasive surface of an abrasive disc comprising:

a) providing an abrasive conditioning ring disc having a first end and a second end wherein the conditioning ring disc first end is attached to the workpiece carrier plate second end workpiece attachment surface and wherein the abrasive conditioning ring disc second end has an annular band of abrasive;

b) providing a rotatable platen having a platen flat surface wherein the platen flat surface is aligned perpendicular to the drive housing vertical rotation axis;

c) attaching an abrasive disc having a surface coat of abrasive to the platen flat surface, moving the slide housing and the attached abrasive conditioning ring disc vertically wherein the attached abrasive conditioning ring disc annular band of abrasive is in conformal contact with the surface coat of abrasive on the abrasive disc attached to the platen flat surface;

d) rotating the rotatable platen and rotating the workpiece carrier plate wherein the abrasive conditioning ring disc annular band of abrasive abrades flat the surface coat of abrasive on the abrasive disc attached to the rotatable platen flat surface.

A process is described for using the apparatus to abrade flat the workpiece carrier plate second end workpiece attachment surface comprising:

a) providing a rotatable platen having a platen flat surface wherein the platen flat surface is aligned perpendicular to the drive housing vertical rotation axis;

b) attaching abrasive to the platen flat surface, moving the slide housing and the workpiece carrier plate vertically downward wherein the workpiece carrier plate second end workpiece attachment surface is in conformal contact with the abrasive on the rotatable platen flat surface;

c) rotating the rotatable platen and rotating the workpiece carrier plate wherein the abrasive attached to the surface of the platen flat surface abrades the workpiece carrier plate second end workpiece attachment surface.

Further, another embodiment of the apparatus is where the slide housing spherical bearing concave surface has a low friction coating and/or where the pivot rotor slide bearing convex surface has a low friction coating and where a lubricant is applied to the spherical bearing spherical shaped contact area between the slide housing spherical bearing concave surface and the pivot rotor slide bearing convex surface.

Also, another embodiment of the apparatus is where a lubricant is applied to the housing slidable contact area formed between the slide housing inside closed curve shaped surface and the contacting concentric drive housing outside closed curve shaped surface and where the lubricant forms a fluid pressure seal between the slide housing inside closed curve shaped surface and the contacting concentric drive housing outside closed curve shaped surface.

In addition, a process for using the apparatus is described where fluid pressure applied to the fluid pressure sealed pressure chamber acts upon the slide housing and the pivot rotor thereby urging the slide housing vertically downward and wherein vacuum applied to the fluid pressure sealed pressure chamber acts upon the slide housing and the pivot rotor thereby urging the slide housing vertically upward.

Another embodiment of a roller bearing rotatable floating workpiece carrier head abrasive lapping and polishing apparatus is described comprising:

a) a drive housing having an outside closed curve shape, an outside closed curve shaped surface, a drive housing weight, an outside closed curve shape size, a drive housing first end, a drive housing second end, wherein the outside closed curve shape extends uniformly from the drive housing first end to the drive housing second end, a drive housing vertical rotation axis located at the center of the drive housing outside closed curve shape wherein the drive housing vertical rotation axis extends from the drive housing first end to the drive housing second end and a drive housing internal opening extending from the drive housing first end to the drive housing second end wherein the drive housing outside closed curve shaped surface extends from the drive housing first end to the drive housing second end and wherein the drive housing first end is attached to a rotatable drive spindle;

b) a slide housing having an inside closed curve shape, an inside closed curve shaped surface, an inside closed curve shape size, a slide housing first end, a slide housing second end and a slide housing weight;

c) wherein the slide housing inside closed curve shape is the same as the drive housing outside closed curve shape wherein the slide housing inside closed curve shape size is nominally greater than the drive housing outside closed curve shape size and wherein the slide housing is positioned concentrically with the drive housing wherein the slide housing inside closed curve shaped surface is in slidable contact with the drive housing outside closed curve shaped surface wherein the slide housing first end is located approximately at the drive housing first end and wherein a housing slidable contact area is formed between the slide housing inside closed curve shaped surface and the contacting concentric drive housing outside closed curve shaped surface;

d) and wherein the slide housing is slidable relative to the drive housing along the drive housing vertical rotation axis and wherein a fluid pressure seal exists between the slide housing inside closed curve shaped surface and the drive housing outside closed curve shaped surface;

e) and wherein the slide housing second end has an integral spherical bearing housing spherical slide bearing concave surface or has an attached spherical bearing housing spherical slide bearing concave surface device wherein the spherical bearing housing spherical slide bearing concave surface has a spherical bearing housing spherical diameter and a spherical bearing housing spherical center of rotation;

f) a pivot rotor having a pivot rotor first end and a pivot rotor second end and a pivot rotor weight wherein a portion of the pivot rotor has a pivot rotor spherical bearing convex surface having a pivot rotor spherical diameter and a pivot rotor spherical center of rotation and wherein the pivot rotor spherical diameter is smaller than the spherical bearing housing spherical diameter;

g) wherein the pivot rotor is positioned wherein the pivot rotor spherical center of rotation is coincident with the spherical bearing housing spherical center of rotation and wherein roller bearings are positioned between the pivot rotor convex spherical surface and the spherical bearing housing concave spherical surface and wherein a spherical bearing pressure seal device is positioned between the pivot rotor convex spherical surface and the spherical bearing housing concave spherical surface;

h) wherein the pivot rotor spherical bearing convex surface is in rotatable contact with the spherical bearing housing spherical bearing concave surface;

i) a rotatable workpiece carrier plate having a workpiece carrier plate first end and a workpiece carrier plate second end and a workpiece carrier plate weight wherein the workpiece carrier plate first end is attached to the pivot rotor second end and wherein the workpiece carrier plate second end has a workpiece attachment surface and wherein the workpiece carrier plate has a drive spline spherical ball socket and wherein the spherical center of rotation of the pivot rotor is located a spherical rotation center offset distance measured from the pivot rotor spherical center of rotation to the workpiece carrier plate flat workpiece attachment surface;

j) wherein spherical rotation motion of the pivot rotor relative to the spherical bearing housing allows the workpiece carrier plate attached to the pivot rotor to be tilted relative to the drive housing vertical rotation axis;

k) a workpiece carrier plate vertical drive shaft having a vertical drive shaft first end and a vertical drive shaft second end wherein the vertical drive shaft first end is rotationally and slidably attached to the drive housing and the vertical drive shaft second end has a drive spline spherical ball end having a drive spline spherical ball end spherical rotation center wherein the drive spline spherical ball end rotationally and slidably engages the workpiece carrier plate drive spline spherical ball socket wherein rotation of the drive housing around the drive housing vertical rotation axis rotates the vertical drive shaft wherein rotation of the vertical drive shaft rotates the workpiece carrier plate around the drive housing vertical rotation axis;

l) wherein the vertical drive shaft first end remains rotationally and slidably attached with the drive housing and the vertical drive shaft second end drive spline spherical ball end remains rotationally and slidably engaged with the workpiece carrier plate drive spline spherical ball socket when the slide housing is moved relative to the drive housing along the drive housing vertical rotation axis and wherein the drive shaft spline spherical ball maintains rotational and slidable engagement with the workpiece carrier plate drive spline spherical ball socket when the workpiece carrier plate is tilted;

m) wherein a fluid pressure sealed pressure chamber located in the drive housing internal opening is formed by the drive housing, the slide housing, the pivot rotor, the spherical bearing pressure seal device and the rotatable drive spindle and wherein fluid passageways in the rotatable drive spindle are fluid coupled to the fluid pressure sealed pressure chamber;

n) wherein fluid pressure applied to the fluid pressure sealed pressure chamber acts upon the slide housing, the spherical bearing pressure seal device and the pivot rotor thereby urging the slide housing vertically downward and wherein vacuum applied to the fluid pressure sealed pressure chamber acts upon the slide housing and the pivot rotor thereby urging the slide housing vertically upward.

The methods and systems of the present disclosure, as described above and shown in the drawings, among other things, provide for improved methods and systems in the art. It will be apparent to those skilled in the art that various modifications and variations can be made in the devices and methods of the present disclosure without departing from the spirit or scope of the disclosure. Thus, it is intended that the present disclosure include modifications and variations that are within the scope of the subject disclosure and equivalents. Additionally, to the extent not already incorporated, each and every patent and patent application referenced herein is incorporated by reference herein in its entirety.

What is claimed:

1. A rotatable floating workpiece carrier head abrasive lapping and polishing apparatus comprising:

a) a drive housing having an outside closed curve shape, an outside closed curve shaped surface, a drive housing weight, a drive housing outside closed curve shape size, a drive housing first end, a drive housing second end, wherein the outside closed curve shape extends uniformly from the drive housing first end to the drive housing second end, a drive housing vertical rotation axis located at a center of the drive housing outside closed curve shape wherein the drive housing vertical rotation axis extends from the drive housing first end to the drive housing second end and a drive housing internal opening extending from the drive housing first end to the drive housing second end wherein the drive housing outside closed curve shaped surface extends from the drive housing first end to the drive housing second end and wherein the drive housing first end is attached to a rotatable drive spindle;

b) a slide housing having an inside closed curve shape, an inside closed curve shaped surface, an inside closed curve shape size, a slide housing first end, a slide housing second end and a slide housing weight;

c) wherein the slide housing inside closed curve shape is the same as the drive housing outside closed curve shape wherein the slide housing inside closed curve shape size is nominally greater than the drive housing outside closed curve shape size and wherein the slide housing is positioned concentrically with the drive housing wherein the slide housing inside closed curve shaped surface is in slidable contact with the drive housing outside closed curve shaped surface wherein the slide housing first end is located substantially at the drive housing first end and wherein a housing slidable contact area is formed between the slide housing inside closed curve shaped surface and the concentric drive housing outside closed curve shaped surface;

d) and wherein the slide housing is slidable relative to the drive housing along the drive housing vertical rotation axis and wherein a first fluid pressure seal exists between the slide housing inside closed curve shaped surface and the drive housing outside closed curve shaped surface;

e) and wherein the slide housing second end has a slide housing spherical bearing concave surface having a slide housing spherical bearing concave surface spherical diameter and a slide housing spherical bearing concave surface spherical center of rotation;

f) a pivot rotor having a pivot rotor first end and a pivot rotor second end and a pivot rotor weight wherein the pivot rotor second end has a pivot rotor spherical bearing convex surface having a pivot rotor spherical bearing convex surface spherical diameter and a pivot rotor spherical bearing convex surface spherical center of rotation and wherein the pivot rotor spherical bearing convex surface spherical diameter is equal to the slide housing spherical bearing concave surface spherical diameter;

g) wherein the pivot rotor is positioned wherein the pivot rotor spherical bearing convex surface spherical center of rotation is coincident with the slide housing spherical bearing concave surface spherical center of rotation wherein the pivot rotor spherical bearing convex surface is in slidable contact with the slide housing spherical bearing concave surface and wherein a second fluid pressure seal is formed between the pivot rotor spherical bearing convex surface and the slide housing spherical bearing concave surface;

h) a rotatable workpiece carrier plate having a workpiece carrier plate first end and a workpiece carrier plate second end and a workpiece carrier plate weight wherein the workpiece carrier plate first end is attached to the pivot rotor second end and wherein the workpiece carrier plate second end has a workpiece carrier plate workpiece attachment surface and wherein the workpiece carrier plate has a drive spline spherical ball socket and wherein a spherical center of rotation of the pivot rotor is located a spherical rotation center offset distance measured from the pivot rotor spherical bearing convex surface spherical center of rotation to the workpiece carrier plate workpiece attachment surface;

i) wherein spherical rotation motion of the pivot rotor relative to the slide housing allows the workpiece carrier plate attached to the pivot rotor to be tilted relative to the drive housing vertical rotation axis;

j) a workpiece carrier plate vertical drive shaft having a vertical drive shaft first end and a vertical drive shaft second end wherein the vertical drive shaft first end is rotationally and slidably attached to the drive housing and the vertical drive shaft second end has a drive spline spherical ball end having a drive spline spherical ball end spherical rotation center wherein the drive spline spherical ball end rotationally and slidably engages the workpiece carrier plate drive spline spherical ball socket wherein rotation of the drive housing around the drive housing vertical rotation axis rotates the vertical drive shaft wherein rotation of the vertical drive shaft rotates the workpiece carrier plate around the drive housing vertical rotation axis;

k) wherein the vertical drive shaft first end remains rotationally and slidably attached with the drive housing and the vertical drive shaft second end drive spline spherical ball end remains rotationally and slidably engaged with the workpiece carrier plate drive spline spherical ball socket when the slide housing is moved relative to the drive housing along the drive housing vertical rotation axis and wherein the drive shaft spline spherical ball maintains rotational and slidable engagement with the workpiece carrier plate drive spline spherical ball socket when the workpiece carrier plate is tilted; and l) Wherein a fluid pressure sealed pressure chamber located in the drive housing internal opening is formed by; the drive housing, the slide housing, the pivot rotor, the second fluid pressure seal, and the rotatable drive spindle and wherein at least one fluid passageway in the rotatable drive spindle is fluid coupled to the fluid pressure sealed pressure chamber.

2. The apparatus of claim 1 wherein the drive housing transmits rotational torque to the vertical drive shaft that transmits the rotational torque to the workpiece carrier plate and wherein the workpiece carrier plate is rotationally coupled to the drive housing.

3. The apparatus of claim 1 wherein at least one weight counteracting rotor spring having a weight counteracting rotor spring first end and a weight counteracting rotor spring second end wherein the weight counteracting rotor spring first end is attached to the drive housing and the weight counteracting rotor spring second end is attached to the pivot rotor wherein the at least one weight counteracting rotor spring counteracts the weights of the pivot rotor, the slide housing and the workpiece carrier plate and wherein the at least one rotor spring urges the pivot rotor spherical slide bearing convex surface against the slide housing spherical slide bearing concave surface wherein the pivot rotor spherical slide bearing convex surface maintains contact with the slide housing spherical slide bearing concave surface.

4. A process for using the apparatus of claim 1 to counteract the weights of the slide housing, the pivot rotor and the workpiece carrier plate by applying vacuum to the fluid pressure sealed pressure chamber wherein the vacuum in the fluid pressure sealed pressure chamber acts on the slide housing and the pivot rotor and creates a vertical upward lifting force that counteracts the weights of the slide housing, the pivot rotor and the workpiece carrier plate.

5. The apparatus of claim 1 wherein at least one rigid abrading device having a first end and a second end wherein the at least one rigid abrading device second end is positioned in conformal contact with the workpiece carrier plate first end and wherein the at least one rigid abrading device first end is attached to the slide housing.

6. A process for using the apparatus of claim 1 in a rigid abrading mode compromising:

a) providing a rigid abrading device having a first end and a second end;

b) providing a rotatable platen having a platen flat surface wherein the platen flat surface is aligned perpendicular to the drive housing vertical rotation axis;

c) moving the slide housing vertically wherein the workpiece carrier plate workpiece attachment surface is positioned in conformal contact with the platen flat surface;

d) moving the rigid abrading device second end in conformal contact with the workpiece carrier plate first end and rigidly attaching the rigid abrading device first end to the slide housing;

e) moving the slide housing vertically upward wherein the workpiece carrier plate workpiece attachment surface moves away from the platen flat surface;

f) providing at least one workpiece having a workpiece top surface and a workpiece bottom surface wherein the at least one workpiece top surface is attached to the workpiece carrier plate workpiece attachment surface;

g) attaching abrasive to the platen flat surface, moving the slide housing and the attached at least one workpiece vertically downward wherein the at least one workpiece bottom surface is in abradable contact with the abrasive on the platen flat surface;

h) wherein rotation of the rotatable platen and rotation of the workpiece carrier plate to abrade the at least one workpiece bottom surface whereby the at least one abraded workpiece bottom surface is perpendicular to the drive housing vertical rotation axis.

7. The process according to claim 6 to abrade the at least one workpiece top surface using the rigid abrading device wherein after the at least one workpiece bottom surface of the at least one workpiece is abraded compromising: a) separating the at least one workpiece from the workpiece carrier plate workpiece attachment surface; b) attaching the at least one workpiece abraded workpiece bottom surface to the workpiece carrier plate second end workpiece attachment surface; c) moving the slide housing, the workpiece carrier plate and the attached at least one workpiece vertically wherein the at least one workpiece top surface is in abradable contact with the abrasive on the platen flat surface; d) and rotating the rotatable platen and rotating the workpiece carrier plate having the attached at least one workpiece to abrade the at least one workpiece top surface whereby the at least one workpiece top surface is perpendicular to the drive housing vertical rotation axis and the at least one workpiece top and bottom surfaces are parallel.

8. The apparatus of claim 1 wherein slidable spherical surface contact of the pivot rotor spherical slide bearing convex surface with the spherical bearing housing spherical slide bearing concave surface restrains the workpiece carrier plate in radial directions that are nominally-perpendicular to the drive housing vertical rotation axis.

9. The apparatus of claim 1 wherein the workpiece carrier plate vertical drive shaft drive spline spherical ball end spherical rotation center is located a drive shaft ball center offset distance measured from the drive spline spherical ball end spherical rotation center to the workpiece carrier plate workpiece attachment surface wherein the drive shaft ball center offset distance is less than 1.5 inches.

10. The apparatus of claim 1 wherein the pivot rotor spherical rotation center offset distance is less than 2.0 inches.

11. The apparatus of claim 1 wherein a counteracting housing spring having a first housing spring end attached to the drive housing and a second housing spring end attached to the slide housing counteracts the weight of the slide housing.

12. The apparatus of claim 1 wherein the vertical drive shaft is hollow and wherein a flexible lift wire having a lift wire first end and a lift wire second end is routed through a hollow opening in the vertical drive shaft wherein the flexible lift wire first end is attached to a lift spring second end wherein the lift spring first end is attached to the drive housing and wherein the flexible lift wire second end is attached to the workpiece carrier plate.

13. The apparatus of claim 1 wherein at least one workpiece having a workpiece top surface and a workpiece bottom surface and an at least one workpiece weight wherein the at least one workpiece top surface is attached to the workpiece carrier plate workpiece attachment surface.

14. A process for using the apparatus of claim 13 to abrade the at least one workpiece by providing a rotatable platen having a platen flat surface wherein the platen flat surface is aligned perpendicular to the drive housing vertical rotation axis, attaching abrasive to the platen flat surface, moving the slide housing and the attached at least one workpiece vertically downward wherein the at least one workpiece bottom surface is in abradable contact with the abrasive on the platen flat surface and rotating the rotatable platen and rotating the workpiece carrier plate to abrade the at least one workpiece bottom surface.

15. The process according to claim 14 further comprising wherein the abrasive attached to the platen flat surface is a flexible abrasive disc having an annular band of abrasive particles or abrasive beads filled with abrasive particles wherein the flexible abrasive disc is attached to the platen flat surface with vacuum.

16. The process according to claim 14 further comprising of lifting the at least one workpiece from abrading contact with the platen flat surface abrasive by counteracting the weights of the slide housing, the pivot rotor, the workpiece carrier plate and the at least one workpiece by applying vacuum to the fluid pressure sealed pressure chamber wherein the vacuum acts on the slide housing and the pivot rotor and creates a vertical upward lifting force that lifts the at least one workpiece attached to the workpiece carrier plate upward away from abrading contact with the abrasive on the platen flat surface.

17. The apparatus of claim 1 wherein a flexible tube having a flexible tube first end and a flexible tube second end wherein the flexible tube first end is fluid coupled to a fluid passageway in the rotatable drive spindle and the flexible tube second end is fluid coupled to a pivot rotor fluid passageway extending from the pivot rotor first end to the pivot rotor second end and wherein the pivot rotor fluid passageway at the pivot rotor second end is fluid coupled to fluid port holes in the workpiece carrier plate workpiece attachment surface.

18. A process for using the apparatus of claim 17 to abrade at least one workpiece by supplying vacuum to a fluid passageway in the rotatable drive spindle that is fluid coupled to the flexible tube first end that is fluid coupled to the fluid port holes in the workpiece carrier plate workpiece attachment surface to attach at least one workpiece top surface with vacuum to the workpiece carrier plate workpiece attachment surface, providing a rotatable platen having a platen flat surface wherein the platen flat surface is aligned perpendicular to the drive housing vertical rotation axis, attaching abrasive to the platen flat surface, moving the slide housing, the workpiece carrier plate and the attached at least one workpiece vertically wherein the at least one workpiece bottom surface is in abradable contact with the abrasive on the platen flat surface and rotating the rotatable platen and rotating the workpiece carrier plate to abrade the at least one workpiece bottom surface.

19. The process according to claim 18 further comprising to abrade the at least one workpiece by applying a fluid pressure to the fluid pressure sealed pressure chamber and rotating the rotatable platen and rotating the workpiece carrier plate having the attached at least one workpiece to abrade the at least one workpiece bottom surface.

20. The process according to claim 19 further comprising providing a uniform abrading pressure on the at least one workpiece abraded surface wherein fluid pressure is applied to the fluid pressure sealed pressure chamber wherein the fluid pressure sealed pressure chamber fluid pressure acts on the slide housing and the pivot rotor and creates an abrading pressure that is transmitted uniformly across the at least one workpiece bottom surface in abradable contact with an abrasive surface of the abrasive on the platen flat surface.

* * * * *